US007186489B2

(12) United States Patent
Uematsu et al.

(10) Patent No.: US 7,186,489 B2
(45) Date of Patent: Mar. 6, 2007

(54) ELECTROPHOTOGRAPHIC PHOTOSENSITIVE MEMBER, ELECTROPHOTOGRAPHIC PHOTOSENSITIVE MEMBER MANUFACTURING PROCESS, PROCESS CARTRIDGE, AND ELECTROPHOTOGRAPHIC APPARATUS

(75) Inventors: Hiroki Uematsu, Sunto-gun (JP); Tatsuya Ikezue, Toride (JP); Akira Shimada, Sunto-gun (JP); Takahiro Mitsui, Kashiwa (JP); Koichi Nakata, Toride (JP); Shuji Ishii, Tokyo (JP); Shoji Amamiya, Kashiwa (JP); Akio Maruyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/225,061

(22) Filed: Sep. 14, 2005

(65) Prior Publication Data

US 2006/0008717 A1 Jan. 12, 2006

Related U.S. Application Data

(63) Continuation of application No. PCT/JP2005/006427, filed on Mar. 25, 2005.

(30) Foreign Application Priority Data

Mar. 26, 2004 (JP) ..... 2004-092099
Apr. 27, 2004 (JP) ..... 2004-131660
Oct. 22, 2004 (JP) ..... 2004-308309

(51) Int. Cl.
*G03G 5/147* (2006.01)

(52) U.S. Cl. ..... 430/66; 430/56; 430/127

(58) Field of Classification Search ..... 430/56, 430/66, 127
See application file for complete search history.

(56) References Cited

U.S. PATENT DOCUMENTS 5,242,773 A * 9/1993 Iino et al. ..... 430/66
5,242,776 A * 9/1993 Doi et al. ..... 430/67
5,381,211 A * 1/1995 Godlove ..... 430/66
2004/0197689 A1* 10/2004 Landa et al. ..... 430/67

FOREIGN PATENT DOCUMENTS

JP 02-039158 2/1990
JP 02-139566 5/1990
JP 03-041456 2/1991
JP 04-175759 6/1992

(Continued)

OTHER PUBLICATIONS

Diamond, Arthur S & David Weiss (eds.) Handbook of Imaging Materials. New York: Marcel-Dekker, Inc. (Nov. 2001) pp. 145-164.*

*Primary Examiner*—Christopher RoDee
(74) *Attorney, Agent, or Firm*—Fitzpatrick, Cella, Harper & Scinto

(57) ABSTRACT

An electrophotographic photosensitive member is disclosed having a cylindrical support and an organic photosensitive layer provided on the cylindrical support. The peripheral surface of the electrophotographic photosensitive member is composed of grooves formed substantially in its peripheral direction and flat portions, and in the grooves, the number of grooves each having a width in the range of from 0.5 μm to 40 μm is from 20 to 1,000 lines per 1,000 μm in width in the generatrix direction of the peripheral surface of the electrophotographic photosensitive member.

8 Claims, 14 Drawing Sheets

FOREIGN PATENT DOCUMENTS

| | | |
|---|---|---|
| JP | 04-369654 | 12/1992 |
| JP | 05-333757 | 12/1993 |
| JP | 06-118662 | 4/1994 |
| JP | 08-076642 | 3/1996 |
| JP | 10-090928 | 4/1998 |
| JP | 2001-066814 | 3/2001 |
| JP | 2001-318480 | 11/2001 |
| JP | 2002-006526 | 1/2002 |
| JP | 2003-043708 | 2/2003 |
| JP | 2003-307859 | 10/2003 |
| JP | 2003-316175 | 11/2003 |
| JP | 2004-093863 | 3/2004 |

* cited by examiner

ELECTROPHOTOGRAPHIC PHOTOSENSITIVE MEMBER, ELECTROPHOTOGRAPHIC PHOTOSENSITIVE MEMBER MANUFACTURING PROCESS, PROCESS CARTRIDGE, AND ELECTROPHOTOGRAPHIC APPARATUS

BACKGROUND OF THE INVENTION

1. Field of the Invention

This invention relates to an electrophotographic photosensitive member, an electrophotographic photosensitive member manufacturing process, and a process cartridge and an electrophotographic apparatus which have the electrophotographic photosensitive member.

2. Related Background Art

As an electrophotographic photosensitive member, in view of low costs, high productivity and so forth, what is called an organic electrophotographic photosensitive member has become widely used which includes a cylindrical support and provided thereon a photosensitive layer (organic photosensitive layer) using organic materials as photoconductive materials (such as a charge generating material and a charge transporting material. As for the organic electrophotographic photosensitive member, in view of advantages such as high sensitivity and high durability, an electrophotographic photosensitive member is prevalent having the so-called multi-layer type photosensitive layer composed of a charge generation layer containing a charge generating material such as a photoconductive dye or a photoconductive pigment and a charge transport layer containing a charge transporting material such as a photoconductive polymer or a photoconductive low-molecular weight compound which are superposed one on another.

A cylindrical electrophotographic photosensitive member is commonly used including a cylindrical support and provided thereon a photosensitive layer.

The electrophotographic photosensitive member is used in an electrophotographic image forming process comprising a sequence of a charging step, an exposure step, a developing step, a transfer step and a cleaning step.

In the electrophotographic image forming process, the cleaning step for removing powdered paper, transfer residual toner and so forth present on the peripheral surface of the electrophotographic photosensitive member and cleaning the peripheral surface of the electrophotographic photosensitive member, is important in order to obtain sharp images.

As a method for such cleaning, in view of costs, easiness of design, and so forth, a method is prevalent in which a cleaning blade is brought into contact with the peripheral surface of the electrophotographic photosensitive member not to leave a space between the cleaning blade and the electrophotographic photosensitive member so that the powdered paper and transfer residual toner can be scraped off without leakage.

It has been conventionally rare to use very hard materials in an electrophotographic photosensitive member, and hence problems have often come about such that the electrophotographic photosensitive member significantly abrades to cause undesirable faulty images, or has a shortened lifetime.

Another problem has also come about such that charged products formed through a charging step cause charge generating materials, charge transporting materials, binder resins and so forth to deteriorate and lower electrophotographic performance.

However, in recent years, the selection of materials, the optimization of process conditions of electrophotographic apparatus, and so forth have enabled the abrasion or level of wear of the electrophotographic photosensitive member to be reduced, whereby a longer lifetime has been able to be achieved.

In recent years, a technique is proposed in which a layer with a high hardness is provided as a surface layer of the electrophotographic photosensitive member (the layer that is positioned at the outermost surface of the electrophotographic photosensitive member, in other words, the layer that is positioned farthest from its support) so that the abrasion or level of wear of the electrophotographic photosensitive member can be reduced to allow the electrophotographic photosensitive member to have a longer lifetime (see, e.g., Japanese Patent Applications Laid-open No. H05-034944, No. H05-066598 No. H05-088525 and No. H05-224452).

However, it has turned out that when the peripheral surface of the electrophotographic photosensitive member has a elevated hardness to reduce the abrasion or level of wear, the following problems are raised.

The charged products may be deposited on the electrophotographic photosensitive member and/or the peripheral surface of the electrophotographic photosensitive member may deteriorate because of electrification coming from the charging means, causing image deletion.

The friction between the electrophotographic photosensitive member and the cleaning blade for cleaning the toner remaining on the peripheral surface of the electrophotographic photosensitive member may increase to cause scraping or the blade to turn up.

A phenomenon may occur in which the edge of the cleaning blade is chipped off.

The peripheral surface of the electrophotographic photosensitive member can not easily be abraded even where external additives of the toner, paper dust of the transfer sheet, and so forth are deposited on the peripheral surface of the electrophotographic photosensitive member, and hence the melt adhesion of toner may occur around these foreign particles serving as starting points, increasing a probability of causing scratches on the peripheral surface of the electrophotographic photosensitive member because of the pressure contact with the cleaning blade.

In an attempt to solve the above problems, it is proposed that, e.g., the peripheral surface of the electrophotographic photosensitive member is periodically subjected to abrading, or a means is provided inside the electrophotographic apparatus to subject the peripheral surface of the electrophotographic photosensitive member to abrading (see, e.g., Japanese Patent Applications Laid-open No. H05-204282, No. H05-323833 and No. H06-051674).

However, the former is not effective if the surface roughness resulting from the abrading exceeds a certain suitable range, and the abrading tends to cause deterioration in image formation if such surface roughness goes beyond the certain suitable range. Also, even if the surface roughness is within the suitable range, though effective in the initial stage of the paper feed running, the electrophotographic photosensitive member may gradually abrade during the paper feed running, so that the surface shape may change to tend to cause the above problems after all.

In the latter, there is such a problem that the electrophotographic apparatus itself becomes large-sized. Also, even if such a means for abrading the peripheral surface of the electrophotographic photosensitive member is provided inside the electrophotographic apparatus, since the conditions under which the charged products, the external toner additives, the powderd paper and so forth adhere to the peripheral surface of the electrophotographic photosensitive member during the paper feed running are not constant, it is difficult to find conditions which can solve the problems.

SUMMARY OF THE INVENTION

An object of the present invention is to provide an electrophotographic photosensitive member which minimizes the above problems, a process for manufacturing the electrophotographic photosensitive member, and a process cartridge and an electrophotographic apparatus which have the electrophotographic photosensitive member.

The present invention is a cylindrical electrophotographic photosensitive member which comprises a cylindrical support and an organic photosensitive layer provided on the cylindrical support, wherein;

a plurality of grooves each having a width in a range of from 0.5 μm to 40 μm are formed on the peripheral surface of the electrophotographic photosensitive member substantially in the peripheral direction of the peripheral surface; and the number of the grooves is from 20 lines to 1,000 lines per 1,000 μm in width in the generatrix direction of the peripheral surface.

The present invention is also a process for manufacturing the electrophotographic photosensitive member, which comprises a surface layer forming step of forming a surface layer of the electrophotographic photosensitive member, and a surface roughening step of roughening the surface of the surface layer.

The present invention is still also a process cartridge which comprises the electrophotographic photosensitive member described above, and at least one means selected from the group consisting of a charging means, a developing means, a transfer means and a cleaning means, which are integrally supported; the process cartridge being detachably mountable to the main body of an electrophotographic apparatus.

The present invention is still also an electrophotographic apparatus which comprises the electrophotographic photosensitive member described above, a charging means, an exposure means, a developing means, a transfer means and a cleaning means.

According to the present invention, it is possible to provide the electrophotographic photosensitive member which minimizes the above problems, the process for manufacturing such an electrophotographic photosensitive member, and the process cartridge and the electrophotographic apparatus which have the electrophotographic photosensitive member.

DETAILED DESCRIPTION OF THE PREFERRED EMBODIMENTS

Figure 1:
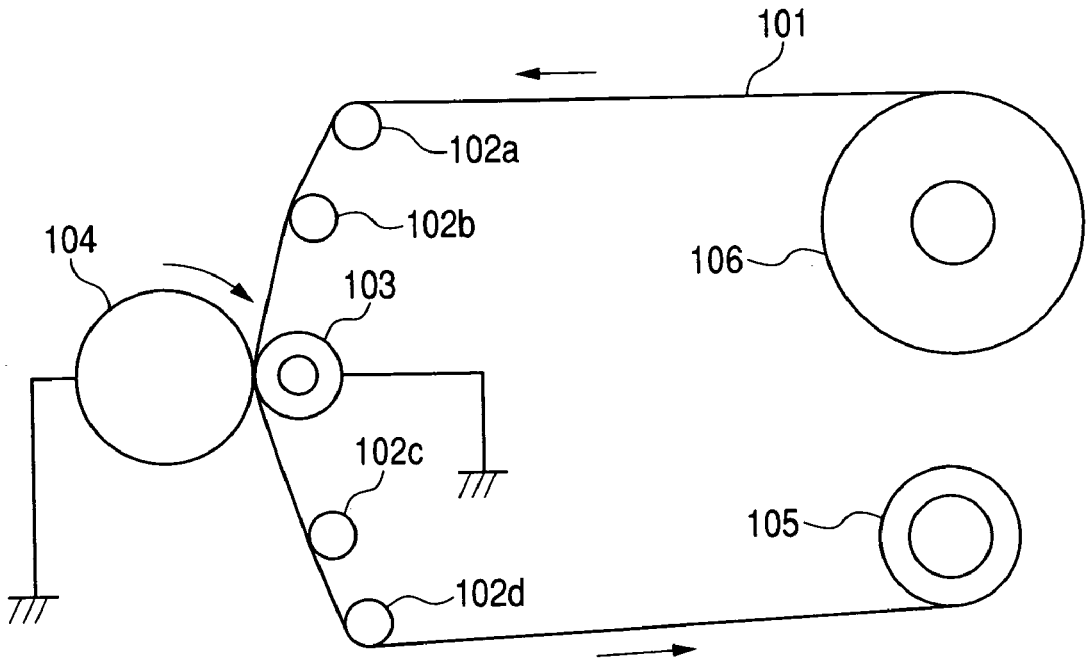
FIG. 1 illustrates an example of an abrader making use of an abrasive sheet.

The electrophotographic photosensitive member of the present invention is a cylindrical electrophotographic photosensitive member which comprises a cylindrical support and an organic photosensitive layer provided on the cylindrical support, and is characterized in that a plurality of grooves each having a width in the range of from 0.5 μm to 40 μm are formed on its peripheral surface substantially in the peripheral direction of the peripheral surface, and the number of the grooves is from 20 lines to 1,000 lines per 1,000 μm in width in the generatrix direction of the peripheral surface. (Hereinafter, the number of the grooves having a width in the range of from 0.5 μm to 40 μm, per 1,000 μm in width in the generatrix direction of the peripheral surface is also called "groove density". That is, in the case of the foregoing, the groove density is from 20 to 1,000.)

If the groove density is smaller than 20, and when used in an electrophotographic apparatus carrying a cleaning means having a cleaning blade, the edge of the cleaning blade may chipped off with an increase in the number of sheets in paper feed running to cause faulty cleaning, so that black line-shaped images tend to appear on reproduced images, or cause melt adhesion of toner and so forth, so that white dot-shaped images tend to appear on reproduced images.

If the groove density is less than 20, and when used in a cleanerless electrophotographic apparatus, the charging means may be contaminated, the charging performance of toner in the developing means may deteriorate, and the transfer means may be scratched.

If on the other hand the groove density is more than 1,000, character reproducibility may lower to make it difficult for small-character (e.g., characters of 3 points or less) images to be reproduced, resulting in blurred images, or, especially in an environment of low humidity, faulty cleaning may occur such that the toner leaks from the cleaning blade.

Grooves of more than 40 μm in width tend to cause tone non-uniformity or white scratched images on halftone images, depending on the charge potential of the electrophotographic photosensitive member and the constitution of the toner. Such grooves tend to cause black scratched images on white-background images. Accordingly, the grooves of more than 40 μm in width among grooves formed on the peripheral surface of the electrophotographic photosensitive member may preferably be in a proportion of not more than 20% by number of lines based on the number of all the grooves formed on the peripheral surface of the electrophotographic photosensitive member.

The part (flat area) between a groove and a groove which are formed substantially in the peripheral direction of the peripheral surface of the electrophotographic photosensitive member may also preferably be in a width of from 0.5 μm to 40 μm.

If the flat area is in a width of more than 40 μm, and when used in an electrophotographic apparatus carrying a cleaning means having a cleaning blade, the torque acting between the electrophotographic photosensitive member and the cleaning blade tends to increase to cause faulty cleaning.

It is also preferable to satisfy the following relation (a), where the number of grooves formed in plurality on the peripheral surface of the electrophotographic photosensitive member and falling under the range of from 0.5 μm to 40 μm in width is i-lines per 1,000 μm in width ($20 \leqq i \leqq 1{,}000$) of the generatrix direction of the peripheral surface (that is, the groove density is "1"), and the widths of the i-lines of grooves falling under the range of from 0.5 μm to 40 μm in width are represented by $W_1$ to $W_i$ (μm).

$$200 \leqq \sum_{n=1}^{i} Wn \leqq 800 \tag{a}$$

The above relation (a) means that the total of the widths of i-lines of grooves falling under the range of from 0.5 μm to 40 μm in width is 200 μm or more and 800 μm or less.

If the total of such widths of grooves is more than 800 μm, and when used in an electrophotographic apparatus carrying a cleaning means having a cleaning blade, faulty cleaning tends to occur because of toner leakage at the part between the electrophotographic photosensitive member and the cleaning blade. On the other hand, if the total of the widths of grooves is less than 200 μm, the torque acting between the electrophotographic photosensitive member and the cleaning blade tends to increase to cause faulty cleaning due to quiver accompanied by squeak or scraping, or turning-up of the blade.

In the present invention, the width of each groove formed on the peripheral surface of the electrophotographic photosensitive member, the groove density and the width of each flat area are measured in the following way, using a non-contact three-dimensional surface measuring instrument MICROMAP 557N, manufactured by Ryoka Systems Inc.

First, a 5-magnification two-beam interference objective lens is fitted to an optical microscope of the MICROMAP. An interference image is vertically scanned with a CCD camera in a wave mode to obtain a three-dimensional image as a surface shape image. The image obtained is in the range of 1.6 mm×1.2 mm.

Next, the three-dimensional image obtained is analyzed, where the number of grooves per 1,000 μm in unit length and the widths of the grooves are obtained as data. On the basis of the data, the number of grooves and the widths of the grooves can be analyzed.

In addition, in the present invention, the grooves of 0.5 μm or more in width are counted, and measurement spots are set to be 3 spots in the generatrix direction of the electrophotographic photosensitive member, and for each of the 3 spots, 4 spots in the peripheral direction, i.e., 12 spots in total.

With regard to the widths of grooves and the number of grooves, besides MICROMAP, commercially available laser microscopes such as an ultra-depth shape measuring microscope VK-8550 or VK-9000 (manufactured by Keyence Corporation), a scanning conforcal laser microscope OLS3000 (manufactured by Olympus Corporation), a real-color conforcal microscope OPTELICS C130 (manufactured by Lasertec Corporation) and a digital microscope VHX-100 or VH-8000 (manufactured by Keyence Corporation) may be used to obtain an image of the peripheral surface of the electrophotographic photosensitive member, on the basis of which the widths of grooves and the number of grooves may be determined using image processing software (e.g., WinROOF, available from Mitani Corporation). A non-contact three-dimensional surface measuring instrument NewView 5032 (manufactured by Zygo Corporation) may also be used to carry out the measurement in the same way as MICROMAP.

The peripheral surface of the electrophotographic photosensitive member may preferably have a ten-point average surface roughness Rz of from 0.3 μm to 1.3 μm. If it is less than 0.3 μm, the effect of preventing image deletion may be reduced. If it is more than 1.3 μm, the character reproducibility may lower to make it difficult for small-character (e.g., characters of 3 points or less) images to be reproduced, resulting in crushed images.

In addition, the ten-point average surface roughness Rz of the peripheral surface of the electrophotographic photosensitive member is one of indexes that represent the depths of grooves.

In the present invention, the peripheral surface of the electrophotographic photosensitive member may preferably have a difference between maximum surface roughness Rmax and ten-point average surface roughness Rz, Rmax−Rz, of 0.3 μm or less, and more preferably 0.2 μm or less. If it is more than 0.3 μm, the tone non-uniformity may occur on halftone images.

In the present invention, the ten-point average surface roughness Rz and maximum surface roughness Rmax of the peripheral surface of the electrophotographic photosensitive member are measured under the following conditions, according to JIS Standard 1982 using a surface roughness measuring instrument SURFCODER SE3500 Model (manufactured by Kosaka Laboratory Ltd.).

Detector: A diamond stylus of R 2 μm and 0.7 mN.

Filter: 2CR.

Cut-off value: 0.8 mm.

Measured length: 2.5 mm.

Feed speed: 0.1 mm.

In addition, in the present invention, measurement spots are set to be 3 spots in the generatrix direction of the electrophotographic photosensitive member, and for each of the 3 spots, 4 spots in the peripheral direction, i.e., 12 spots in total.

The electrophotographic photosensitive member of the present invention is described below together with how to manufacture the same.

The electrophotographic photosensitive member of the present invention may be manufactured by, e.g., forming a surface layer of the electrophotographic photosensitive member, and thereafter roughening the surface of the surface layer so that the state of the peripheral surface of the electrophotographic photosensitive member having been completed fulfills the above conditions.

As other methods, the following are available: a method in which the photosensitive layer and so forth are successively superposed on a surface-roughened cylindrical support so as to reflect the surface shape of the support on the peripheral surface of the electrophotographic photosensitive member, and a method in which, where the surface layer is formed by using a surface layer coating fluid, the surface is roughened before the surface layer coating fluid is completely dried (hardened) (i.e., while having flowability).

Next, an example of an abrader making use of an abrasive sheet is shown in FIG. 1 as an example of a roughening means usable in the process for manufacturing the electrophotographic photosensitive member of the present invention. The abrasive sheet refers to a sheet-like abrasive member including a sheet-like substrate and provided thereon a layer in which abrasive grains have been dispersed in a binder resin.

As shown in FIG. 1, an abrasive sheet 101 is wound around a hollow shaft 106, and a motor (not shown) is so disposed that tension is applied to the abrasive sheet 101 in the direction opposite to the direction in which the abrasive sheet 101 is fed to the shaft 106. The abrasive sheet 101 is fed in the direction of an arrow, and passes through a back-up roller 103 via guide rollers 102*a* and 102*b*. After abrading, the abrasive sheet 101 is wound up on a wind-up means 105 by means of a motor (not shown) via guide rollers 102*c* and 102*d*. The abrading is carried out while the abrasive sheet 101 is brought in contact with an abrading object 104 (an electrophotographic photosensitive member the peripheral surface of which has not been surface-roughened (abraded) or an electrophotographic photosensitive member the peripheral surface of which has not been surface-roughened (abraded) and cleaned), and surface-roughening the peripheral surface of the abrading object 104. The abrasive sheet 101 is insulative in many cases. Accordingly, one having been grounded to earth or one having conductivity may preferably be used at the part with which the abrasive sheet 101 comes into contact.

The abrasive sheet 101 may preferably be fed at a feed speed ranging from 10 to 500 mm/min. If the feed speed is small, the peripheral surface of the abrading object 104 may deeply be scratched, the grooves may become non-uniform, the binder resin may adhere to the surface of the abrasive sheet 101, and so forth.

The abrading object 104 is placed at the position facing the back-up roller 103 via the abrasive sheet 101. Here, the back-up roller 103 is pressed against the abrasive sheet 101 on its substrate side at a desired set value and for a stated time, and the peripheral surface of the abrading object 104 is surface-roughened. The abrading object 104 may be rotated in the same direction as, or in the direction opposite to, the direction in which the abrasive sheet 101 is fed. Also, in the meddle of surface roughening, the rotational direction may be changed.

The back-up roller 103 may be pressed against the abrading object 104 at a pressure of from 0.005 to 15 $N/m^2$, within the range of which the electrophotographic photosensitive member having been completed can readily have the peripheral-surface shape specified in the present invention. The peripheral-surface shape (such as groove width, groove density and surface roughness) may be controlled by appropriately selecting the feed speed of the abrasive sheet 101, the pressure to press the back-up roller 103, the particle diameter and shape of abrasive grains, the count of abrasive grains to be dispersed in the abrasive sheet, the binder resin layer thickness of the abrasive sheet, the thickness of the substrate, and so forth.

The abrasive grains may include, e.g., particles of aluminum oxide, chromium oxide, diamond, iron oxide, cerium oxide, corundum, quartzite, silicon nitride, boron nitride, molybdenum carbide, silicon carbide, tungsten carbide, titanium carbide and silicon oxide. The abrasive grains may preferably have an average particle diameter of from 0.01 μm to 50 μm, and more preferably from 1 μm to 15 μm. If the abrasive grains have a too small average particle diameter, it is difficult for the electrophotographic photosensitive member having been completed to have the peripheral-surface shape specified in the present invention. In particular, the groove width can not readily be the value specified in the present invention. On the other hand, if the abrasive grains have a too large average particle diameter, a large difference in the value of Rmax−Rz tends to result. In addition, the average particle diameter of the abrasive grains is the median diameter D50 as measured by centrifugal sedimentation.

The abrasive sheet may be produced by coating a substrate with a coating fluid prepared by dispersing the abrasive grains in a binder resin. The abrasive grains in the binder resin may stand dispersed having particle size distribution to a certain extent. Instead, the particle size distribution may be controlled. For example, even where the average particle diameter is the same, grains on the side of large particle diameter may be removed, whereby the value of Rmax−Rz can be made small. Also, this can control the scattering of average particle diameter of the abrasive grains when the abrasive sheet is produced. As a result, the Rz of the electrophotographic photosensitive member having been completed can be kept from scattering.

The count of the abrasive grains to be dispersed in the binder resin of the abrasive sheet correlates with the average particle diameter of the abrasive grains. The larger the count is in number, the larger the average particle diameter of the abrasive grains is. Accordingly, the peripheral surface of the electrophotographic photosensitive member having been completed tends to be scratched. The count of the abrasive grains to be dispersed in the abrasive sheet may preferably be in the range of from 500 to 20,000, and more preferably in the range of from 1,000 to 3,000.

As the binder resin in which the abrasive grains used in the abrasive sheet are to be dispersed, the following are usable: known thermoplastic resins, heat curable resins, reactive resins, electron ray curable resins, ultraviolet ray curable resins, visible-light curable resins and mildew proof resins. The thermoplastic resins may include, e.g., vinyl chloride resins, polyamide resins, polyester resins, polycarbonate resins, amino resins, a styrene-butadiene copolymer, urethane elastomers, and polyamide-silicone resins. The heat curable resins may include, e.g., phenol resins, phenoxy resins, epoxy resins, polyurethane resins, polyester resins, silicone resins, melamine resins and alkyd resins.

The layer formed by dispersing the abrasive grains in the binder resin of the abrasive sheet may preferably have a layer thickness of from 1 μm to 100 μm. If it has a too large layer thickness, the layer thickness tends to become non-uniform, so that the surface of the abrasive sheet may have a large unevenness to tend to result in a large value of Rmax−Rz when the abrading object is abraded. On the other hand, if it has a too small layer thickness, the abrasive grains tend to come off.

In the present invention, as the abrasive sheet, e.g., those commercially available as given below are usable.

MAXIMA, MAXIMA T Type, available from Ref-Lite Co., Ltd.

LAPIKA, available from Kovax Co., Ltd.

MICROFINISHING FILM, a lapping film available from Sumitomo 3M Limited.

MIRROR FILM, a lapping film available from Sankyo Rikagaku Co., Ltd.

MIPOX, available from Nippon Microcoating K.K.

In the present invention, the surface roughening step (abrading step) may also be carried out over a plurality of times so that the electrophotographic photosensitive member having the desired peripheral-surface shape can be obtained. In such a plurality of steps, the abrading may be carried out first using an abrasive sheet in which abrasive grains with rough count are dispersed, then using an abrasive sheet in which abrasive grains with fine count are dispersed, or may be carried out first using an abrasive sheet in which abrasive grains with fine count are dispersed, then using an abrasive sheet in which abrasive grains with rough count are dispersed. In the former case, it is possible to superimpose fine grooves over rough grooves on the peripheral surface of the electrophotographic photosensitive member. In the latter case, it is possible to reduce non-uniformity of grooves.

The abrading may also be carried out using abrasive sheets having the same count but different in abrasive grains. Since such different abrasive grains have different hardness, the peripheral-surface shape of the electrophotographic photosensitive member can be optimized.

The substrate used in the abrasive sheet may include, e.g., substrates of polyester resins, polyolefin resins, cellulose resins, polyvinyl resins, polycarbonate resins, polyimide resins, polyamide resins, polysulfone resins and polyphenylsulfone resins.

The substrate of the abrasive sheet may preferably have a thickness of from 10 μm to 150 μm, and more preferably from 15 μm to 100 μm. If the substrate has a too small thickness, the pressure may become non-uniform when the abrasive sheet is pressed against the peripheral surface of the abrading object by the back-up roller. This may cause the abrasive sheet to twist, so that non-abraded portions of about a few mm in size may come about at depressed portions of the peripheral surface of the electrophotographic photosensitive member, and deep grooves at raised portions, and these may appear as density non-uniformity on halftone images. If the substrate has a too large thickness, the abrasive sheet itself has so high a hardness that non-uniformity of abrasive grains, non-uniformity of pressing pressure, and so forth may inevitably be reflected on the peripheral-surface shape of the electrophotographic photosensitive member.

The back-up roller 103 is a means that is effective as a means for assisting the formation of the grooves on the peripheral surface of the abrading object 104. The abrading may be effected only by the tension of the abrasive sheet 101. A method may be employed in which, without using the back-up roller 103, the grooves are formed on the peripheral surface of the abrading object 104 only by the tension of the abrasive sheet 101. However, where the surface layer of the electrophotographic photosensitive member has a high hardness (where a curable resin is chiefly used), with only the tension of the abrasive sheet 101, pressure for bringing the sheet into contact with the peripheral surface of the abrading object 104 is too low. Accordingly, the method is preferred which makes use of the back-up roller.

Figure 2:
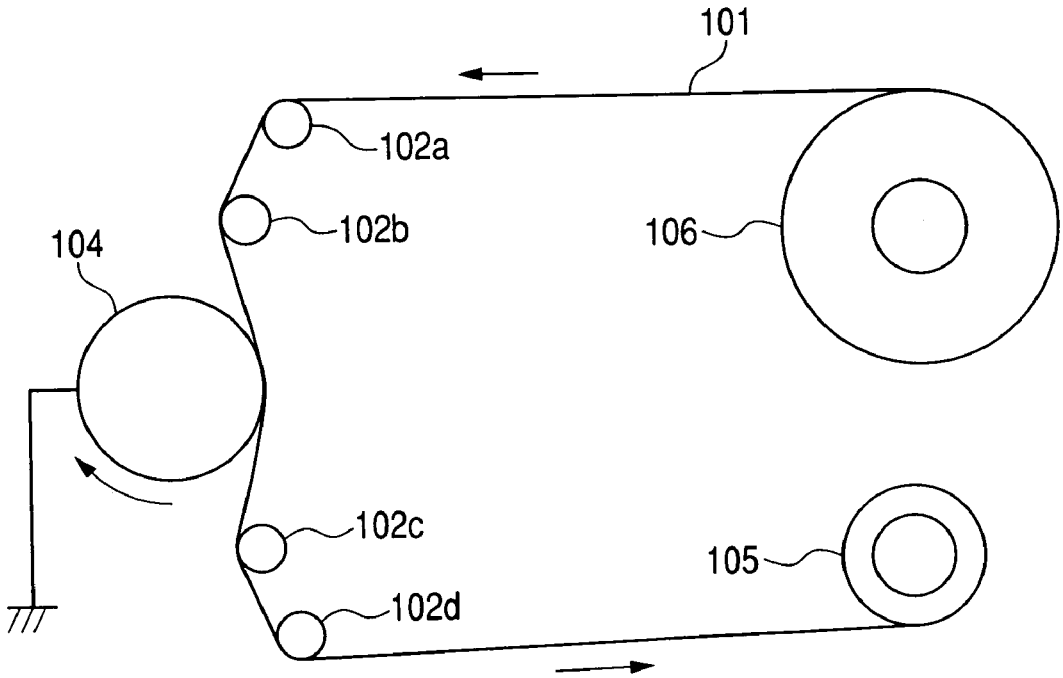
FIG. 2 illustrates an example in which the peripheral surface of an abrading object 104 is abraded only by the tension of an abrasive sheet 101.

An example in which the peripheral surface of the abrading object 104 is abraded only by the tension of the abrasive sheet 101 is shown in FIG. 2. This example differs from the example shown in FIG. 1 in that the back-up roller 103 is not provided and the shape of grooves to be formed on the peripheral surface of the abrading object 104 is controlled primarily depending on the count of the abrasive grains used in the abrasive sheet 101, the pressure to press the abrasive sheet 101 against the abrading object 104, the abrading time and so forth.

Materials for the back-up roller 103 used in the abrader may include metals and resins. In the step of surface-roughening (abrading) the peripheral surface of the abrading object 104, it is considered that abrading pressure distribution may become non-uniform on the peripheral surface of the abrading object 104 because of cylinder vibration of the abrading object 104, cylinder vibration of the back-up roller 103, abrading pressure distribution in the thrust direction of the abrasive sheet 101, and so forth. In consideration of absorbing these, the material for the back-up roller 103 may preferably be a resin. Further, taking into account the non-uniformity of abrading pressure distribution in the first place, the material for the back-up roller 103 may more preferably be, among resins, a foamable resin. In particular, since the abrasive sheet 101 is basically insulative and the peripheral surface of the abrading object 104 is electrostatically charged because of friction, the back-up roller 103 may more preferably be made of a material having conductivity, for the purpose of keeping voltage from being raised.

In addition, even where the back-up roller 103 is made of a material having conductivity, the part between the surface of the abrasive sheet 101 and the peripheral surface of the abrading object 104 is not conductive. Hence, the surface of the abrasive sheet 101 and the peripheral surface of the abrading object 104 is not a little electrostatically charged during the abrading. Charging voltage may differ depending on the resistance each material has. In a high-voltage case, the surfaces may be charged to a few kV. Accordingly, decharged air or electrostatic air may be blown in the course of surface roughening, on the peripheral surface of the abrading object, the abrasive sheet, the nip between these, and so forth.

In the case where the foamable resin is used in the back-up roller, if its hardness is low, the back-up roller is deformed even when the pressure to press the roller against the abrading object is raised, so that it is difficult for the electrophotographic photosensitive member having been completed to have the peripheral-surface shape specified in the present invention. Hence, in the case where the foamable resin is used, the back-up roller may preferably have a hardness of 10 or more in Asker-C hardness. On the other hand, the upper-limit value of the hardness may preferably be 70 or less in order to keep the groove density, the groove width and the value of Rmax−Rz within the above ranges. More preferably, the back-up roller may have an Asker-C hardness of from 15 to 65, and sill more preferably from 25 to 60.

The back-up roller that satisfies the Asker-C hardness of 10 or more may include rollers made of materials such as polyurethane resins, polystyrene resins, polypropylene resins, polycarbonate resins, polyolefin resins, fluorine rubbers and phenol resins.

The Asker-C hardness is measured by bringing a rubber hardness meter ESC Type (SRIS0101/Type C), manufactured by Elaston Co., into contact with the back-up roller, and reading the position of a pointer.

In the case where the foamable resin is used in the back-up roller, foreign particles tend to gather in the holes of foamed resin. Hence, attention should be fully paid so as for the foreign particles not to enter at the interface between the abrasive sheet and the back-up roller. For that purpose, it is effective to continuously blow air or the like on the back-up roller.

Besides the foamable resin, a resin that satisfies values of from 5 to 70, and particularly from 10 to 40, in Shore-A hardness may also be used as a preferable material.

Such a back-up roller that satisfies the Shore-A hardness of from 5 to 70 may include rollers made of materials such as polyurethane resins, polystyrene resins, polypropylene resins, polycarbonate resins, polyolefin resins, fluorine rubbers and phenol resins.

The Shore-A hardness is measured by bringing a rubber hardness meter ESA Type (JIS 6253/ISO7619 Type A), manufactured by Elaston Co., into contact with the back-up roller, and reading the position of a pointer.

Figure 3:
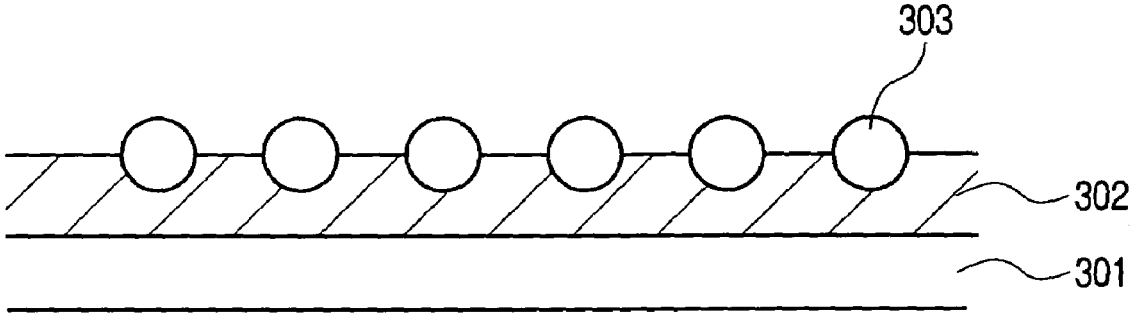
FIG. 3 illustrates an example of the abrasive sheet.

FIG. 3 shows an example of the abrasive sheet. The abrasive sheet shown in FIG. 3 is so constructed that a substrate 301 is coated with a binder resin 302 in which abrasive grains 303 have been dispersed.

Figure 4:
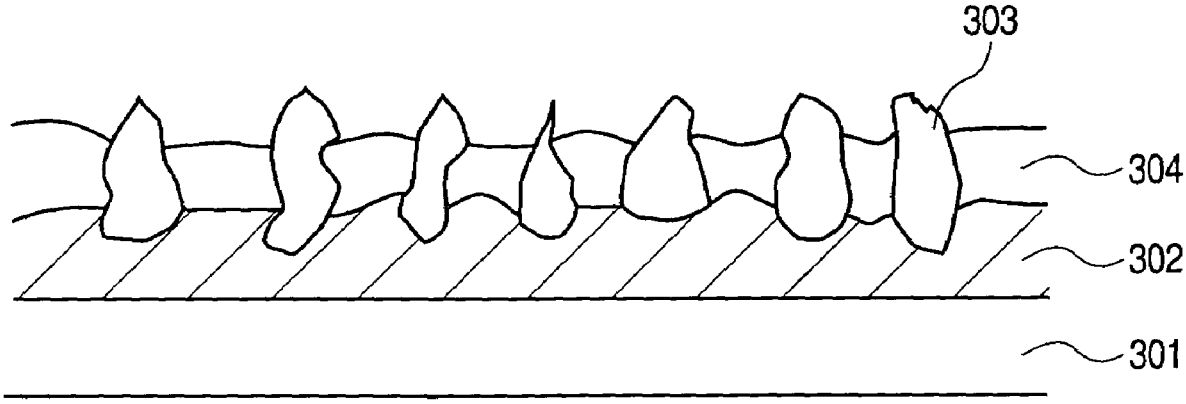
FIG. 4 illustrates another example of the abrasive sheet.

FIG. 4 shows another example of the abrasive sheet. The abrasive sheet shown in FIG. 4 is one whose abrasive grains 303 have upward sharp edges. The substrate 301 is coated with a binder resin 302 and abrasive grains 303 (by electrostatic coating or the like), and thereafter coated with a binder resin 304 to stabilize the sharp edges of the abrasive grains 303.

Figure 5A:
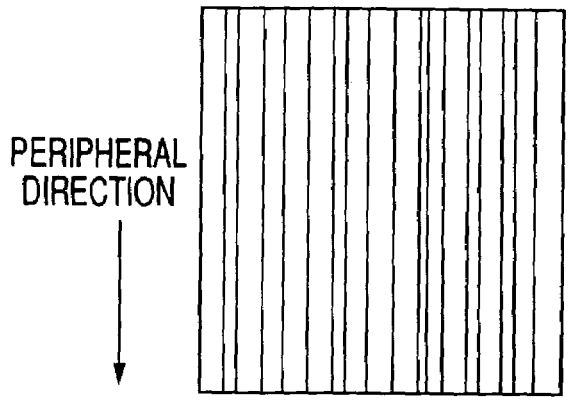
FIGS. 5A, 5B and 5C illustrate examples showing a state of grooves on the peripheral surface of the electrophotographic photosensitive member of the present invention.
Figure 5B:
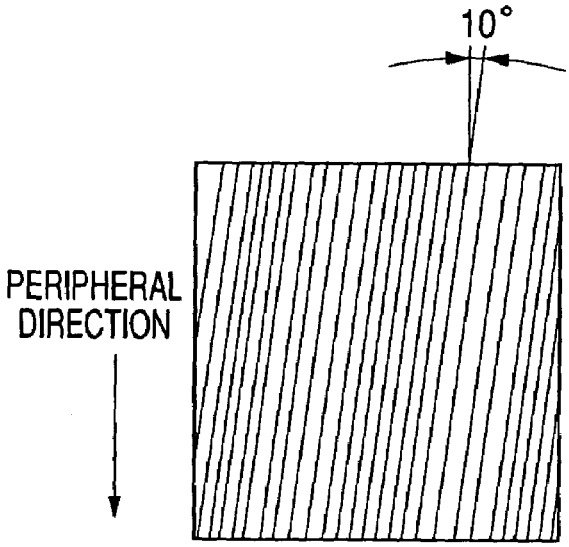
Figure 5C:
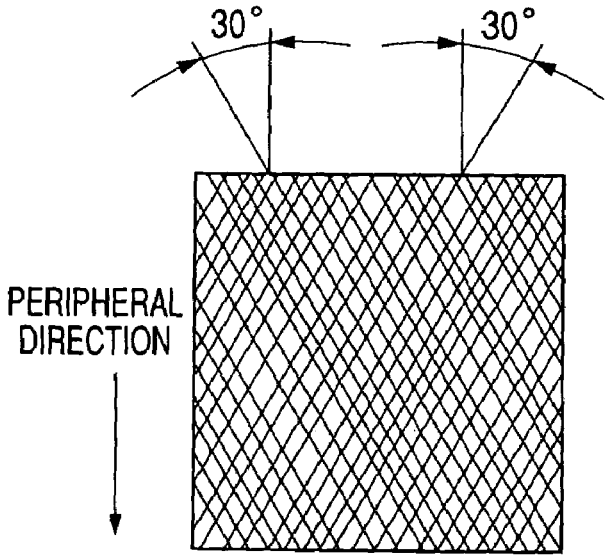

FIGS. 5A to 5C illustrate examples showing a state of grooves on the peripheral surface of the electrophotographic photosensitive member of the present invention.

FIG. 5A shows a state in which the grooves are formed in the same direction as the peripheral direction; FIG. 5B, a state in which the grooves are so formed as to have an angle of 10 degrees in the peripheral direction; and FIG. 5C, a state in which the grooves are so formed as to have an angle of ±30° in the peripheral direction (a state in which grooves in two directions are superimposed). In addition, in the present invention, the wording "substantially in the peripheral direction" refers to a case in which the grooves are formed perfectly in the peripheral direction and a case in which they are formed approximately in the peripheral direction. What is meant by "approximately the peripheral direction" is, stated specifically, the direction of ±60° with respect to the peripheral direction.

Where the electrophotographic apparatus carrying a cleaning means having a cleaning blade is used, the angles of grooves with respect to the peripheral direction may preferably be as small as possible in order to make small the contact area of the cleaning blade with the peripheral surface of the electrophotographic photosensitive member to achieve better cleaning performance. Stated specifically, the grooves may preferably be at an average angle of less than 45 degrees, and particularly an average angle of less than 30 degrees. On the other hand, where foreign particles are caught by a member brought into contact with the electrophotographic photosensitive member, such as an edge of the cleaning blade, the grooves may be made to have angles with respect to the peripheral direction. This is preferable because the foreign particles are removable with ease. It is more preferable for the grooves to be so formed that grooves in two or more directions are superimposed.

Figure 6:
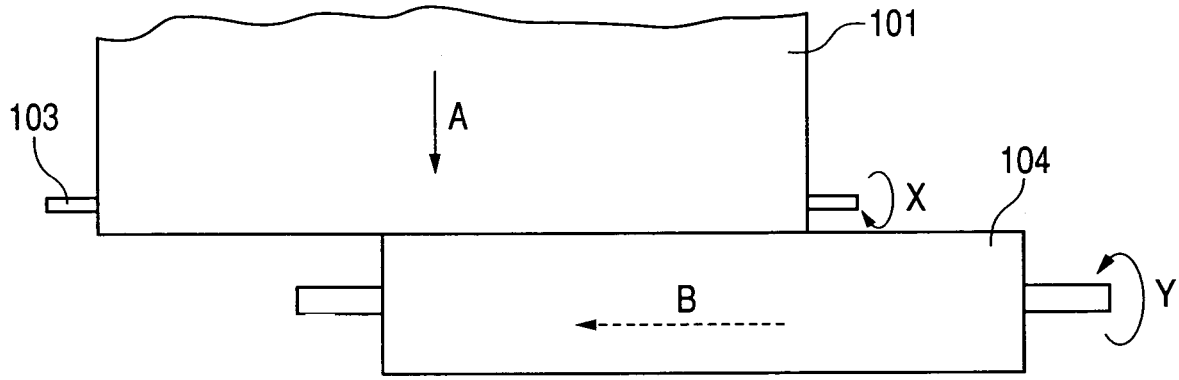
FIG. 6 illustrates an example of how to form grooves at an angle of 10 degrees.

An example of how to form the grooves at an angle of 10 degrees as shown in FIG. 5B is shown in FIG. 6.

In FIG. 6, the abrasive sheet 101 is wound up in the direction of an arrow A, and the back-up roller 103 is rotated following motion around a support shaft (not shown) in the same direction, the direction of an arrow X. The abrading object 104 is rotated in the direction of an arrow Y. The abrading object 104 is moved in the direction of an arrow B in the state the abrading object 104 is pressed by the back-up roller 103. Thus, the above grooves are formed. The angle with respect to the peripheral direction, of the grooves on the peripheral surface of the electrophotographic photosensitive member is controlled by selecting the feed speed of the abrasive sheet 101 and abrading object 104, the number of revolutions of the abrading object 104, and so forth.

Figure 7:
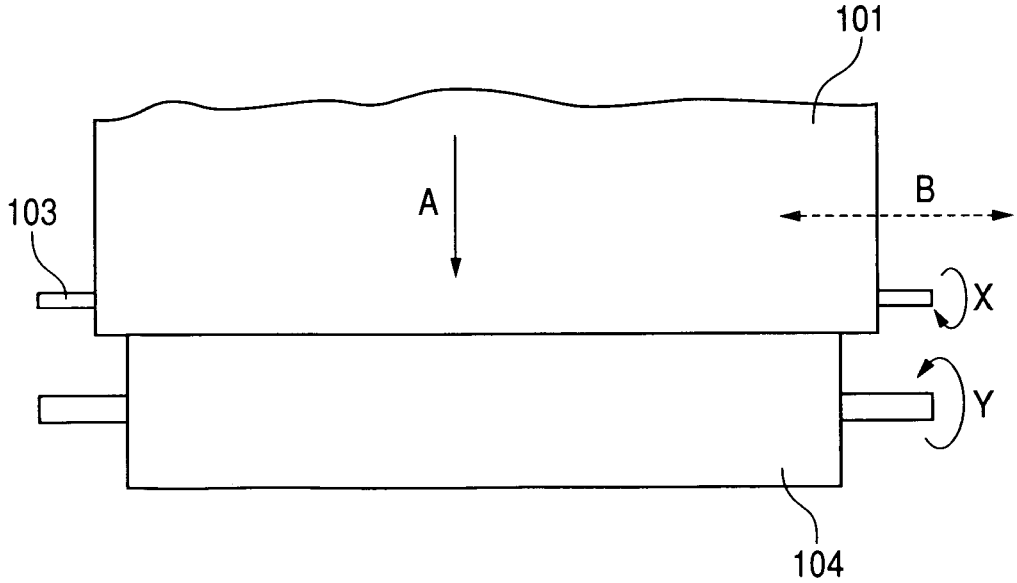
FIG. 7 illustrates an example of how to form grooves at an angle of ±30 degrees.
Figure 8:
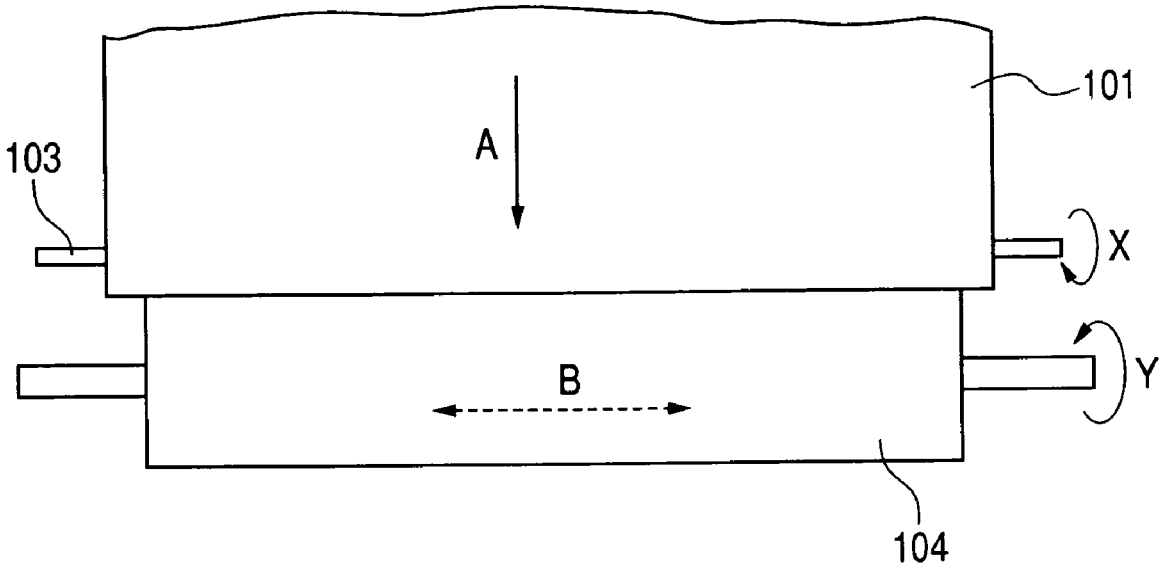
FIG. 8 illustrates an example of how to form grooves at an angle of ±30 degrees.

Examples of how to form the grooves at an angle of ±30 degrees are shown in FIGS. 7 and 8.

In FIG. 7, the abrasive sheet 101 is wound up in the direction of an arrow A, and the back-up roller 103 is rotated around a support shaft (not shown) in the direction of an arrow X. Simultaneously therewith, the member holding the back-up roller 103 is moved in the direction of an arrow B, whereby the abrasive sheet 101 is likewise moved. Thus, the angle is formed. The setting of the angle may be controlled by selecting the width of movement of the abrading object 104 and back-up roller 103, changing the period of the movement, and selecting the feed speed of the abrasive sheet 101.

In the case of FIG. 8, as being different form the case of FIG. 7, the member holding the abrading object 104 is moved right and left in the direction of an arrow B at the same time the abrading object 104 is rotated in the direction of an arrow Y when the abrasive sheet 101 is wound up, whereby the angle is formed. The changing of the angle may be controlled by the same setting as the case of FIG. 6.

The angle of grooves on the peripheral surface of the electrophotographic photosensitive member in the peripheral direction is measured with a color laser microscope (an ultra-depth shape measuring microscope VK-8550) manufactured by Keyence Corporation, by observing the peripheral surface of the electrophotographic photosensitive member with an objective lens of 20 magnifications.

Where the peripheral surface of the abrading object is surface-roughened with the abrasive sheet, phenomena may come about such that the dust formed when the peripheral surface of the abrading object is abraded is deposited in the interiors of the grooves, both edges of grooves are raised, and both edges of grooves formed conceal the grooves again. If an electrophotographic photosensitive member involved in such phenomena is set in the electrophotographic apparatus and images are reproduced, the abrasion dust present in the interiors of grooves may be scraped out by a toner (inclusive of its external additives), or the part where grooves are raised or the part where grooves are concealed may be scraped off by the cleaning blade. In addition, the wording "the part where grooves are concealed" refers to the part where the abrasion dust formed when the peripheral surface of the abrading object is abraded with the abrasive sheet and/or the raised portions scraped off at both edges of grooves has/have been buried in the grooves.

If the abrasion dust and the raised portions are scraped out and off in a large quantity, they tend to stick to the edge of the cleaning blade to make it difficult to maintain normal cleaning, and may appear as black or white lines on reproduced images. Also, if paper feed running is further continued, they may melt-adhere to the peripheral surface of the electrophotographic photosensitive member, and may appear as white dots on reproduced images. In prior art, there is a technique in which the abrasion dust of the peripheral surface of the electrophotographic photosensitive member is utilized as a lubricant. However, in the case of the electrophotographic photosensitive member having a surface layer with a high hardness, a problem may come about such that the presence of abrasion dust at the edge of the cleaning blade causes scratches on the peripheral surface of the electrophotographic photosensitive member or the toner to melt-adhere to the peripheral surface of the electrophotographic photosensitive member. In particular, with regard to the charging given as one factor that governs the abrasion amount (or abrasion wear) of the electrophotographic photosensitive member, and in the case of corona charging in which damage is less in comparison with contact charging resulting in great discharge deterioration, the abrasion amount of the peripheral surface of the electrophotographic photosensitive member is reduced and the scratches, toner melt adhesion and so forth on the peripheral surface of the electrophotographic photosensitive member may be difficult to remove. Consequently, the above problem tends to be fomented.

The present inventors have measured the quantity of abrasion dust of the peripheral surface of the electrophotographic photosensitive member under the conditions as shown below, to determine the deposition thickness of the abrasion dust of the electrophotographic photosensitive member deposited on the air face of a blade made of polyurethane resin, and have evaluated the relationship between the results obtained and the lifetime of the electrophotographic photosensitive member to find that the lifetime of the electrophotographic photosensitive member can be elongated as long as the deposition thickness of the abrasion dust is within a specific range.

More specifically, in an environment of 23° C./50% RH, an electrophotographic photosensitive member is rotated for 90 seconds at a peripheral speed of 150 mm/s while its peripheral surface is brought into contact at a linear pressure of 2 g/mm with a blade made of polyurethane resin and having a hardness of 77 degrees, where the deposition thickness of the abrasion dust of the electrophotographic photosensitive member deposited on the air face of the blade made of polyurethane resin may preferably be within the range of from 0.1 μm to 5 μm, and further preferably within the range of from 0.5 μm to 5 μm.

Figure 19:
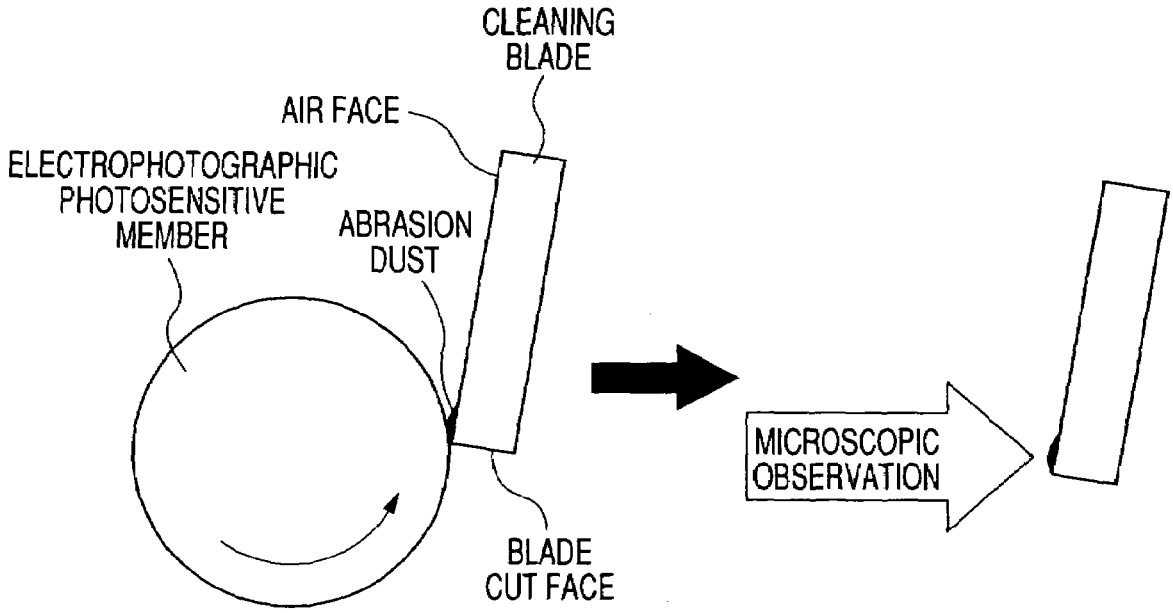
FIG. 19 diagrammatically illustrates how to measure the quantity of abrasion dust of the peripheral surface of an electrophotographic photosensitive member.
Figure 20:
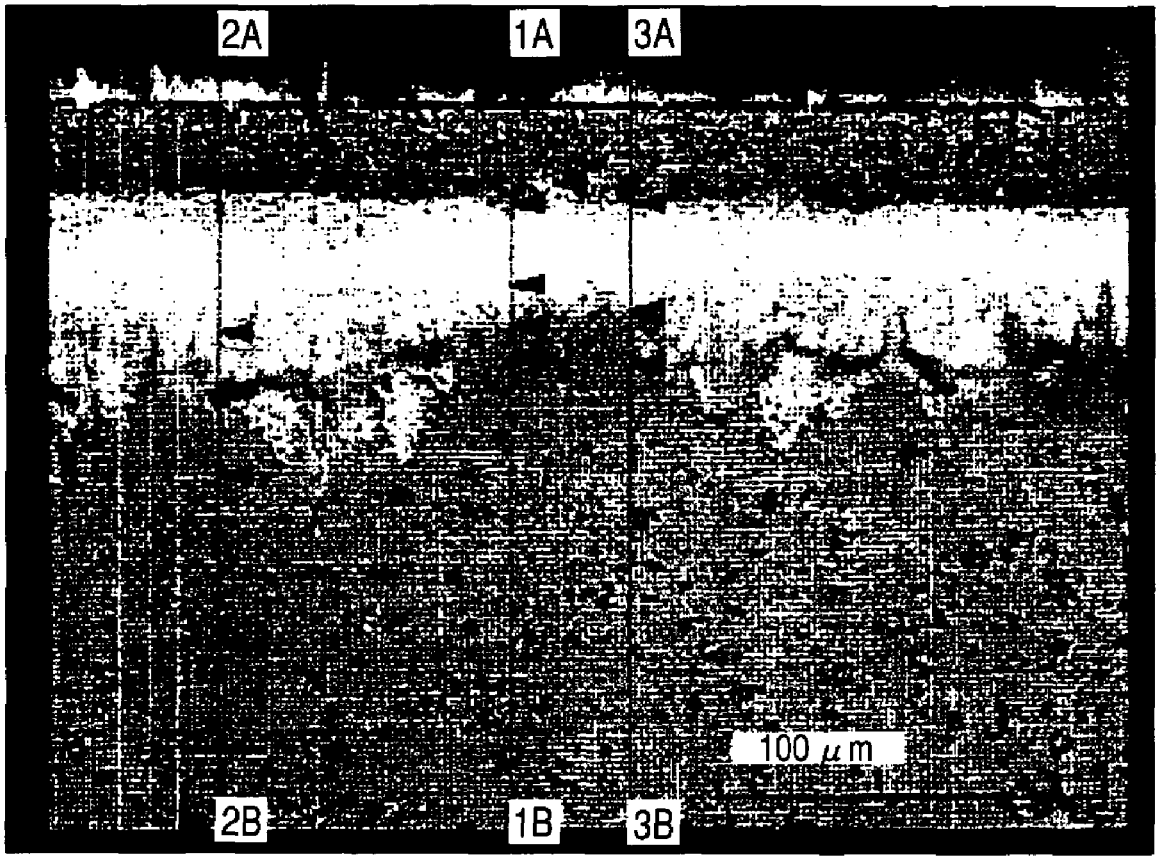
FIG. 20 is an image of abrasion dust deposited on the air face of a blade, as viewed from the blade air face.
Figure 21:
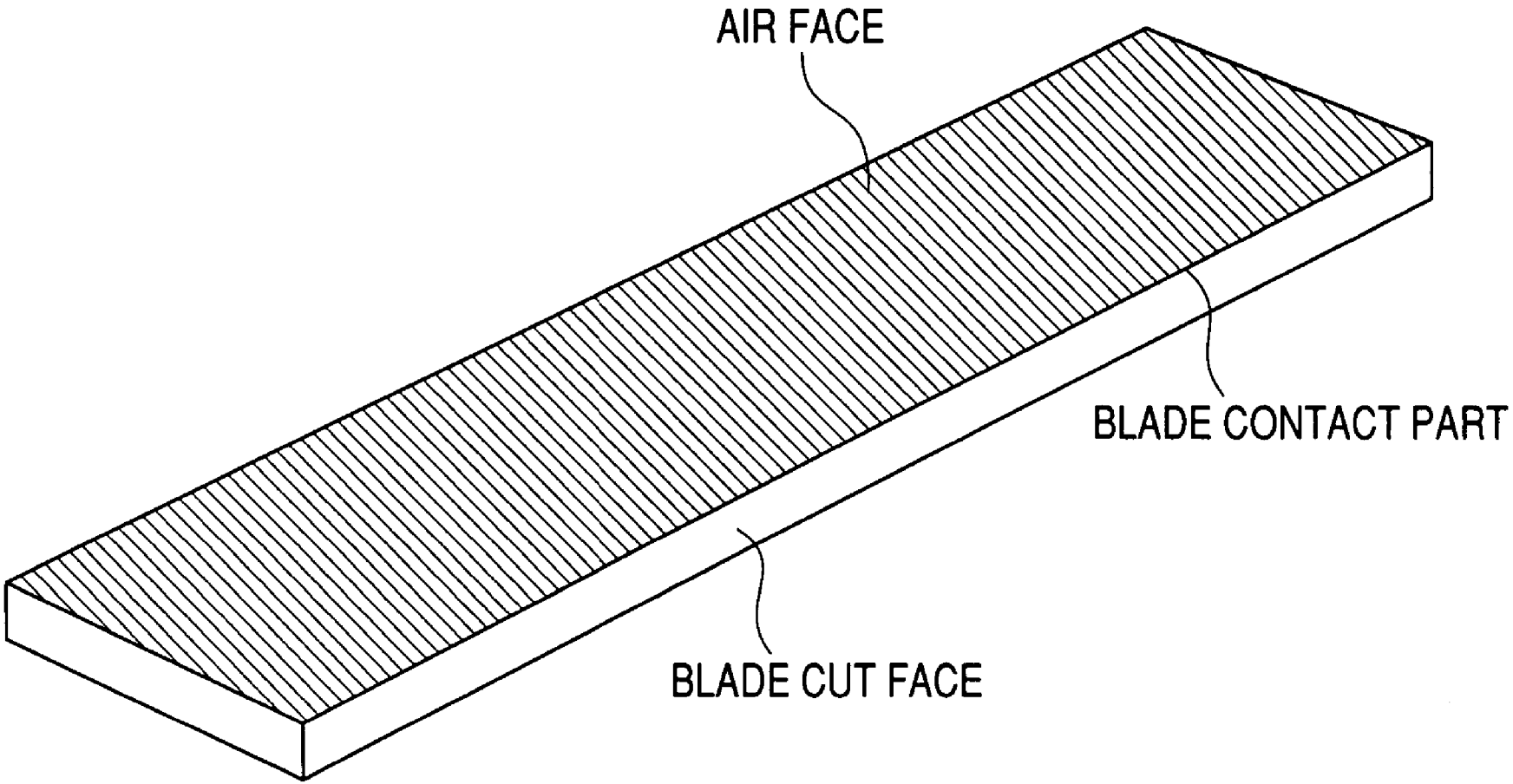
FIG. 21 illustrates the air face of a blade.

FIG. 19 diagrammatically shows how to measure the quantity of abrasion dust of the peripheral surface of the electrophotographic photosensitive member. An image of abrasion dust deposited on the air face of a blade is shown in FIG. 20, as viewed from the blade air face by the use of an objective lens of 50 magnifications in a color laser microscope (an ultra-depth shape measuring microscope VK-8550) manufactured by Keyence Corporation. The "quantity of abrasion dust" is specifically meant to be the quantity found by automatically measuring the distance between the air face of a blade and the uppermost portion of the abrasion dust (i.e., maximum height) by means of the ultra-depth shape measuring microscope VK-8550. In addition, the air face of a blade is the portion shown in FIGS. 19 and 21.

Where the electrophotographic photosensitive member of the present invention is manufactured by the manufacturing process having the above surface roughening step, the above quantity of abrasion dust may be controlled in the surface roughening step.

Where the quantity of abrasion dust can not readily come within the above range through only the surface roughening step, the peripheral surface of the abrading object may be cleaned (cleaning step) after the peripheral surface of the abrading object has been surface-roughened, or the cleaning step may be carried out as a step simultaneous with the surface roughening step, or the two may be carried out in combination. Any of these may be carried out so that the quantity of abrasion dust can be held within the above range.

The cleaning step is described below.

Figure 9:
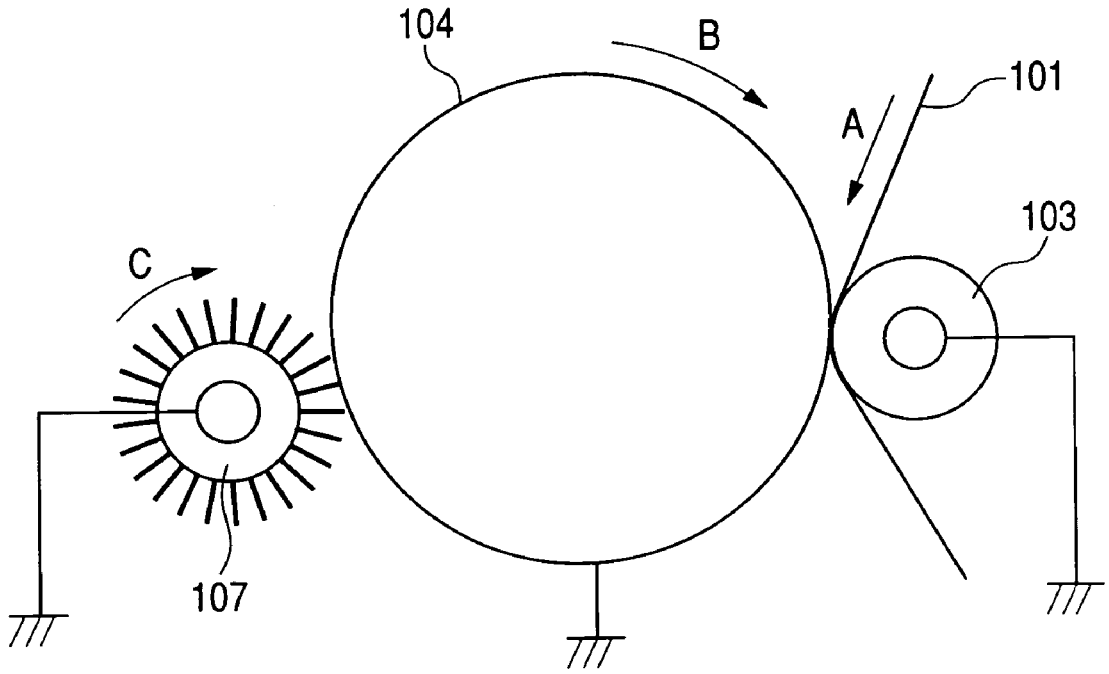
FIG. 9 illustrates an example in which the surface roughening step and the cleaning step are simultaneously carried out.

An example of a case where the surface roughening step and the cleaning step are simultaneously carried out is shown in FIG. 9.

As shown in FIG. 9, the abrasive sheet 101 is moved in the direction of an arrow A, and the abrading object 104 is rotated in the direction of an arrow B. In the course of the above, a brush 107 which is a cleaning member is kept in face-to-face pressure contact with the abrading object 104 while being rotated, to remove the abrasion dust deposited on the peripheral surface of the abrading object 104. The cleaning time may be equal to the abrading time, or only the cleaning time may be prolonged in such a state that, after the abrading is completed, the brush 107 is still kept in pressure contact with the peripheral surface of the abrading object 104 even after the back-up roller 103 is separated from the abrading object 104.

Since the abrasive sheet 101 is insulative, it is electrostatically charged during the surface roughening step. The abrading object 104 kept in contact therewith is photoconductive, but is electrostatically charged because it is in contact with the abrasive sheet 101. It is considered that the abrasion dust itself stands electrostatically charged. Accordingly, in FIG. 9, the back-up roller 103, the abrading object 104 and the brush 107 are earthed. If necessary, the abrasive sheet 101, the abrading object 104 and the brush 107 each may be provided with a means for charging, decharging or irradiation with light to generate a triboelectric series so that the abrasion dust can be collected by the brush 107.

The brush 107 is so controlled as to rotate face to face with the abrading object 104. Accordingly, the brush 107 may be rotated in the rotational direction of, and in synchronization with, the abrasive sheet 101. This is more advantageous for recovering the abrasion dust.

With continuous use of the brush 107, the abrasion dust and the like are collected on the brush ear tips, and it is impossible for the brush to maintain its performance. Hence, it is preferable to attach a means for removing the abrasion dust from the brush tips as shown below.

Figure 10:
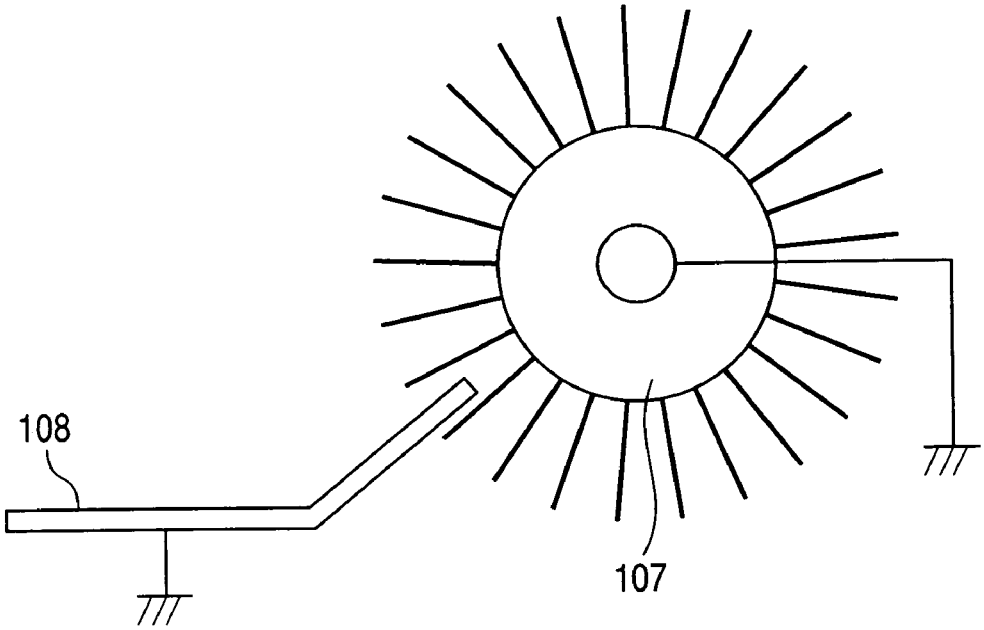
FIG. 10 illustrates an example in which abrasion dust is removed from ear tips of a brush 107.
Figure 11:
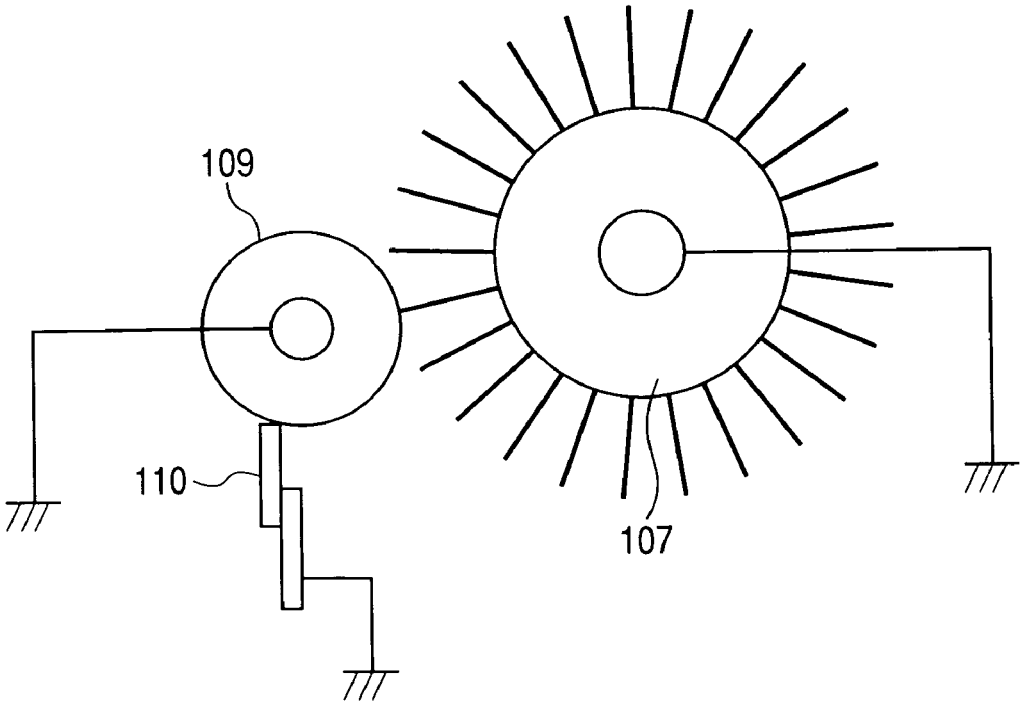
FIG. 11 illustrates an example in which abrasion dust is removed from ear tips of a brush 107.

FIGS. 10 and 11 show examples in which abrasion dust is removed from the ear tips of the brush 107.

In FIG. 10, a plate-like abrasion dust scrape-off member (scraper) 108 is pressed against the brush 107 and penetrated into it to a certain extent. The extent of penetration of the scraper 108 may preferably be in the range of from 0.2 mm to 5 mm, and more preferably from 0.5 mm to 2.5 mm, taking into account the ear length of the brush 107, the straightness of the abrading object, the parallelism between the rotating shaft of the abrading object and the abrading object in the surface roughening step, and so forth. Although the scraper 108 and the brush 107 are grounded, voltage may be applied to each or any one of them so that the abrasion dust may be deposited on the scraper 108. The abrasion dust becomes deposited in the region of the scraper 108 with which the brush 107 is kept in contact, and hence it is preferable to clean the scraper 108 periodically.

In FIG. 11, since the abrasion dust taken in the brush 107 stands negatively charged, a roller 109 to which positive voltage is applied in order to collect it is kept in contact with the brush 107 so that the abrasion dust can be removed therefrom. To apply the positive voltage, a metal may preferably be used as the roller 109. Alternatively, a conductive resin may be used. To the roller 109, a blade 110 is attached which recovers the abrasion dust collected on the former. The blade 110 may include as an example a rubber blade bonded to a metallic sheet. The example is by not means limited to this as long as the abrasion dust can be collected by the roller 109. The abrasion dust having been collected becomes deposited at the part where the blade 110 comes into contact with the roller 109. Accordingly, it is preferable for the blade 110 to be periodically cleaned.

In addition, two or more of the brushes may be used in cleaning the abrading object. Also, the brushes may be the same or different in material, outer diameter, number of revolutions, rotational direction, cleaning time and so forth. The material for the brush may include, e.g., acrylic resins, polyamide, aramid resins, polypropylene, polyvinyl chloride, polyester, polybutylene terephthalate and polyphenylene sulfide. The material may preferably be hard one from the viewpoints of scraping off the abrasion dust in grooves, removing the raised portions at both edges of grooves, and so forth. The material should be selected which has an ability to scrape off the abrasion dust and expel it from the brush. Of the above materials, acrylic resins, polyamide and aramid resins are preferred.

As the cleaning member such as the brush, used in the cleaning step, one having conductivity is preferable. Taking into account the fact that it is grounded or voltage is applied thereto, it may preferably have a low resistance. Specifically, it may preferably have a resistivity of from $10^1$ to $10^8$ Ωcm.

The thickness of each ear of the brush may preferably be from 1 to 20 deniers (0.11 to 2.22 mg/m), and more preferably from 2 to 12 deniers (0.22 to 1.33 mg/m). If ears are slender, they can enter the interiors of grooves, but are weak in stiffness to tend to have a low scraping ability. On the other hand, if the ears are thick, the abrasion dust in grooves tend to be scraped off with difficulty.

The ears of the brush may preferably have a length (ear length) of from 1 mm to 10 mm, and more preferably from 2 mm to 7 mm. After the brush has been prepared, it is cut at its tip to be in the desired length. If it has a large ear length, even where a material having strong stiffness is used, there is a possibility that the length becomes non-uniform at the time of pruning. On the other hand, if the brush has a large ear length, there is a tendency for its stiffness to become weak. The shorter the ear length is, the stronger the stiffness of the brush is in appearance. In view of the cylinder vibration of the abrading object and the straightness of a shaft of the surface roughening apparatus, the ear length may preferably be 1 mm or more.

In the foregoing description, as an example of the shape of the cleaning member, the brush has been cited, but various shapes may be included such as a roller, a tape and a blade or the like.

Figure 12:
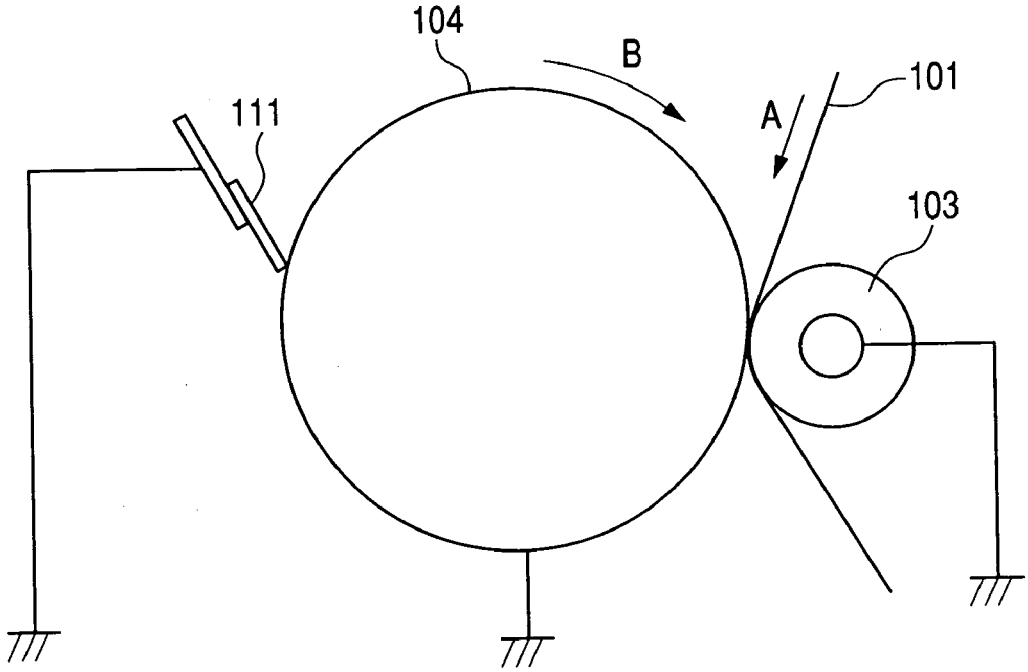
FIG. 12 illustrates an example in which a blade is used as a cleaning member.

An example in which a blade is used as the cleaning member is shown in FIG. 12.

In the case where a blade is used as the cleaning member, the abrasion dust may become deposited at the edge of a blade 111 more than needed, where the peripheral surface of the abrading object (electrophotographic photosensitive member) may be scratched with a decrease in the scraping effect. Thus, in consideration of productivity, it is preferable to clean the edge or replace the blade with new one, periodically. While not shown in FIG. 12, external additives used in toners or particles similar thereto may be fed to the blade 111 so as to be useful in removing the abrasion dust. A material for the blade may include, e.g., polyurethane resins, silicone rubbers, fluorine rubbers and acrylonitrile-butadiene rubbers.

The cleaning step may be carried out simultaneously with or after the surface roughening step, using a abrasive sheet in which abrasive grains are dispersed having count different from the count of abrasive grains of the abrasive sheet used in the surface roughening step. When the abrading of the peripheral surface of the abrading object is carried out by using such an abrasive sheet in which the abrasive grains having different counts are dispersed, phenomena are prevented from occurring such that the dust formed when the peripheral surface of the abrading object is abraded is deposited in the interiors of the grooves, both edges of grooves are swollen or raised, and both edges of formed grooves conceal the grooves again. The abrasive grains of an abrasive sheet used in the cleaning may preferably have the count which is larger than the count of the abrasive grains of the abrasive sheet used in the surface roughening. The abrasive grains of an abrasive sheet used in the cleaning may preferably be smaller than the abrasive grains of the abrasive sheet used in the surface roughening. The direction of feed for the abrasive sheet used in the cleaning and the direction of feed for the abrasive sheet used in the surface roughening may be the same or opposite. Where such directions of feed for abrasive sheets are changed, the direction of feed for the abrasive sheet used in the cleaning and the direction of feed for the abrasive sheet used in the surface roughening may be changed simultaneously, or may be changed at different timing.

The rotation direction of the abrading object 104 may be the same as, or opposite to, the direction in which the abrasive sheet 101 is fed. Also, the rotation direction may be changed in the middle of the surface roughening. Where the rotation direction is changed, the frequency and time at which it is changed may be so determined that the above quantity of abrasion dust come to be within the above range. The abrasion dust produced through the surface roughening step and the raise of both edges of grooves are considered to be concerned with the rotational direction of the abrading object 104. Hence, they tend to be scraped off or to come off where the abrading object 104 is rotated in reverse. Thus, a method in which the abrading object is rotated in reverse in the surface roughening step is one in which the surface roughening step and the cleaning step are simultaneously carried out.

Figure 13:
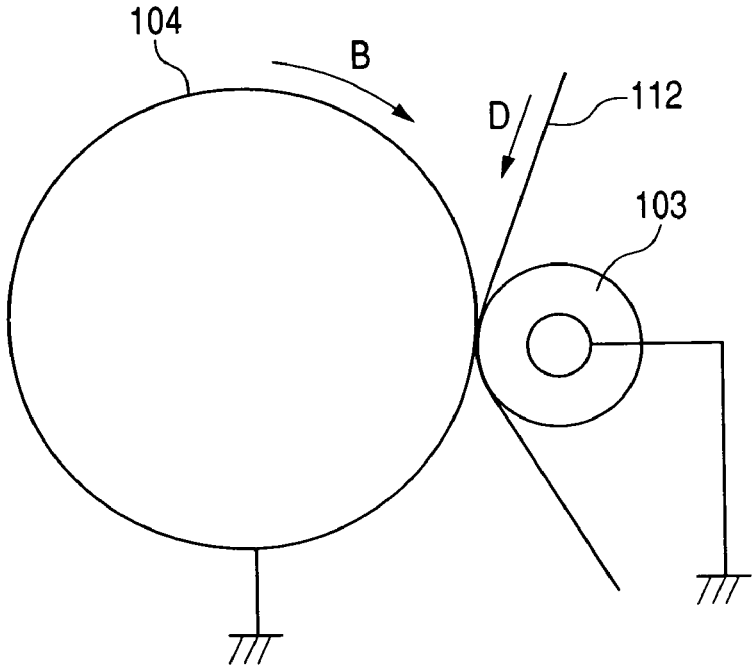
FIG. 13 illustrates an example of a method in which a dry belt or wet belt 112 serving as a cleaning member is brought into contact with an abrading object 104 to further remove abrasion dust remaining on the peripheral surface of the abrading object 104.

FIG. 13 shows an example of a method in which, as a second cleaning step after the first cleaning step has been completed, a dry or wet belt 112 is brought into contact with the abrading object 104 to further remove abrasion dust remaining on the peripheral surface of the abrading object 104.

With respect to the abrading object 104 on which the surface roughening step (abrading step) and the cleaning step (first cleaning step) have been finished by the above various methods, the dry or wet belt 112 is moved in the direction of an arrow D. The abrading object 104 is rotated in the direction of an arrow B. Here, the belt 112 is kept in pressure contact with the abrading object 104 by a back-up roller 103 at a stated pressure, during which the second cleaning step is carried out. The cleaning may be carried out at any time, and the rotational directions of the belt 112 and abrading object 104 may be opposite. The belt 112 may include, e.g., a foamed sheet or foamed sponge made of a polyurethane resin or a melamine resin. In the case of the wet belt, it is used in the state it is incorporated with a solvent which does not attack the abrading object 104, such as ion-exchanged water or alcohol. In addition, this second cleaning step may be carried out simultaneously with the surface roughening step (abrading step) and/or the first cleaning step.

Figure 14:
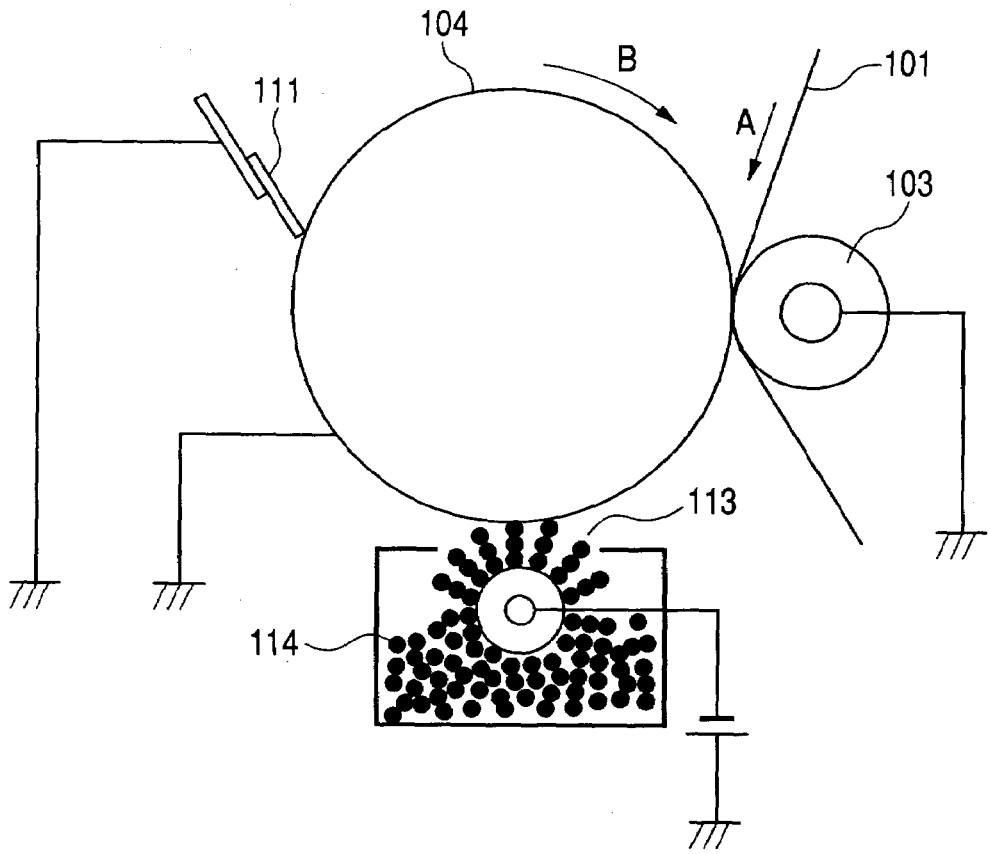
FIG. 14 illustrates an example in which a magnetic brush 113 is used as a cleaning member.

An example in which a magnetic brush 113 is used as the cleaning member is shown in FIG. 14. In FIG. 14, an example is shown in which the magnetic brush 113 is grounded. Instead, the magnetic brush may be charged. The magnetic brush 113 is provided therein with magnetic poles (not shown). The magnetic brush 113 is chiefly formed using particles 114. As the particles 114, resin particles or metallic particles having been surface-treated are usable. If the particles 114 that form ears of the magnetic brush 113 come off the ears, such particles may scratch the peripheral surface of the abrading object 104, and hence the position of attachment and the charge potential should be optimized. For example, methods may be contrived in which, as shown in FIG. 14, a container for the particles 114 is placed at a part lower than the abrading object 104 so that no problem occurs even if the particles 114 come off the ears, and, for the purpose of preventing the particles 114 from coming off, voltage is applied to the abrading object 114 (electrophotographic photosensitive member) to such an extent that no memory may occur.

A blade 111 is disposed in order to take adhereing particles 114 away from the magnetic brush 113 to the abrading object 104. If the particles 114 are caught at the edge of the blade 111, they may scratch the peripheral surface of the abrading object 104. Accordingly, a brush may be used in place of, or in combination with, the blade 111. A means for removing the particles 114, e.g., a magnet or a metallic roller, may be provided between the magnetic brush 113 and the blade 111.

If the magnetic brush 113 is filled therein with the abrasion dust, it may be the cause of scratching the peripheral surface of the abrading object 11 4. Accordingly, it is better to replace the ears of the magnetic brush 113 in entirety, to replace the unit of the magnetic brush 113, or to collect only the abrasion dust by charging or the like.

Fine particles may also be added to the interior of the unit of the magnetic brush 113 in order to improve the collection efficiency of the abrasion dust. Materials for such fine particles may primarily include metal oxides. In particular, materials commonly used as external additives of toners are preferred, which may include, e.g., silica, titanium compounds, alumina, cerium oxide, calcium carbonate, magnesium carbonate and calcium phosphate. Any of these may be used alone or in combination. The fine particles may preferably be those having been subjected to surface treatment such as hydrophobic treatment.

Figure 15:
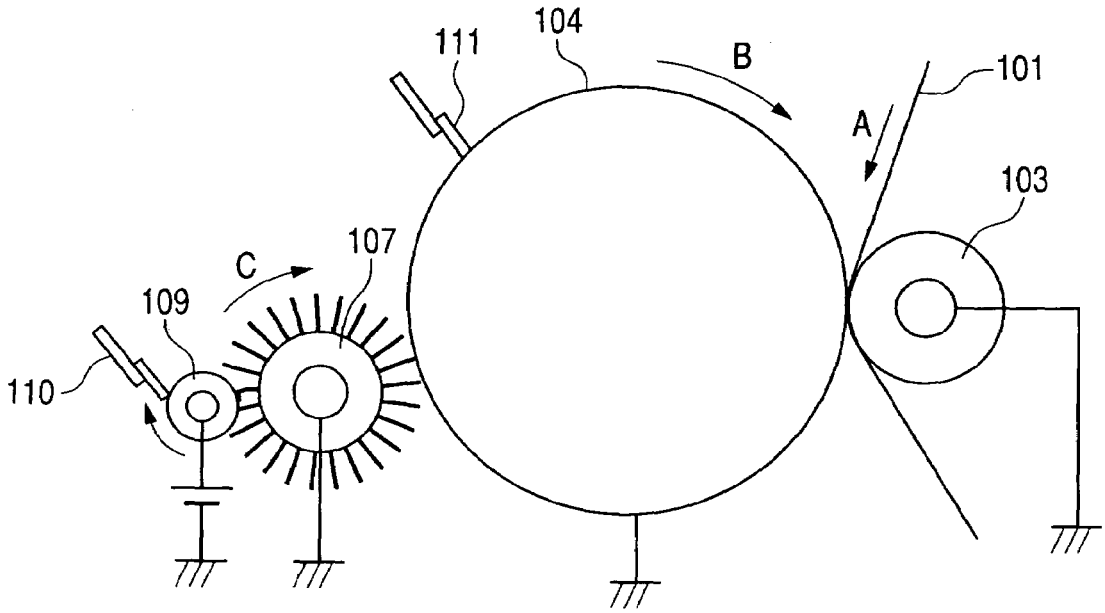
FIG. 15 illustrates an example in which the example shown in FIG. 11 and the example shown in FIG. 12 are set in combination.
Figure 16:
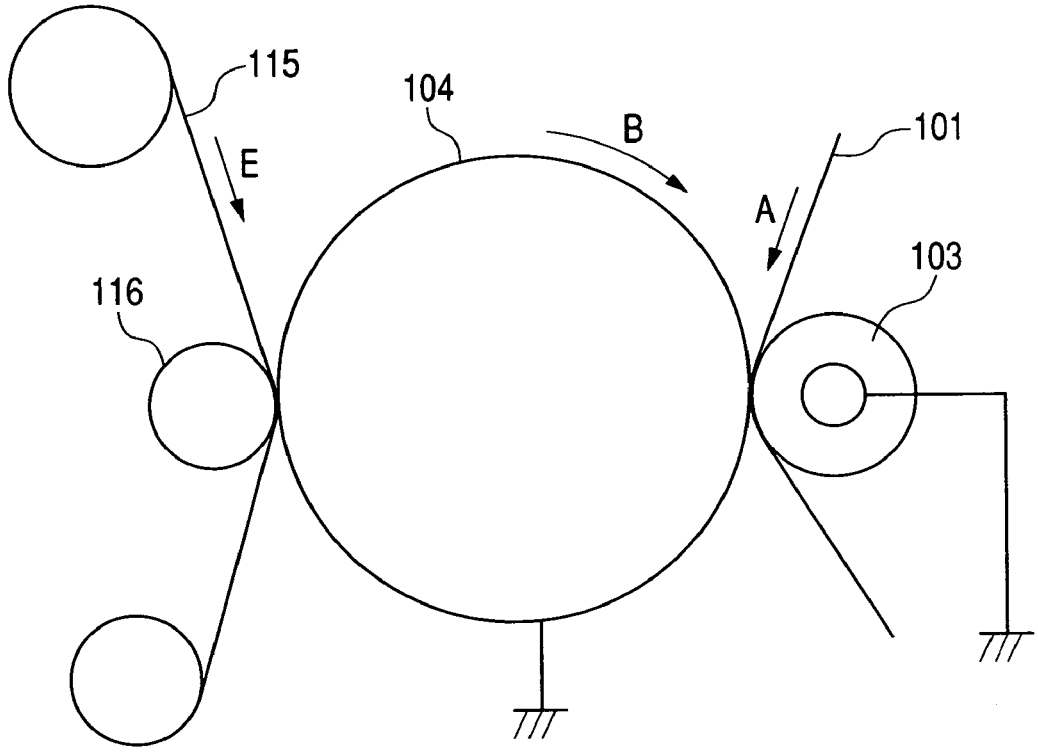
FIG. 16 illustrates an example in which the cleaning step is carried out using a pressure-sensitive adhesive tape.

An example in which the example shown in FIG. 11 and the example shown in FIG. 12 are set in combination is shown in FIG. 15. Also, an example in which the cleaning step is carried out using a pressure-sensitive adhesive tape is shown in FIG. 16. A pressure-sensitive adhesive tape 115 is pressed against the abrading object 104 by a cleaning back-up roller 116 simultaneously with the surface roughening step, in the state of which the pressure-sensitive adhesive tape 115 is discharged in the direction of an arrow E to clean the peripheral surface of the abrading object 104. Thereafter, the pressure-sensitive adhesive tape 115 is wound up. The cleaning back-up roller 116 is intended to bring the pressure-sensitive adhesive tape 115 into close contact with the abrading object 104, and hence may preferably be made of a metal or a resin having a high hardness.

Figure 17:
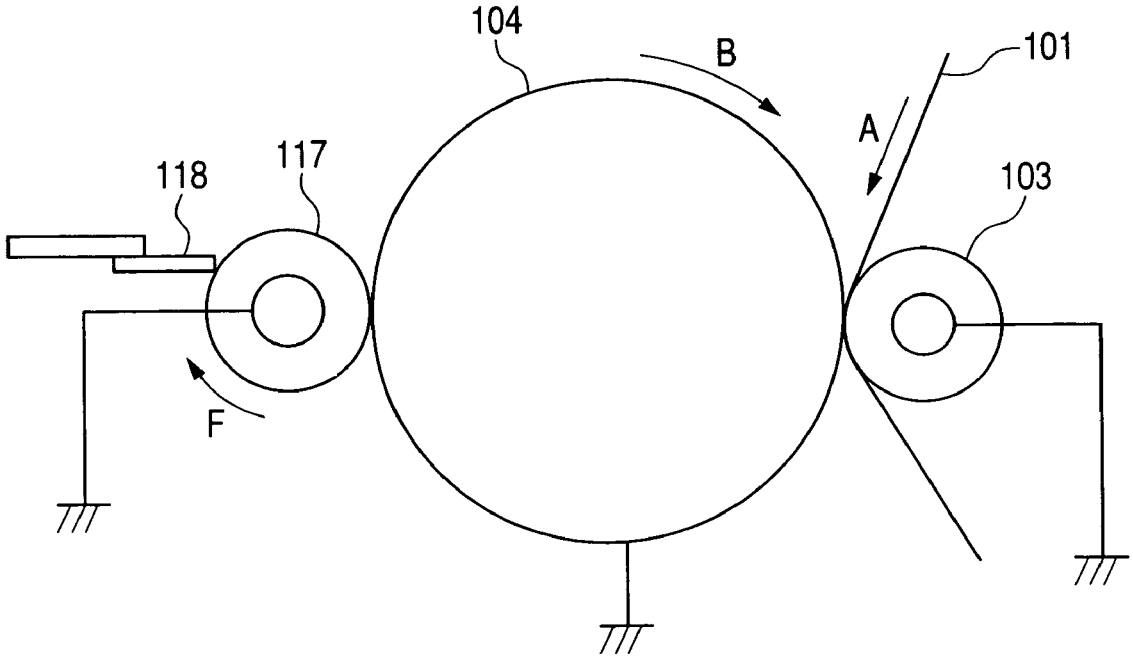
FIG. 17 illustrates an example in which the cleaning step is carried out using a roller.

An example in which the cleaning step is carried out using a roller is shown in FIG. 17. A roller 117 is brought into pressure contact with the abrading object 104 simultaneously with the surface roughening step so that the abrasion dust adhering to the roller 117 can be scraped off by a blade 118. As materials for the roller 117, a material having viscosity, a metal or a conductive resin, a foamable resin and so forth may be used. In the case when the material having viscosity is used, it is more efficient to press the roller 117 against the abrading object 104 without disposing the blade 118, and move the abrasion dust to the roller 117. This is effective in elongating the lifetime of the roller 117. In the case where a metal or a conductive resin is used in the roller 117, it may preferably be grounded to earth or voltage is applied to it so that the abrasion dust can be collected from the peripheral surface of the abrading object 104 into the roller 117. In the case where a foamable resin is used in the roller 117, the roller may preferably be so constructed that the abrasion dust is buried in the foamed portions of the roller 117 kept in pressure contact with the abrading object 104. It is also preferable to use a roller having conductivity and foamability.

The cleaning step may also be carried out after the surface roughening step and/or another cleaning step, by immersing the abrading object in a liquid for a stated time and vibrating these. This liquid may include water and organic solvents. In the case where an organic solvent is used, it is better to use a solvent that does not dissolve the photosensitive layer of the abrading object 104. For example, alcohols or ketones are preferred. A solvent used in a surface layer coating fluid may also be used. The abrading object may be finely vibrated by means of an ultrasonic cleaner simultaneously with the immersion. This enables the abrasion dust to more efficiently be removed.

The present invention is most effective when applied to electrophotographic photosensitive members whose peripheral surfaces is not easily worn. The reason therefor is that, as stated previously, the electrophotographic photosensitive member whose peripheral surface is not easily worn is highly durable, but may remarkably cause such problems that:

- a phenomenon may be seen in which the cleaning blade is chipped off at its edge; and
- the peripheral surface of the electrophotographic photosensitive member can not easily be abraded even when external additives of the toner, paper dust of the transfer sheet, and so forth have become deposited on the peripheral surface of the electrophotographic photosensitive member, and hence the melt adhesion of toner may occur around these foreign particles serving as starting points, resulting in scratches on the peripheral surface of the electrophotographic photosensitive member in a high probability because of the pressure contact with the cleaning blade.

Specifically, the peripheral surface of the electrophotographic photosensitive member may preferably have a universal hardness value (HU) of 150 N/mm$^2$ or more, and more preferably 160 N/mm$^2$ or more.

Electrophotographic photosensitive members whose peripheral surfaces is not easily worn and is not easily scratched is reduced in a change of its peripheral shape at the initial stage and even after repeatedly used. Thus, they can maintain cleaning performance in the initial stage even when used repeatedly over a long period of time.

From the viewpoint of such advantages that the peripheral surface of the electrophotographic photosensitive member can not easily wear and also can not easily be scratched, the electrophotographic photosensitive member may preferably have a universal hardness value (HU) of 240 N/mm$^2$ or less, more preferably 220 N/mm$^2$ or less, and still more preferably 200 N/mm$^2$ or less. The peripheral surface of the electrophotographic photosensitive member may preferably have a modulus of elastic deformation of 40% or more, more preferably 45% or more, and still more preferably 50% or more. On the other hand, the peripheral surface of the electrophotographic photosensitive member may preferably have a modulus of elastic deformation of 65% or less.

If the universal hardness value (HU) is too large or the modulus of elastic deformation is too small, the surface of the electrophotographic photosensitive member has insufficient elastic force. Hence, the peripheral surface of the electrophotographic photosensitive member is apt to be scratched because the paper dust and toner caught at the part between the peripheral surface of the electrophotographic photosensitive member and the cleaning blade rub the peripheral surface of the electrophotographic photosensitive member, tending to cause the wear concurrently therewith. If the universal hardness value (HU) is too large, a small elastic deformation level may result even though the electrophotographic photosensitive member has a high modulus of elastic deformation. Consequently, a great pressure is locally applied to the surface of the electrophotographic photosensitive member, and therefore the surface of the electrophotographic photosensitive member is liable to be deeply scratched.

In addition, if the modulus of elastic deformation is too small even though the universal hardness value (HU) is within the above range, the plastic deformation level may become relatively large. Hence, the surface of the electrophotographic photosensitive member tends to be finely scratched, resulting in its wear. This occurs especially remarkably when not only the modulus of elastic deformation is too small but also the universal hardness value (HU) is too small.

In the present invention, the universal hardness value (HU) and modulus of elastic deformation of the peripheral surface of the electrophotographic photosensitive member are measured with a microhardness measuring instrument FISCHER SCOPE H100V (manufactured by Fischer Co.) in an environment of 25° C./50% RH. This FISCHER SCOPE H100V is an instrument in which an indenter is brought into touch with a measuring object (the peripheral surface of the electrophotographic photosensitive member) and a load is continuously applied to this indenter, where the indentation depth under application of the load is directly read out to find the hardness continuously.

In the present invention, a Vickers pyramid diamond indenter having angles of 136 degrees between the opposite faces is used as the indenter. The indenter is pressed against the peripheral surface of the electrophotographic photosensitive member. The last load (final load) applied continuously to the indenter is set to 6 mN, and the time (retention time) for which the application state of the final load of 6 mN to the indenter is retained is set to be 0.1 second. Also, measurement is made at 273 spots.

Figure 22:
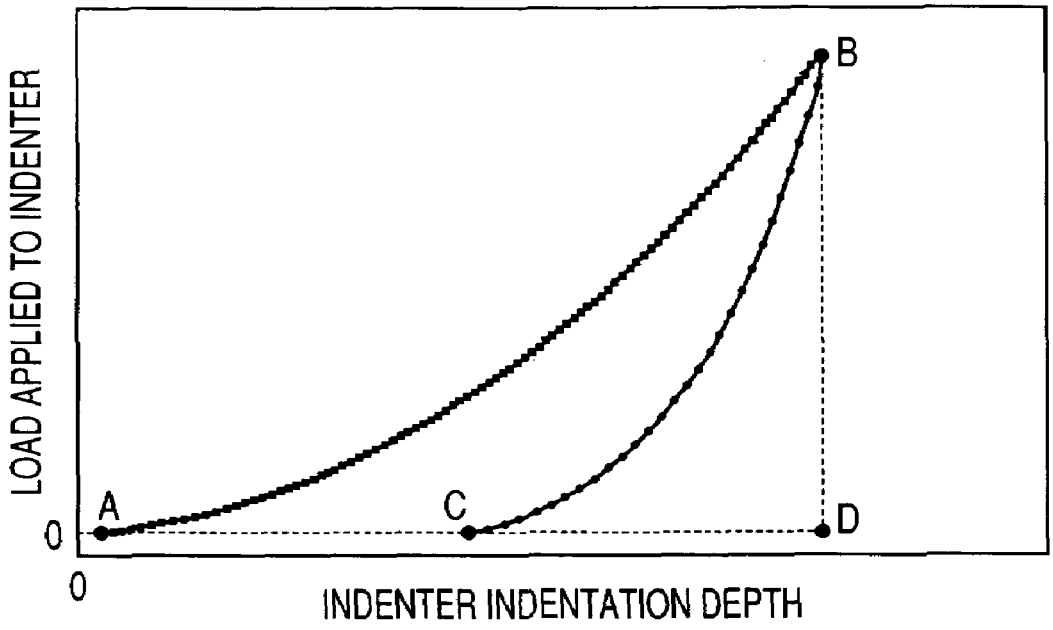
FIG. 22 illustrates the outline of an output chart of Fischer Scope H100V (manufactured by Fischer Co.).
Figure 23:
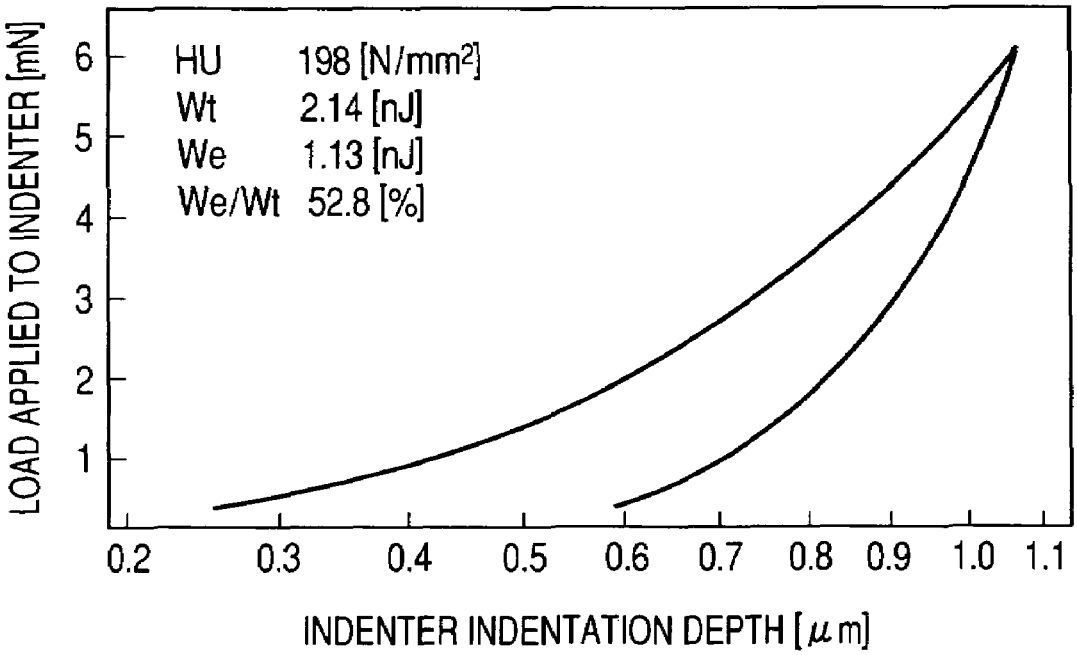
FIG. 23 illustrates the outline of an output chart of Fischer Scope H100V (manufactured by Fischer Co.).

The outline of an output chart of Fischer Scope H100V (manufactured by Fischer Co.) is shown in FIG. 22. The outline of an output chart of Fischer Scope H100V (manufactured by Fischer Co.) in the case where the electrophotographic photosensitive member of the present invention is measured is shown in FIG. 23. In FIGS. 22 and 23, the load F (mN) applied to the indenter is plotted as ordinate, and the indentation depth h (μm) of the indenter as abscissa. FIG. 22 shows results obtained when the load applied to the indenter is increased stepwise until the load comes to be the maximum (from A to B), and thereafter the load is reduced stepwise (from B to C). FIG. 23 shows results obtained when the load applied to the indenter is reduced stepwise until the load comes finally to be 6 mN, and thereafter the load is reduced stepwise.

The universal hardness value (HU) may be found from the indentation depth at the time the final load of 6 mN is applied, and from the following expression. In the following expression, $F_f$ stands for the final load, $S_f$ stands for the surface area of the part where the indenter is penetrated under application of the final load, and $h_f$ stands for the indentation depth at the time the final load is applied.

$$HU = \frac{F_f[N]}{S_f[\mathrm{mm}^2]} = \frac{6\times10^{-3}}{26.43\times(h_f\times10^{-3})^2}$$

The modulus of elastic deformation may be found from the work done (energy) by the indenter against the measuring object (the peripheral surface of the electrophotographic photosensitive member), i.e., the changes of energy due to the increase and decrease in the load of the indenter against the measuring object (the peripheral surface of the electrophotographic photosensitive member). Specifically, the value found when the elastic deformation work done We is divided by the total work done Wt (We/Wt) is the modulus of elastic deformation. In addition, the total work done Wt is the area of a region surrounded by A-B-D-A in FIG. 22, and the elastic deformation work done We is the area of a region surrounded by C-B-D-C in FIG. 22.

In order to improve scratch resistance or wear resistance of the peripheral surface of the electrophotographic photosensitive member, it is preferable that the surface layer of the electrophotographic photosensitive member is a cured layer. For example, the surface layer of the electrophotographic photosensitive member may be formed using a curable resin (a monomer of a curable resin), or using a hole transporting compound having a polymerizing functional group (such as a chain-polymerizing functional group or a successive-polymerizing functional group) (i.e., a hole transporting compound to part of the molecule of which the polymerizing functional group stands chemically bonded). Where a curable resin having no charge transporting ability is used, a charge transporting material may be used together in the form of a mixture.

In particular, in order to obtain the electrophotographic photosensitive member having the universal hardness value (HU) and the modulus of elastic deformation within the above ranges, it is effective to form the hole transporting compound having a chain-polymerizing functional group, by cure polymerization (polymerization which involves cross-linking), in particular, to form by the curing polymerization a hole transporting compound having two or more chain-polymerizing functional groups in the same molecule. When using the hole transporting compound having a successive-polymerizing functional group, the compound may preferably be a hole transporting compound having three or more successive-polymerizing functional groups in the same molecule.

A method of forming the surface layer of the electrophotographic photosensitive member by the use of the hole transporting compound having a chain-polymerizing functional group is more specifically described below. In addition, the following applies alike to the case in which the hole transporting compound having a successive-polymerizing functional group is used.

The surface layer of the electrophotographic photosensitive member may be formed by coating a surface layer coating fluid containing the hole transporting compound having a chain-polymerizing functional group and a solvent, and cure-polymerizing the hole transporting compound having a chain-polymerizing functional group, thereby curing the surface layer coating fluid.

In the coating of the surface layer coating fluid, coating methods are usable such as dip coating, spray coating, curtain coating and spin coating. Of these coating methods, dip coating and spray coating are preferred from the viewpoint of efficiency and productivity.

In the cure polymerization of the hole transporting compound having a chain-polymerizing functional group, a method is available which makes use of heat, light such as visible light or ultraviolet light, or radiations such as electron rays or gamma-rays. A polymerization initiator may optionally be incorporated in the surface layer coating fluid.

In addition, as the method of cure-polymerizing the hole transporting compound having a chain-polymerizing functional group, it is preferred to use the method making use of radiations such as electron rays or gamma-rays, in particular, electron rays. This is because the polymerization by radiations requires no particular polymerization initiator. The cure polymerization of the hole transporting compound having a chain-polymerizing functional group without using any polymerization initiator can form a surface layer with a highly pure three-dimensional matrix to obtain an electrophotographic photosensitive member showing good electrophotographic characteristics. The polymerization by electron rays among radiations may extremely reduce damage to the electrophotographic photosensitive member due to irradiation, and can establish good electrophotographic characteristics.

To obtain the electrophotographic photosensitive member having the universal hardness value (HU) and the modulus of elastic deformation within the above ranges by cure-polymerizing the hole transporting compound having a chain-polymerizing functional group by the irradiation with electron rays, it is important to take into account conditions for irradiation with electron rays.

The irradiation with electron rays may be effected using an accelerator of a scanning type, an electron curtain type, a broad beam type, a pulse type or a laminar type. Accelerating voltage may preferably be 250 kV or less, and more preferably 150 kV or less. The dose may preferably be in the range of from 1 to 1,000 kGy (0.1 to 100 Mrad), and more preferably in the range of from 5 to 200 kGy (0.5 to 20 Mrad). If the accelerating voltage and the dose are too high, electrical characteristics of the electrophotographic photosensitive member may deteriorate. If the dose is too low, the cure polymerization of the hole transporting compound having a chain-polymerizing functional group may be insufficient, thereby insufficiently curing the surface layer coating fluid.

In order to accelerate the curing of the surface layer coating fluid, it is preferable to heat an irradiation object at the time the hole transporting compound having a chain-polymerizing functional group is cure-polymerized. The timing of heating may be at any stage, before the irradiation with electron rays, during the irradiation or after the irradiation. It, however, is preferable for the irradiation object to be kept at a temperature within a certain range during the presence of radicals of the hole transporting compound having a chain-polymerizing functional group. The heating may preferably be so carried out that the temperature of the irradiation object may be from room temperature to 250° C., and more preferably from 50 to 150° C. Heating at a too high temperature may cause deterioration in materials of the electrophotographic photosensitive member. Heating at a too low temperature reduces the effect to be obtained by carrying out the heating. The heating may preferably be carried out for a period of time of approximately from few seconds to tens of minutes, and specifically from 2 seconds to 30 minutes.

The irradiation with electron rays and the heating of the irradiation object may be carried out in air, in an inert gas such as nitrogen or helium, or in vacuum. In view of such an advantage that radicals can be kept from being deactivated because of oxygen, an inert gas or vacuum is preferable.

The surface layer of the electrophotographic photosensitive member may preferably have a layer thickness of 30 μm or less, more preferably 20 μm or less, more preferably 10 μm or less, and more preferably 7 μm or less, from the viewpoint of the electrophotographic characteristics. On the other hand, from the viewpoint of durability (running performance) of the electrophotographic characteristics, it may preferably be 0.5 μm or more, and more preferably 1 μm or more.

The chain polymerization refers to the form of polymerization, and when the reaction to form a polymeric substance is classified into chain polymerization and successive polymerization, is the former, specifically including unsaturation polymerization, ring-opening polymerization, isomerization polymerization or the like, in the reaction form of which the reaction proceeds chiefly through an intermediate such as radicals or ions.

The chain-polymerizing functional group is meant to be a functional group that enables the above reaction form to be taken. Examples of an unsaturation-polymerizing functional group and a ring-opening-polymerizing functional group are shown below, which groups are applicable over a wide range.

The unsaturation polymerization is the reaction in which unsaturated groups as exemplified by C═C, C≡C—C═O, C═N and C≡N polymerize through radicals or ions. Of these, C═C is dominant. Specific examples of the unsaturation-polymerizing functional group are shown below.

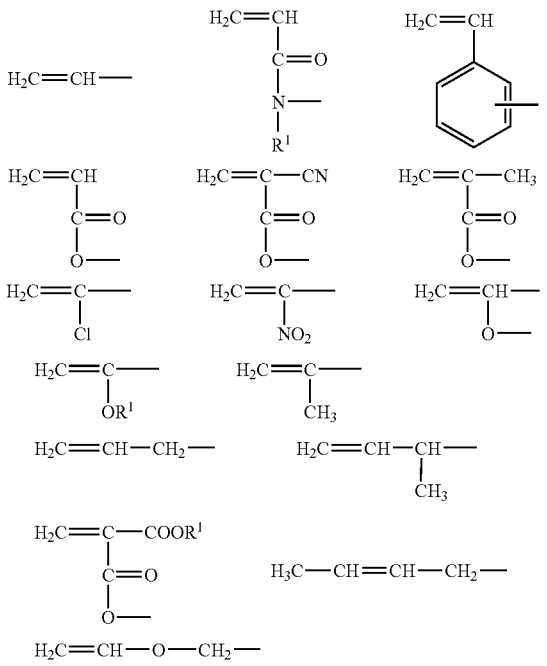

In the above formulas, $R^1$ represents a hydrogen atom, a substituted or unsubstituted alkyl group, a substituted or unsubstituted aryl group or a substituted or unsubstituted aralkyl group. Here, the alkyl group may include a methyl group, an ethyl group and a propyl group. The aryl group may include a phenyl group, a naphthyl group and an anthryl group. The aralkyl group may include a benzyl group and a phenethyl group.

The ring-opening polymerization is the reaction in which an unstable cyclic structure having a strain, such as a carbon ring, an oxo-ring or a nitrogen hetero-ring repeats polymerization simultaneously with its ring opening to form a chain polymer. In most of the ring-opening polymerization, ions act as active species. Specific examples of the ring-opening-polymerizing functional group are shown below.

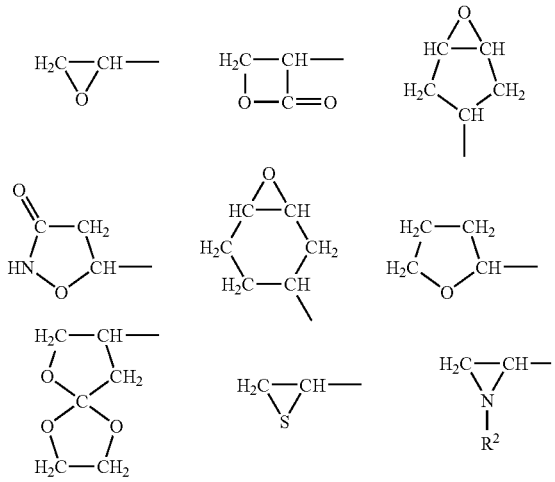

-continued

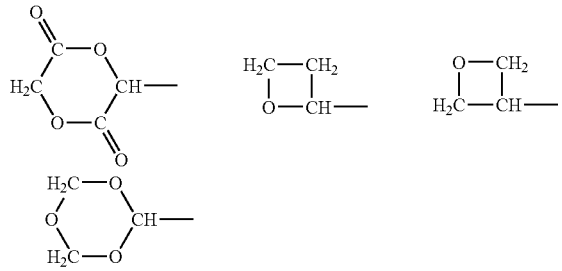

In the above formulas, $R^2$ represents a hydrogen atom, a substituted or unsubstituted alkyl group, a substituted or unsubstituted aryl group or a substituted or unsubstituted aralkyl group. Here, the alkyl group may include a methyl group, an ethyl group and a propyl group. The aryl group may include a phenyl group, a naphthyl group and an anthryl group. The aralkyl group may include a benzyl group and a phenethyl group.

Of the chain-polymerizing functional groups as exemplified above, chain-polymerizing functional groups having structures represented by the following formulas (1) to (3) are preferable.

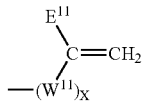

(1)

In the formula (1), $E^{11}$ represents a hydrogen atom, a halogen atom, a substituted or unsubstituted alkyl group, a substituted or unsubstituted aryl group, a substituted or unsubstituted aralkyl group, a substituted or unsubstituted alkoxyl group, a cyano group, a nitro group, —$COOR^{11}$ or —$CONR^{12}R^{13}$. $W^{11}$ represents a substituted or unsubstituted alkylene group, a substituted or unsubstituted arylene group, —COO—, —O—, —OO—, —S— or —$CONR^{14}$. $R^{11}$ to $R^{14}$ each independently represent a hydrogen atom, a halogen atom, a substituted or unsubstituted alkyl group, a substituted or unsubstituted aryl group or a substituted or unsubstituted aralkyl group. A subscript letter symbol X represents 0 or 1. Here, the halogen atom may include a fluorine atom, a chlorine atom and a bromine atom. The alkyl group may include a methyl group, an ethyl group, a propyl group and a butyl group. The aryl group may include a phenyl group, a naphthyl group, an anthryl group, a pyrenyl group, a thiophenyl group or a furyl group. The aralkyl group may include a benzyl group, a phenethyl group, a naphthylmethyl group, a furfuryl group and a thienyl group. The alkoxyl group may include a methoxyl group, an ethoxyl group and a propoxyl group. The alkylene group may include a methylene group, an ethylene group and a butylene group. The arylene group may include a phenylene group, an naphthylene group and an anthracenylene group.

The substituent the above each group may have may include halogen atoms such as a fluorine atom, a chlorine atom, a bromine atom and an iodine atom; alkyl groups such as a methyl group, an ethyl group, a propyl group and a butyl group; aryl groups such as a phenyl group, a naphthyl group, an anthryl group and a pyrenyl group; aralkyl groups such as a benzyl group, a phenethyl group, a naphthylmethyl group, a furfuryl group and a thienyl group; alkoxyl groups such as a methoxyl group, an ethoxyl group and a propoxyl group; aryloxyl groups such as a phenoxyl group and a naphthoxyl group; and a nitro group, a cyano group and a hydroxyl group.

(2)

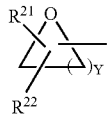

In the formula (2), $R^{21}$ and $R^{22}$ each independently represent a hydrogen atom, a substituted or unsubstituted alkyl group, a substituted or unsubstituted aryl group or a substituted or unsubstituted aralkyl group. A subscript letter symbol Y represents an integer of 1 to 10. Here, the alkyl group may include a methyl group, an ethyl group, a propyl group and a butyl group. The aryl group may include a phenyl group and a naphthyl group. The aralkyl group may include a benzyl group and a phenethyl group.

The substituent the above each group may have may include halogen atoms such as a fluorine atom, a chlorine atom, a bromine atom and an iodine atom; alkyl groups such as a methyl group, an ethyl group, a propyl group and a butyl group; aryl groups such as a phenyl group, a naphthyl group, an anthryl group and a pyrenyl group; aralkyl groups such as a benzyl group, a phenethyl group, a naphthylmethyl group, a furfuryl group and a thienyl group; alkoxyl groups such as a methoxyl group, an ethoxyl group and a propoxyl group; and aryloxyl groups such as a phenoxyl group and a naphthoxyl group.

(3)

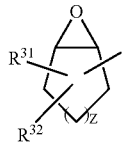

In the formula (3), $R^{31}$ and $R^{32}$ each independently represent a hydrogen atom, a substituted or unsubstituted alkyl group, a substituted or unsubstituted aryl group or a substituted or unsubstituted aralkyl group. A subscript letter symbol Z represents an integer of 0 to 10. Here, the alkyl group may include a methyl group, an ethyl group, a propyl group and a butyl group. The aryl group may include a phenyl group and a naphthyl group. The aralkyl group may include a benzyl group and a phenethyl group.

The substituent the above each group may have may include halogen atoms such as a fluorine atom, a chlorine atom, a bromine atom and an iodine atom; alkyl groups such as a methyl group, an ethyl group, a propyl group and a butyl group; aryl groups such as a phenyl group, a naphthyl group, an anthryl group and a pyrenyl group; aralkyl groups such as a benzyl group, a phenethyl group, a naphthylmethyl group, a furfuryl group and a thienyl group; alkoxyl groups such as a methoxyl group, an ethoxyl group and a propoxyl group; and aryloxyl groups such as a phenoxyl group and a naphthoxyl group.

Of the chain-polymerizing functional groups having structures represented by the above formulas (1) to (3), chain-polymerizing functional groups having structures represented by the following formulas (P-1) to (P-11) are more preferable.

(P-1)

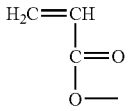

(P-2)

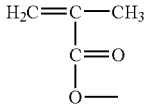

(P-3)

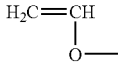

(P-4)

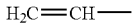

(P-5)

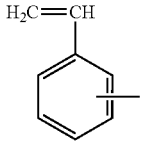

(P-6)

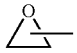

(P-7)

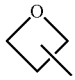

(P-8)

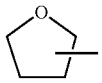

(P-9)

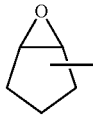

(P-10)

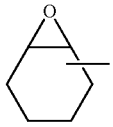

(P-11)

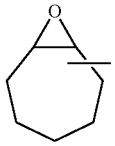

Of the chain-polymerizing functional groups having structures represented by the above formulas (P-1) to (P-11), the following are still more preferred: the chain-polymerizing functional group having the structure represented by the above formula (P-1), i.e., an acryloyloxyl group, and the chain-polymerizing functional group having the structure represented by the above formula (P-2), i.e., a methacryloyloxyl group.

In the present invention, of the hole transporting compounds having chain-polymerizing functional groups having the above chain-polymerizing functional groups, a hole transporting compound having two or more chain-polymerizing functional groups (in the same molecule) is preferred.

Specific examples of the hole transporting compound having two or more chain-polymerizing functional groups are shown below.

$$(P^{41})_a—A^{41}—[R^{41}—(P^{42})_d]_b \quad (4)$$

In the above formula (4), $P^{41}$ and $P^{42}$ each independently represent a chain-polymerizing functional group. $R^{41}$ represent a divalent group. A41 represent a hole transporting group. Subscript letter symbols a, b and d each independently represent an integer of 0 or more, provided that a+b×d is 2 or more. Where a is 2 or more, $p^{41}$'s may be the same or different. Where b is 2 or more, $[R^{41}—(P^{42})_d]$'S may be the same or different. Where d is 2 or more, $P^{42}$'s may be the same or different.

To exemplify those in which all the $(P^{41})_a$ and $[P^{41}—RP^{42})_d]$ in the formula (4) have been substituted with hydrogen atoms, they may include oxazole derivatives, oxathiazole derivatives, imidazole derivatives, styryl derivatives, hydrazone derivatives, triarylamine derivatives (such as triphenylamine), 9-(p-diethylaminosttyryl)anthrathene, 1,1-bis(4-dibenzylaminophenyl)propane, styrylanthrathene, styrylpyrazoline, phenylhydrazones, thiazole derivatives, triazole derivatives, phenazine derivatives, acrylidine derivatives, benzofuran derivatives, benzimidazole derivatives, thiophene derivatives and N-phenylcarbazole derivatives. Of these in which all the $(P^{41})$a and $[R^{41}—(P^{42})_d]$ in the formula (4) have been substituted with hydrogen atoms, those having a structure represented by the following formula (5) are preferred.

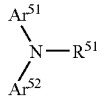

(5)

In the above formula (5), $R^{51}$ represents a substituted or unsubstituted alkyl group, a substituted or unsubstituted aryl group or a substituted or unsubstituted aralkyl group. $Ar^{51}$ and $Ar^{52}$ each independently represent a substituted or unsubstituted aryl group. $R^{51}$, $Ar^{51}$ and $Ar^{52}$ may be combined directly with the N (nitrogen atom), or may be combined with the N (nitrogen atom) via an alkylene group (such as a methyl group, an ethyl group or a propylene group), a hetero-atom (such as an oxygen atom or a sulfur atom) or —CH═CH—. Here, the alkyl group may preferably be one having 1 to 10 carbon atoms, and may include a methyl group, an ethyl group, a propyl group and a butyl group. The aryl group may include a phenyl group, a naphthyl group, an anthryl group, a pyrenyl group, a thiophenyl group, a furyl group, a pyridyl group, a quinolyl group, a benzoquinolyl group, a carbazolyl group, a phenothiazyl group, a benzofuryl group, a benzothiophenyl group, a dibenzofuryl group and a dibenzothiophenyl group. The aralkyl group may include a benzyl group, a phenethyl group, a naphthylmethyl group, a furfuryl group and a thienyl group. $R^{51}$ in the above formula (5) may preferably be a substituted or unsubstituted aryl group.

The substituent the above each group may have may include halogen atoms such as a fluorine atom, a chlorine atom, a bromine atom and an iodine atom; alkyl groups such as a methyl group, an ethyl group, a propyl group and a butyl group; aryl groups such as a phenyl group, a naphthyl group, an anthryl group and a pyrenyl group; aralkyl groups such as a benzyl group, a phenethyl group, a naphthylmethyl group, a furfuryl group and a thienyl group; alkoxyl groups such as a methoxyl group, an ethoxyl group and a propoxyl group; aryloxyl groups such as a phenoxyl group and a naphthoxyl group; substituted amino groups such as a dimethylamino group, a diethylamino group, a dibenzylamino group, a diphenylamino group and a di(p-tolyl)amino group; arylvinyl groups such as a styryl group and a naphthylvinyl group; and a nitro group, a cyano group and a hydroxyl group.

The divalent group represented by $P^{41}$ in the above formula (4) may include substituted or unsubstituted alkylene groups, substituted or unsubstituted arylene groups, $—CR^{411}═CR^{412}—$ (where $R^{411}$ and $CR^{412}$ each independently represent a hydrogen atom, a substituted or unsubstituted alkyl group or a substituted or unsubstituted aryl group), —CO—, —SO—, $—SO_2—$, an oxygen atom and a sulfur atom, and also a combination of any of these. Of these, a divalent group having a structure represented by the following formula (6) is preferred, and a divalent group having a structure represented by the following formula (7) is more preferred.

$$—(X^{61})_{p6}—(Ar^{61})_{q6}—(X^{62})_{r6}—(Ar^{62})_{s6}—(X^{63})_{t6}— \quad (6)$$

$$—(X^{71})_{p7}—(Ar^{71})_{q7}—(X^{72})_{r7}— \quad (7)$$

In the above formula (6), $X^{61}$ to $X^{63}$ each independently represent a substituted or unsubstituted alkylene group, $—(CR^{61}═CR^{62})_{n6}—$ (where $R^{61}$ and $R^{62}$ each independently represent a hydrogen atom, a substituted or unsubstituted alkyl group or a substituted or unsubstituted aryl group, and a subscript letter symbol n6 represents an integer of 1 or more and preferably 5 or less), —CO—, —SO—, $—SO_2—$, an oxygen atom or a sulfur atom. $Ar^{61}$ and $Ar^{62}$ each independently represent a substituted or unsubstituted arylene group. Subscript letter symbols p6, q6, r6, s6 and t6 each independently represent an integer of 0 or more (preferably 10 or less, and more preferably 5 or less), provided that it is excluded that all of p6, q6, r6, s6 and t6 are 0. Here, the alkylene group may preferably be one having 1 to 20 carbon atoms, and particularly preferably one having 1 to 10 carbon atoms, and may include a methylene group, an ethylene group and a propylene group. The arylene group may include divalent groups formed by removing two hydrogen atoms from benzene, naphthalene, anthracene, phenanthrene, pyrene, benzothiophene, pyridine, quinoline, benzoquinoline, carbazole, phenothiazine, benzofuran, benzothiophene, dibenzofuran, dibenzothiophene and the like. The alkyl group may include a methyl group, an ethyl group and a propyl group. The aryl group may include a phenyl group, a naphthyl group and a thiophenyl group.

The substituent the above each group may have may include halogen atoms such as a fluorine atom, a chlorine atom, a bromine atom and an iodine atom; alkyl groups such as a methyl group, an ethyl group, a propyl group and a butyl group; aryl groups such as a phenyl group, a naphthyl group, an anthryl group and a pyrenyl group; aralkyl groups such as a benzyl group, a phenethyl group, a naphthylmethyl group, a furfuryl group and a thienyl group; alkoxyl groups such as a methoxyl group, an ethoxyl group and a propoxyl group; aryloxyl groups such as a phenoxyl group and a naphthoxyl group; substituted amino groups such as a dimethylamino group, a diethylamino group, a dibenzylamino group, a diphenylamino group and a di(p-tolyl)amino group; arylvinyl groups such as a styryl group and a naphthlyvinyl group; and a nitro group, a cyano group and a hydroxyl group.

In the above formula (7), $X^{71}$ and $X^{72}$ each independently represent a substituted or unsubstituted alkylene group, $—(CR^{71}═CR^{72})_{n7}—$ (where $R^{71}$ and $R^{72}$ each independently represent a hydrogen atom, a substituted or unsubstituted alkyl group or a substituted or unsubstituted aryl group, and a subscript letter symbol n7 represents an integer of 1 or more and preferably 5 or less), —CO— or an oxygen atom. $Ar^{71}$ represents a substituted or unsubstituted arylene group. Subscript letter symbols p7, q7 and r7 each independently represent an integer of 0 or more (preferably 10 or less, and more preferably 5 or less), provided that it is excluded that all of p7, q7 and r7 are 0. Here, the alkylene group may preferably be one having 1 to 20 carbon atoms, and particularly preferably one having 1 to 10 carbon atoms, and may include a methylene group, an ethylene group and a propylene group. The arylene group may include may include divalent groups formed by removing two hydrogen atoms from benzene, naphthalene, anthracene, phenanthrene, pyrene, benzothiophene, pyridine, quinoline, benzoquinoline, carbazole, phenothiazine, benzofuran, benzothiophene, dibenzofuran, dibenzothiophene and the like. The alkyl group may include a methyl group, an ethyl group and a propyl group. The aryl group may include a phenyl group, a naphthyl group and a thiophenyl group.

The substituent the above each group may have may include halogen atoms such as a fluorine atom, a chlorine atom, a bromine atom and an iodine atom; alkyl groups such as a methyl group, an ethyl group, a propyl group and a butyl group; aryl groups such as a phenyl group, a naphthyl group, an anthryl group and a pyrenyl group; aralkyl groups such as a benzyl group, a phenethyl group, a naphthylmethyl group, a furfuryl group and a thienyl group; alkoxyl groups such as a methoxyl group, an ethoxyl group and a propoxyl group; aryloxyl groups such as a phenoxyl group and a naphthoxyl group; substituted amino groups such as a dimethylamino group, a diethylamino group, a dibenzylamino group, a diphenylamino group and a di(p-tolyl)amino group; arylvinyl groups such as a styryl group and a naphthylvinyl group; and a nitro group, a cyano group and a hydroxyl group.

Preferred examples (exemplary compounds) of the hole transporting compound having two or more chain-polymerizing functional groups are shown below.

| No. | Exemplary compound |
|---|---|
| 1 | 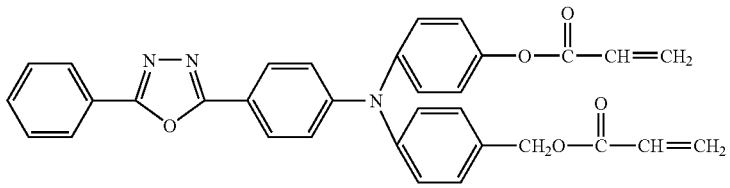 |
| 2 | 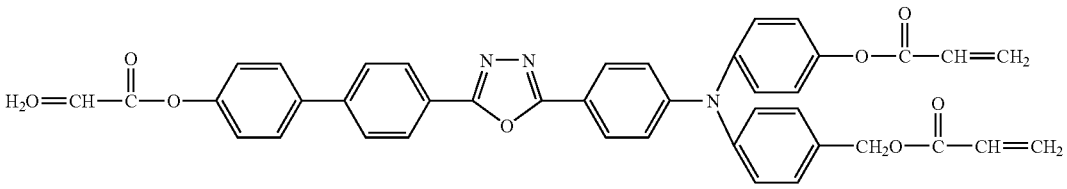 |
| 3 | 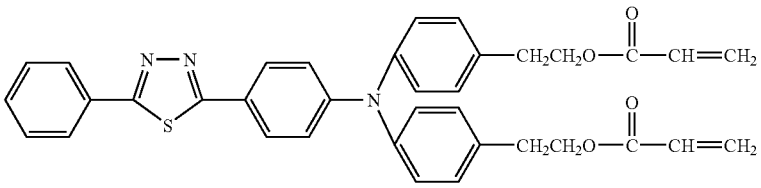 |
| 4 | 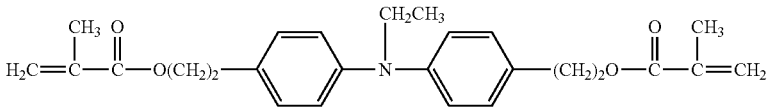 |
| 5 | 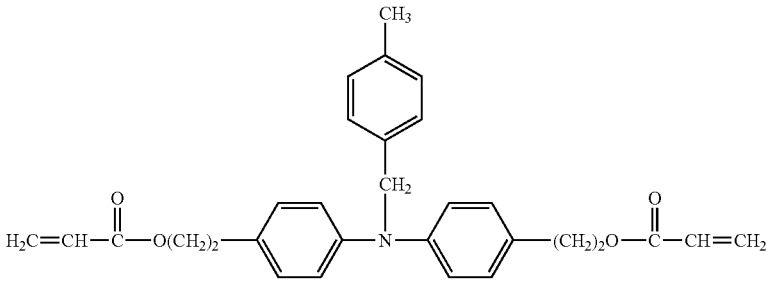 |

-continued
| No. | Exemplary compound |
|---|---|
| 6 | 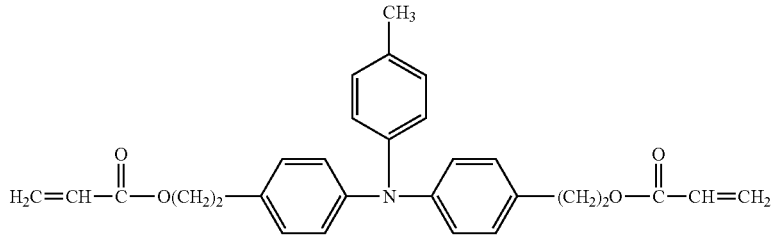 |
| 7 | 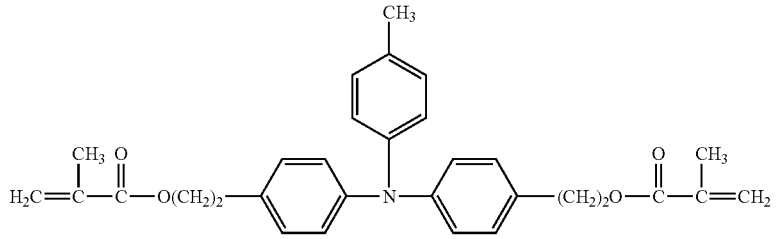 |
| 8 | 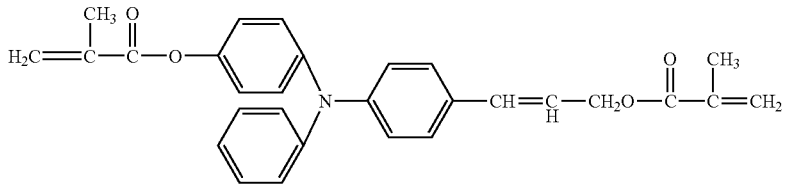 |
| 9 | 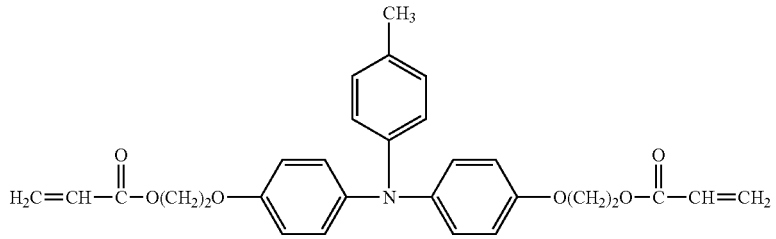 |
| 10 | 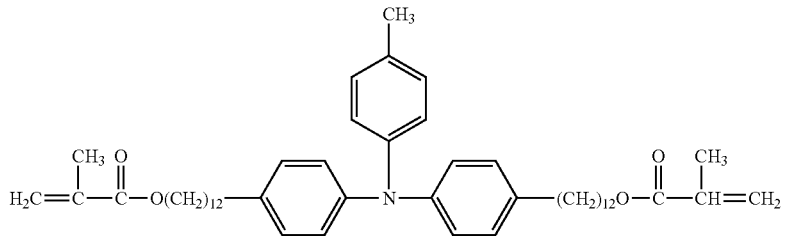 |
| 11 | 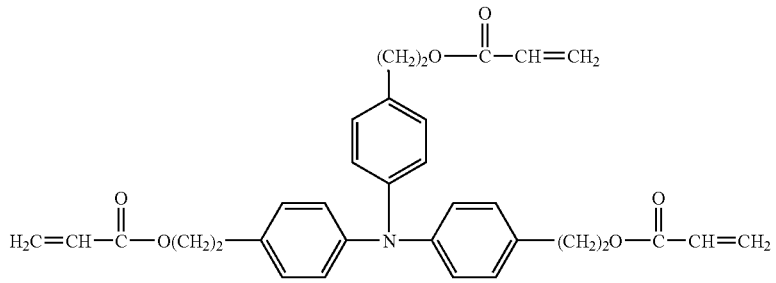 |

-continued
| No. | Exemplary compound |
|---|---|
| 12 | 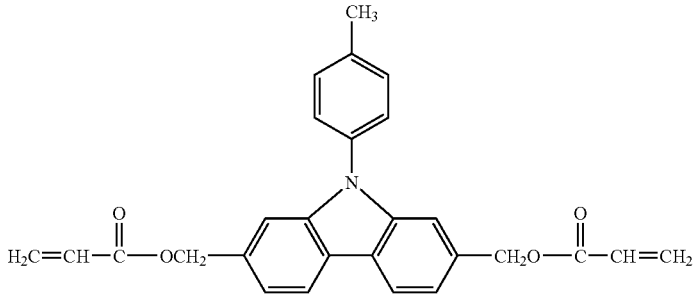 |
| 13 | 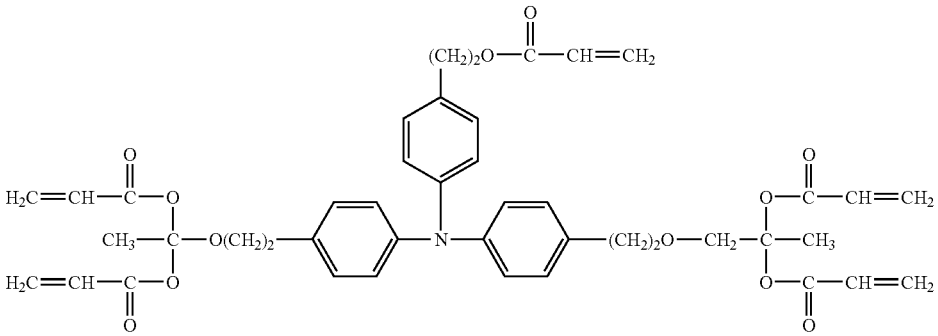 |
| 14 | 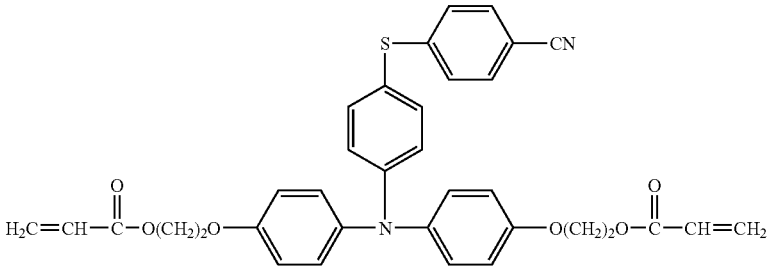 |
| 15 | 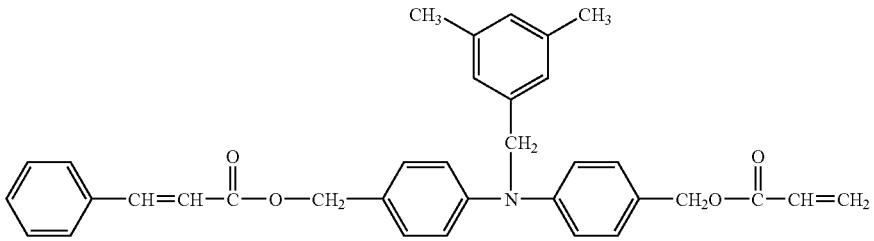 |
| 16 | 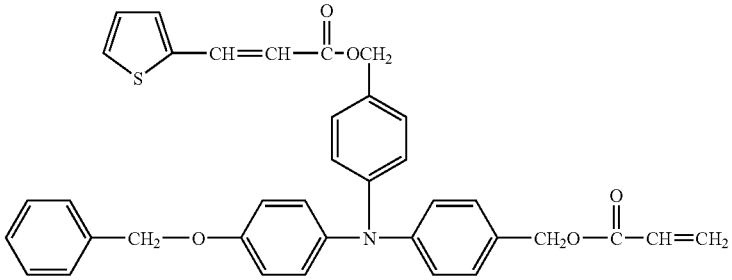 |

-continued
| No. | Exemplary compound |
|---|---|
| 17 | 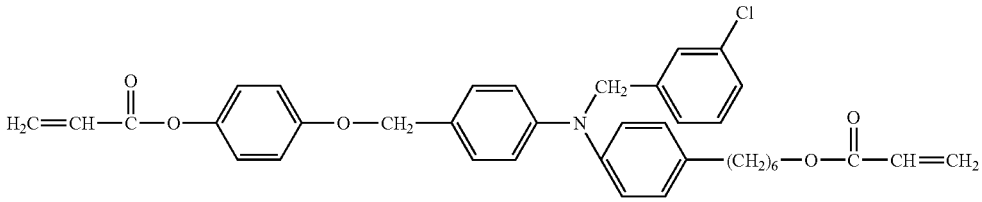 |
| 18 | 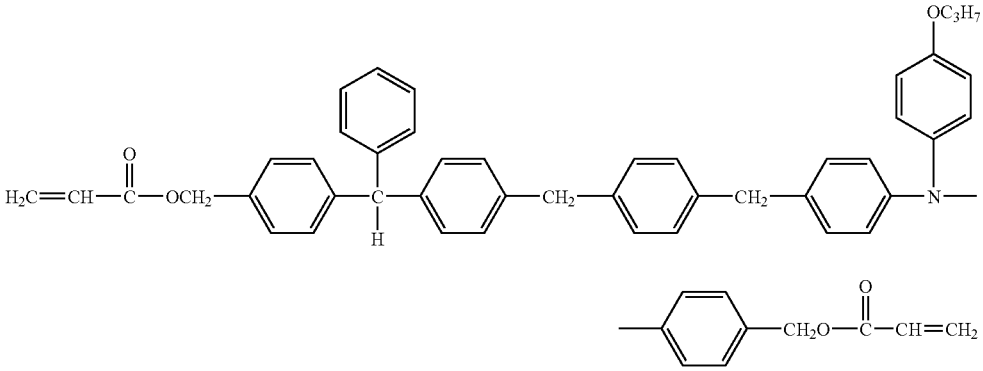 |
| 19 | 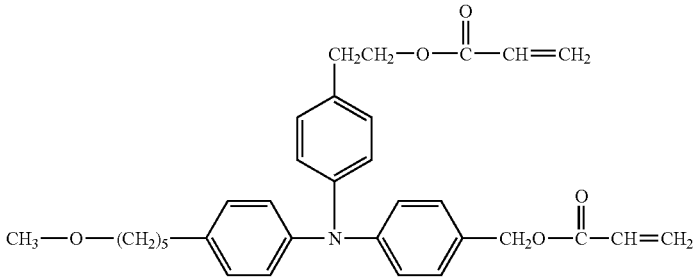 |
| 20 | 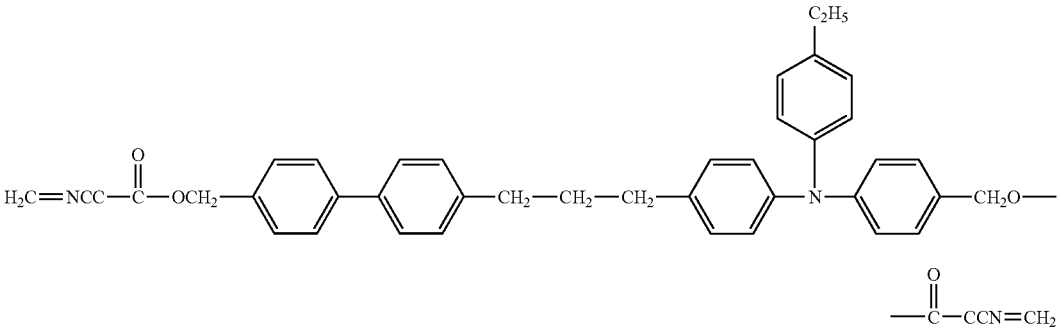 |
| 21 | 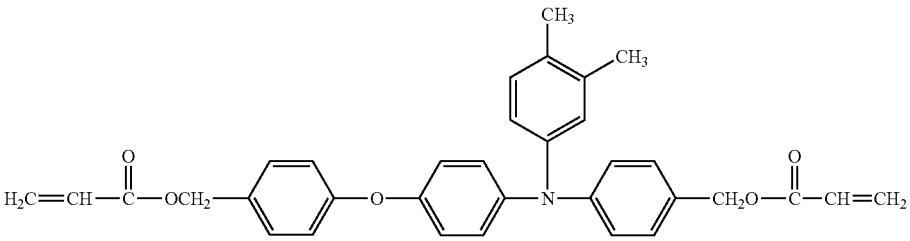 |
| 22 | 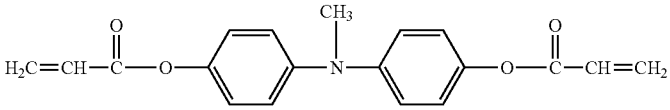 |

-continued
| No. | Exemplary compound |
|---|---|
| 23 | 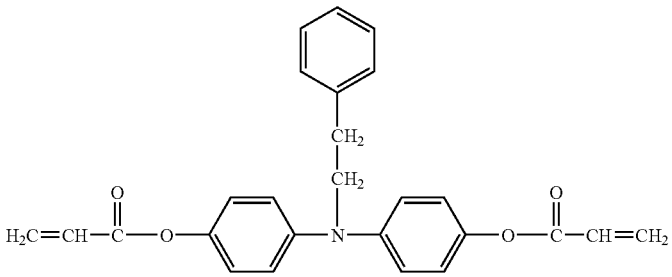 |
| 24 | 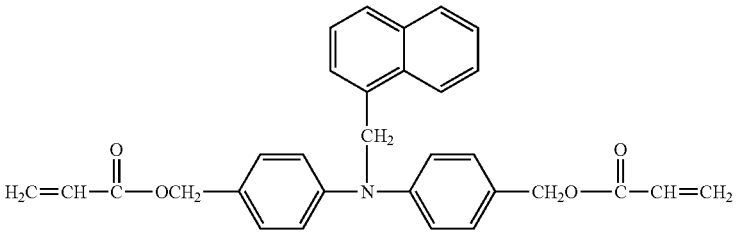 |
| 25 | 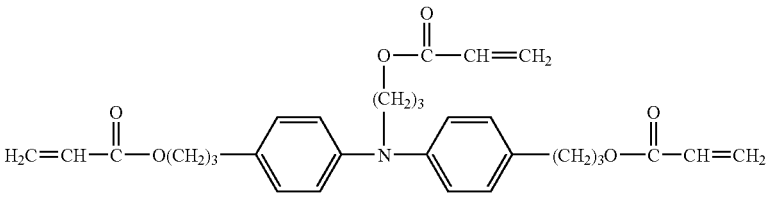 |
| 26 | 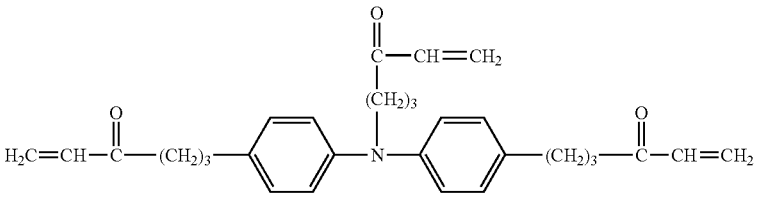 |
| 27 | 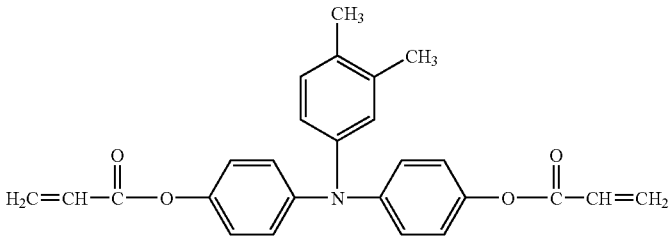 |
| 28 | 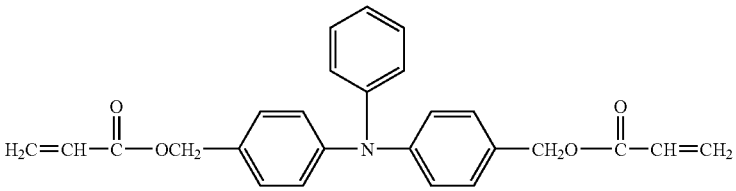 |

-continued
| No. | Exemplary compound |
|---|---|
| 29 | 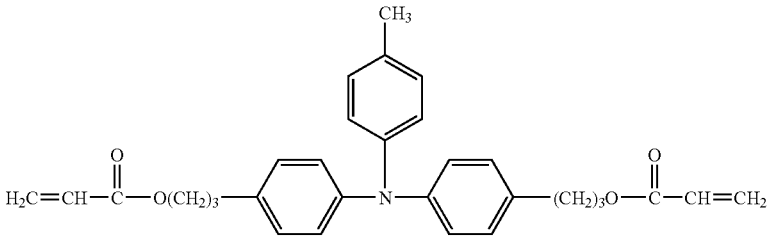 |
| 30 | 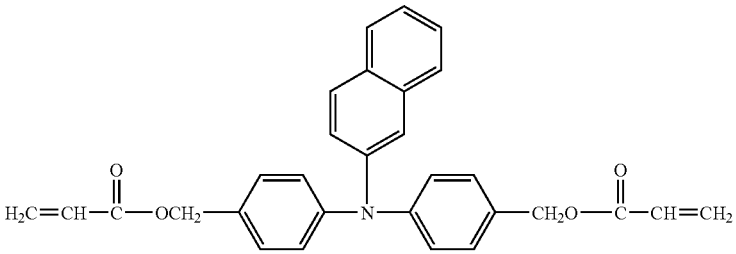 |
| 31 | 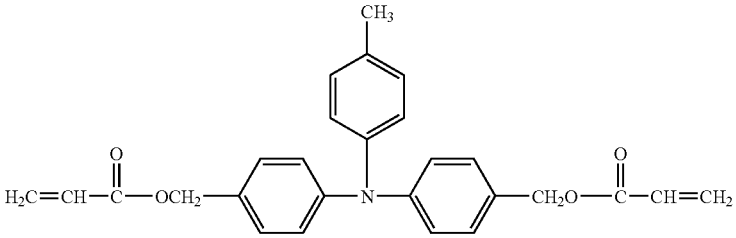 |
| 32 | 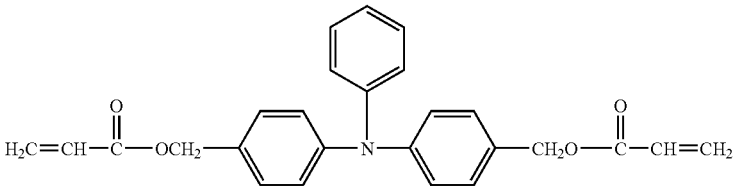 |
| 33 | 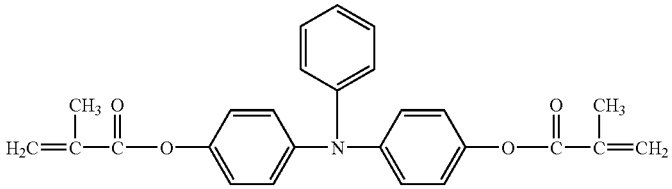 |
| 34 | 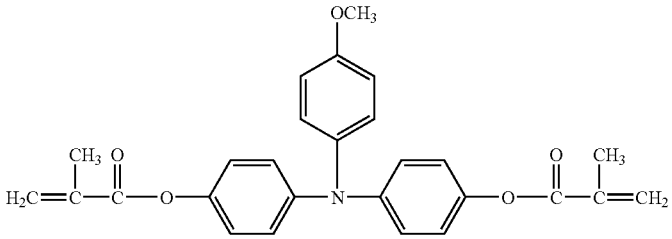 |

-continued
| No. | Exemplary compound |
|---|---|
| 35 | 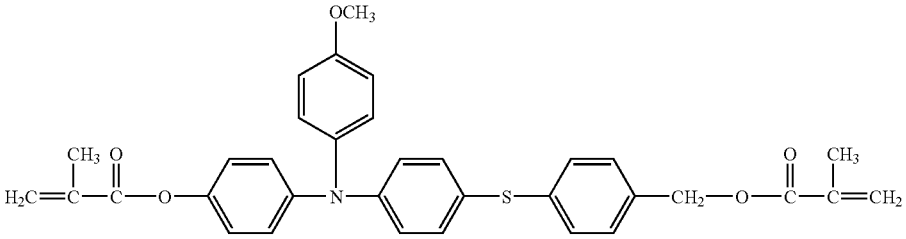 |
| 36 | 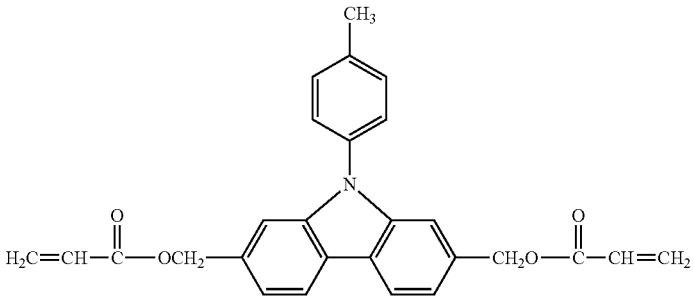 |
| 37 | 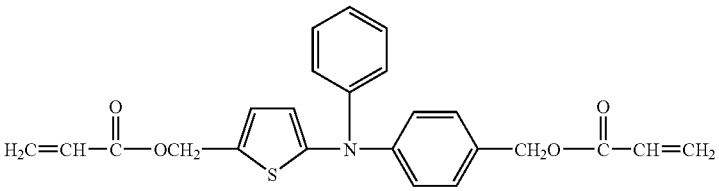 |
| 38 | 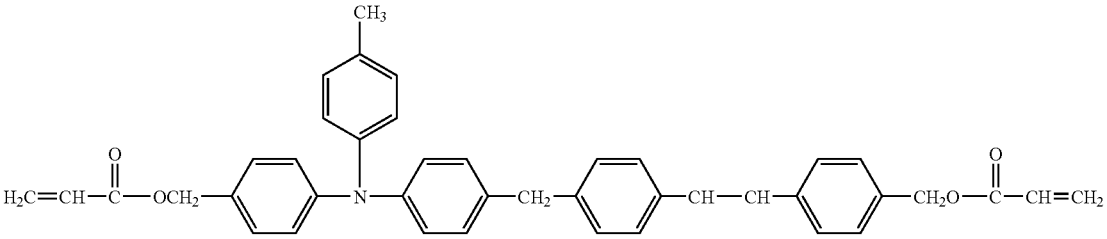 |
| 39 | 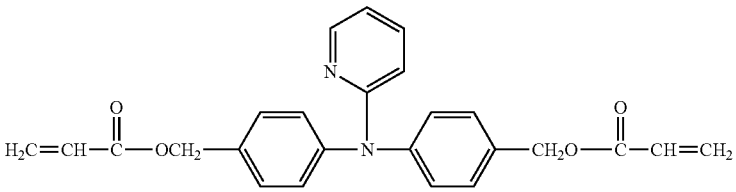 |
| 40 | 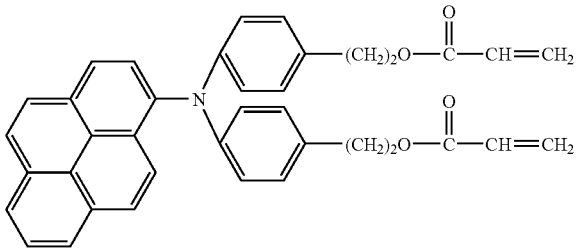 |

-continued
| No. | Exemplary compound |
|---|---|
| 41 | 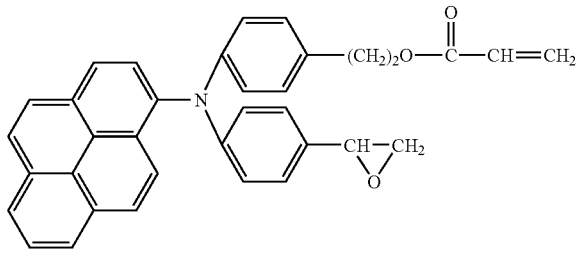 |
| 42 | 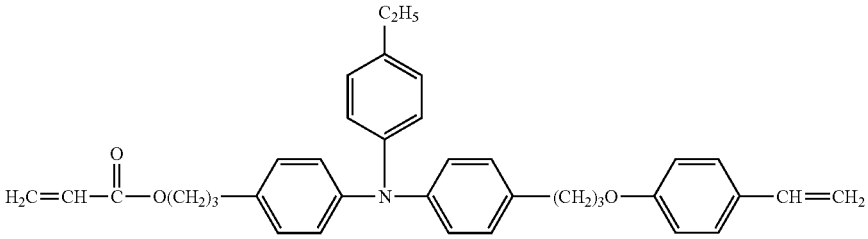 |
| 43 | 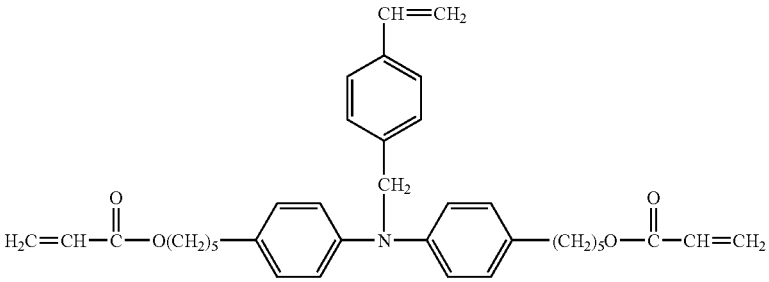 |
| 44 | 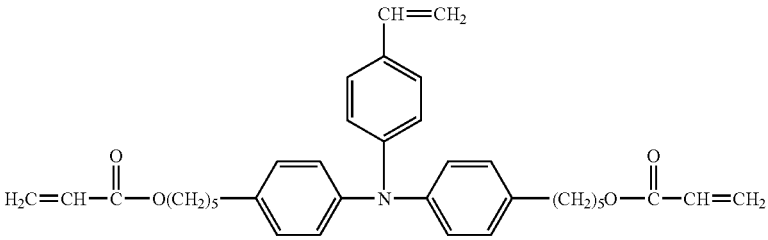 |
| 45 | 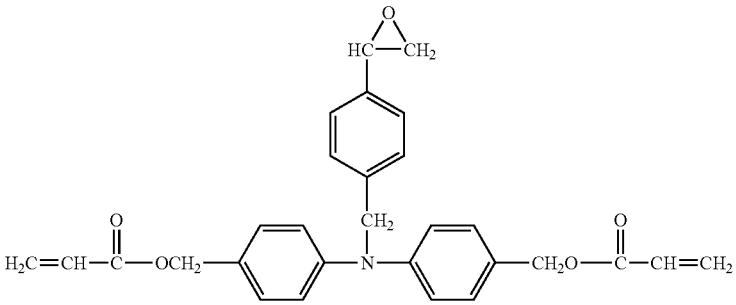 |

-continued
| No. | Exemplary compound |
|---|---|
| 46 | 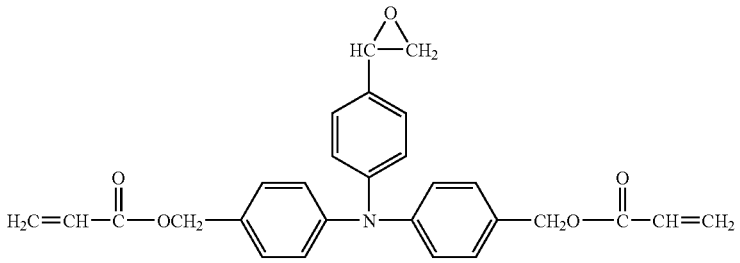 |
| 47 | 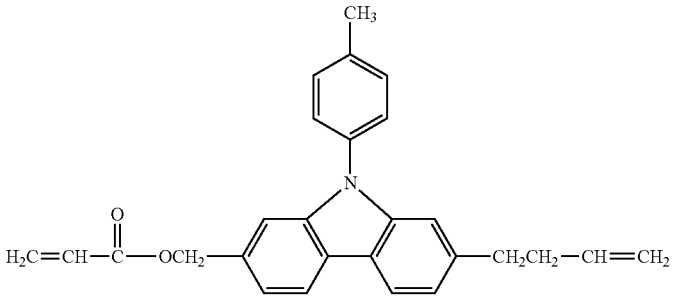 |
| 48 | 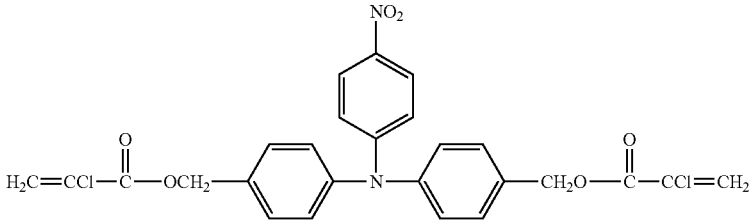 |
| 49 | 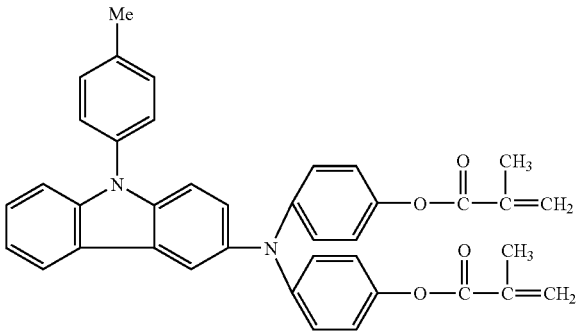 |
| 50 | 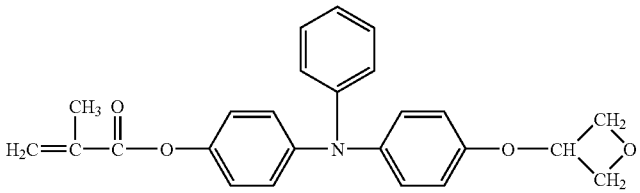 |

-continued
| No. | Exemplary compound |
|---|---|
| 51 | 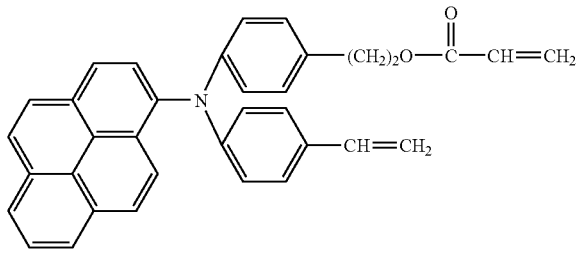 |
| 52 | 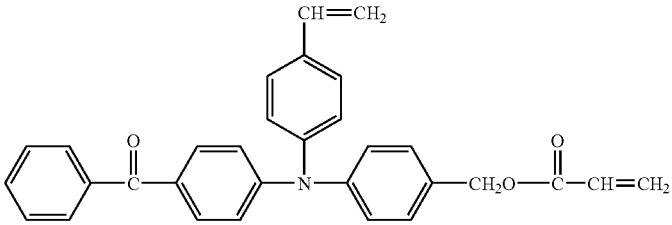 |
| 53 | 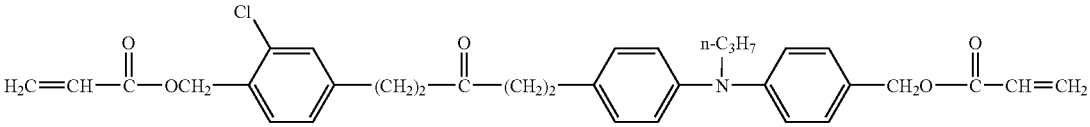 |
| 54 | 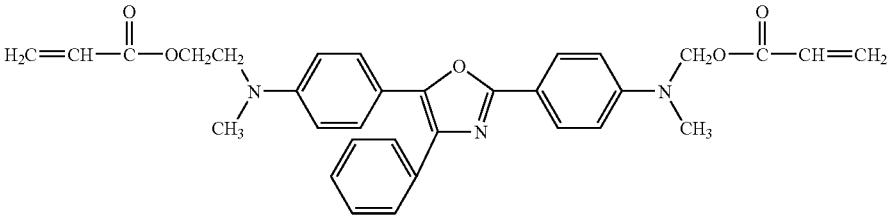 |
| 55 | 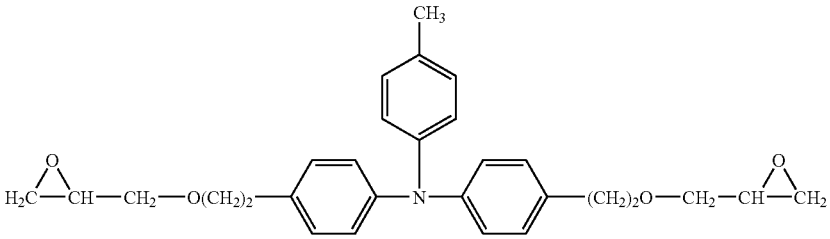 |
| 56 | 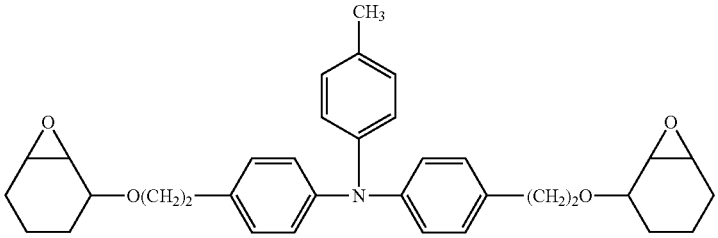 |

-continued
| No. | Exemplary compound |
|---|---|
| 57 | 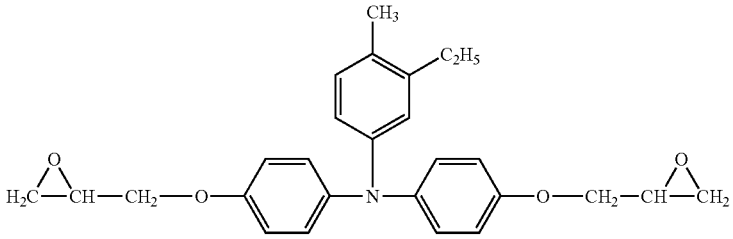 |
| 58 | 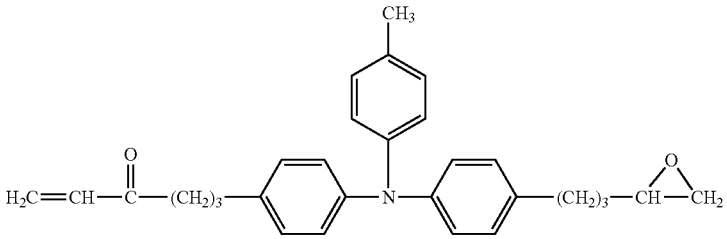 |
| 59 | 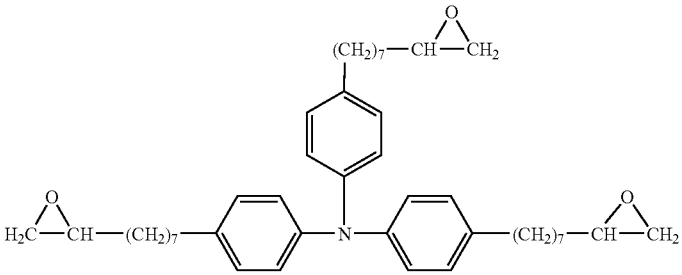 |
| 60 | 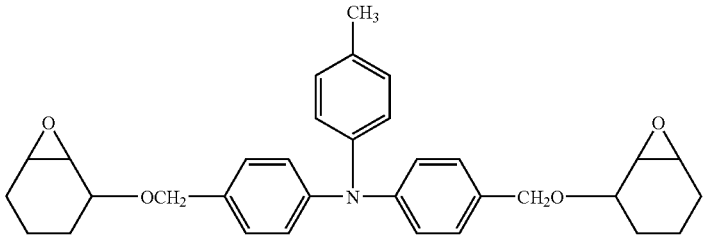 |
| 61 | 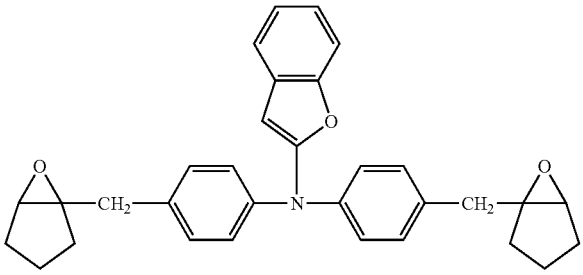 |
| 62 | 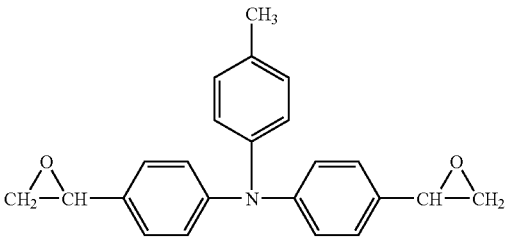 |

-continued
| No. | Exemplary compound |
|---|---|
| 63 | 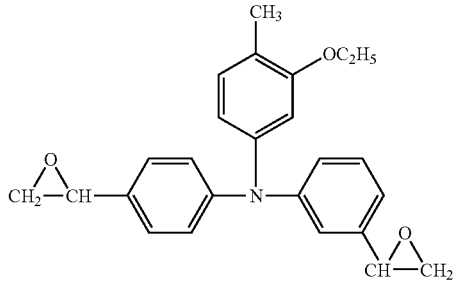 |
| 64 | 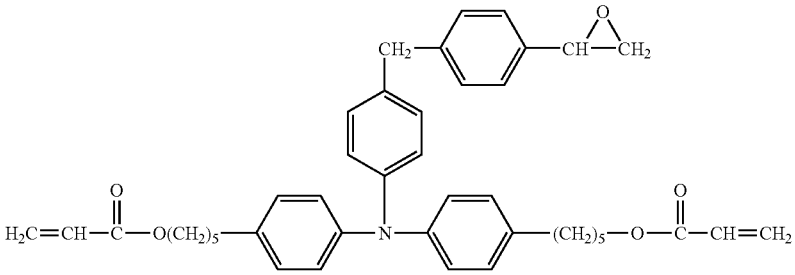 |
| 65 | 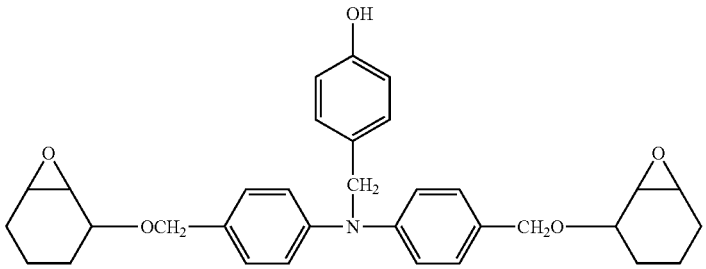 |
| 66 | 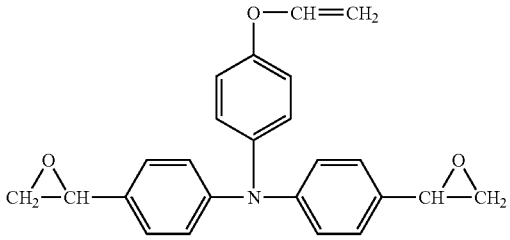 |
| 67 | 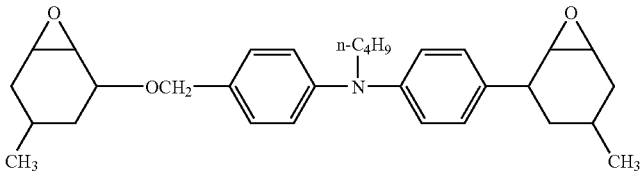 |
| 68 | 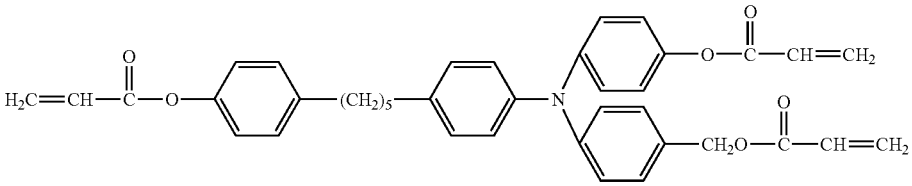 |

-continued
| No. | Exemplary compound |
|---|---|
| 69 | 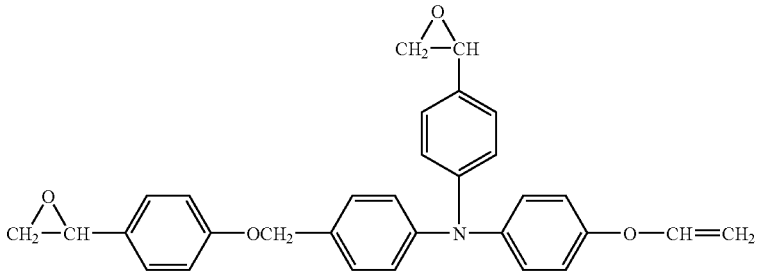 |
| 70 | 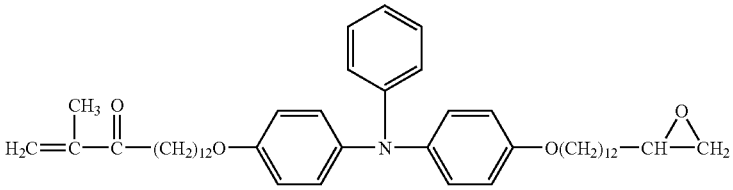 |
| 71 | 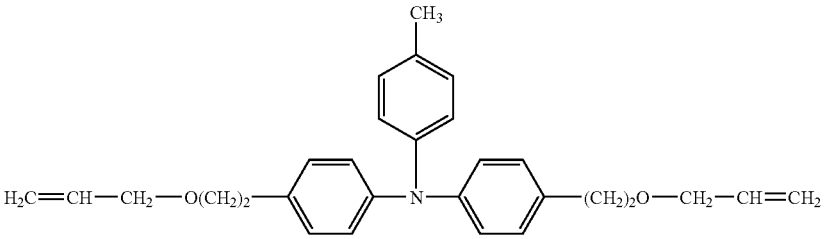 |
| 72 | 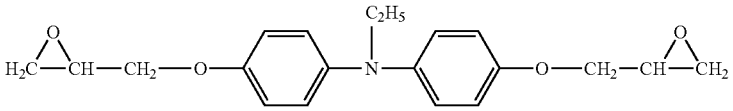 |
| 73 | 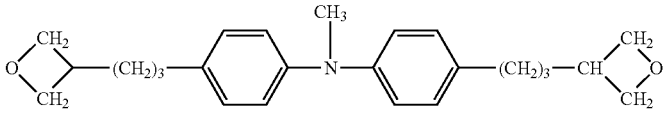 |
| 74 | 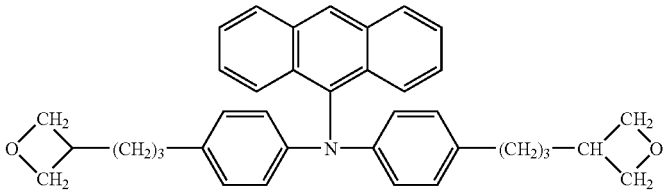 |
| 75 | 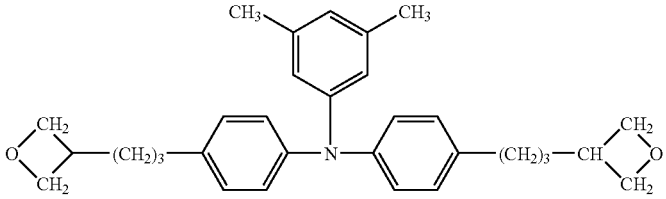 |
| 76 | 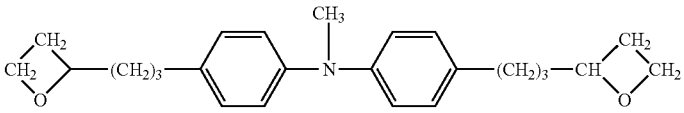 |

-continued
| No. | Exemplary compound |
|---|---|
| 77 | 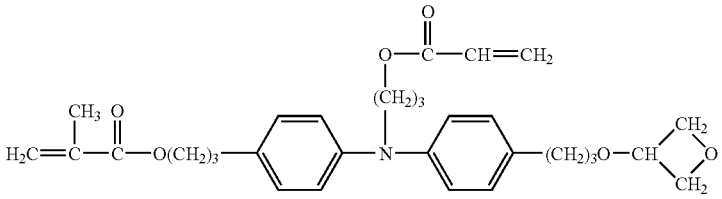 |
| 78 | 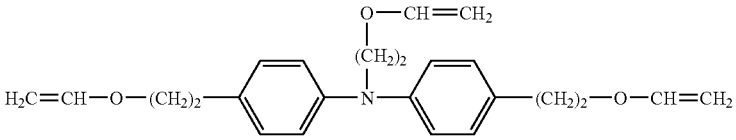 |
| 79 | 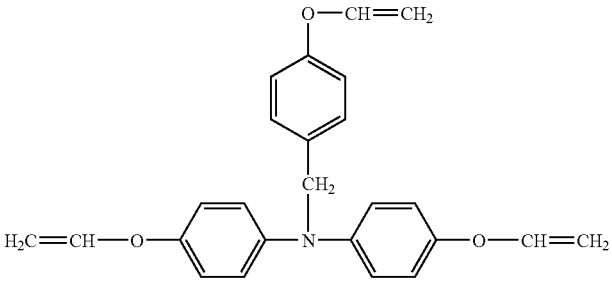 |
| 80 | 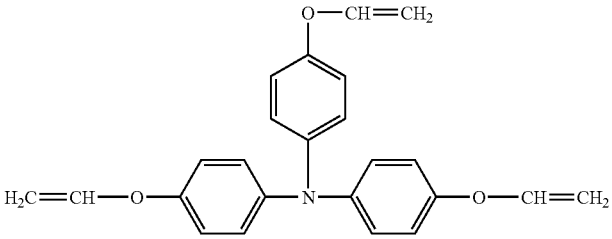 |
| 81 | 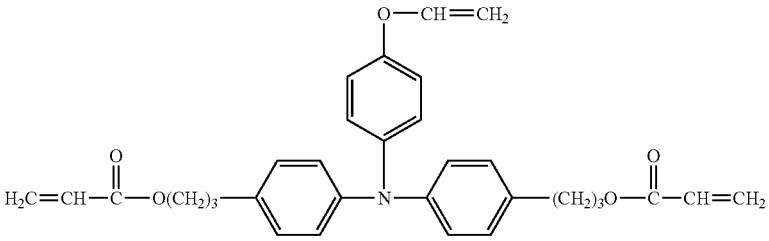 |
| 82 | 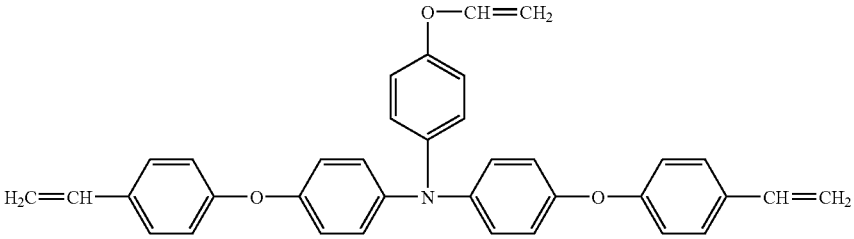 |

-continued
| No. | Exemplary compound |
|---|---|
| 83 | 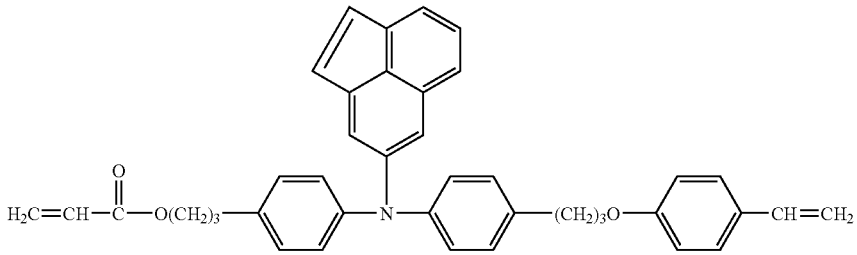 |
| 84 | 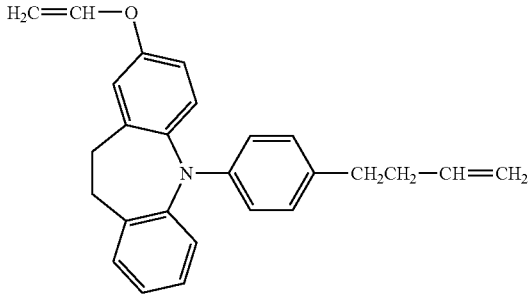 |
| 85 | 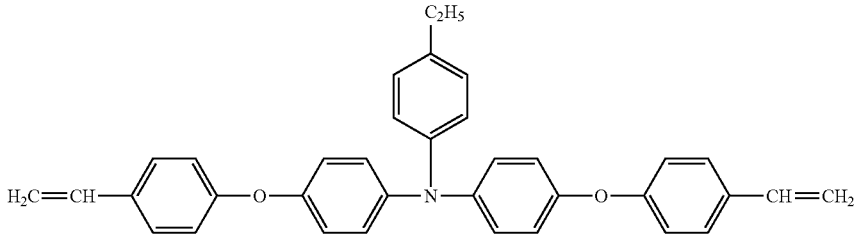 |
| 86 | 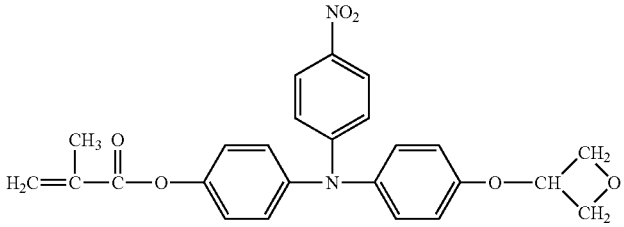 |
| 87 | 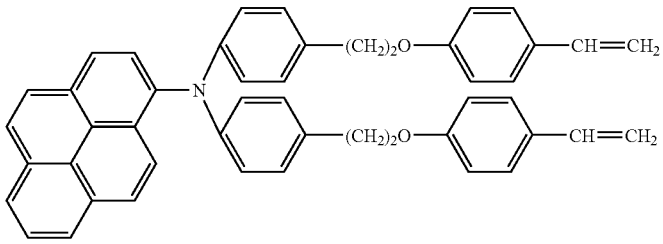 |
| 88 | 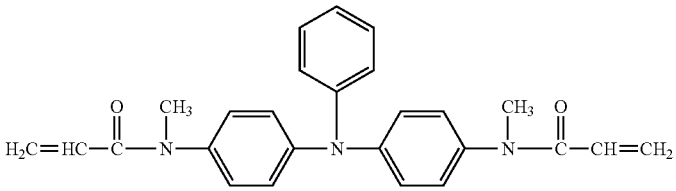 |

-continued
| No. | Exemplary compound |
|---|---|
| 89 | 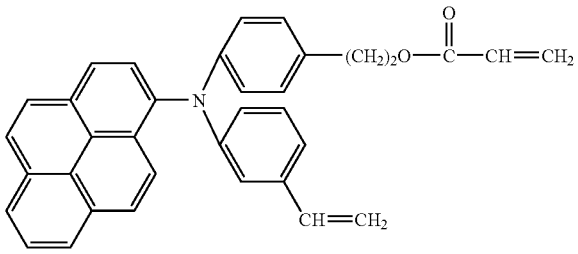 |
| 90 | 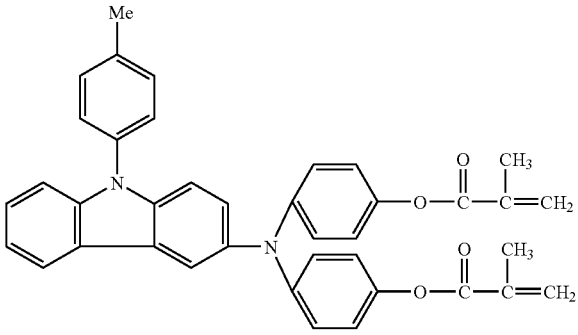 |
| 91 | 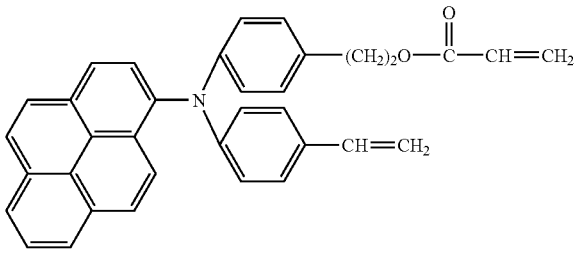 |
| 92 | 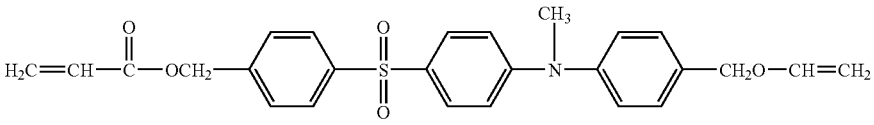 |
| 93 | 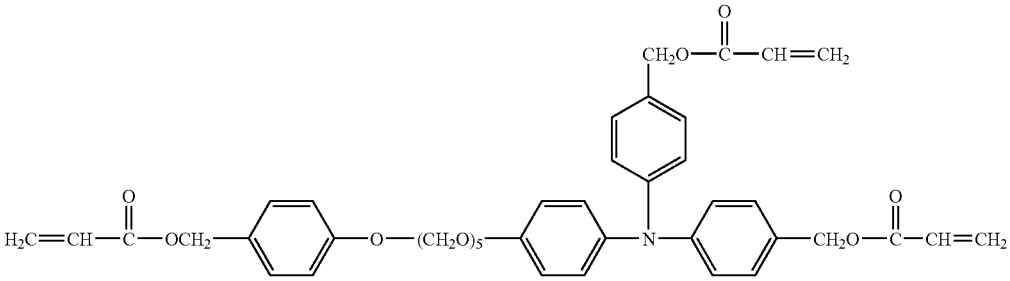 |
| 94 | 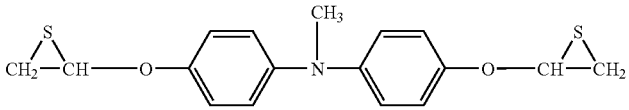 |

-continued
| No. | Exemplary compound |
|---|---|
| 95 | 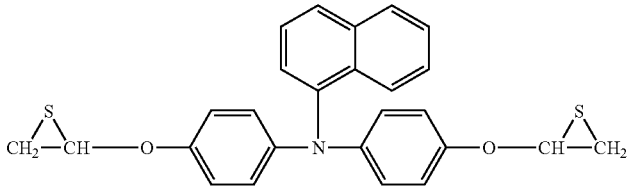 |
| 96 | 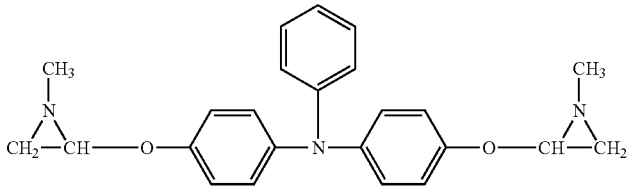 |
| 97 | 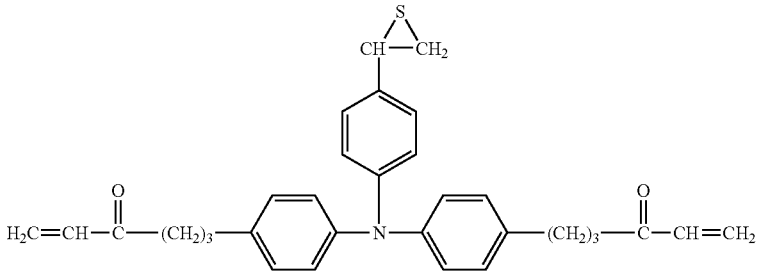 |
| 98 | 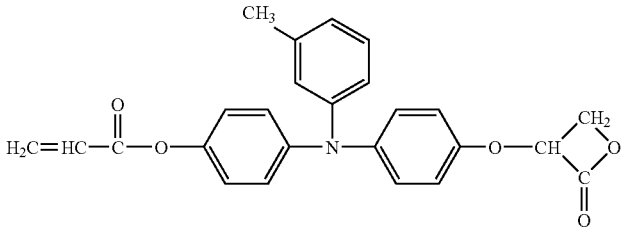 |
| 99 | 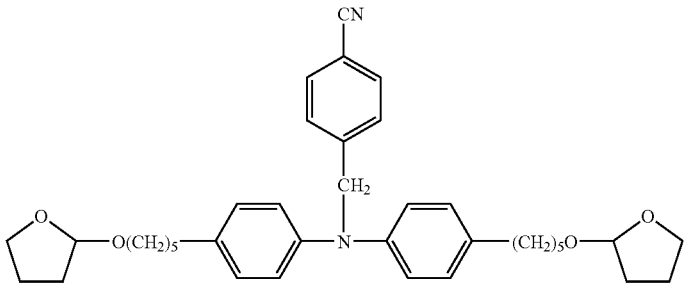 |
| 100 | 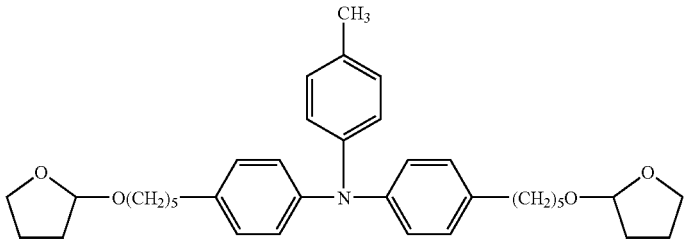 |

-continued
| No. | Exemplary compound |
|---|---|
| 101 | 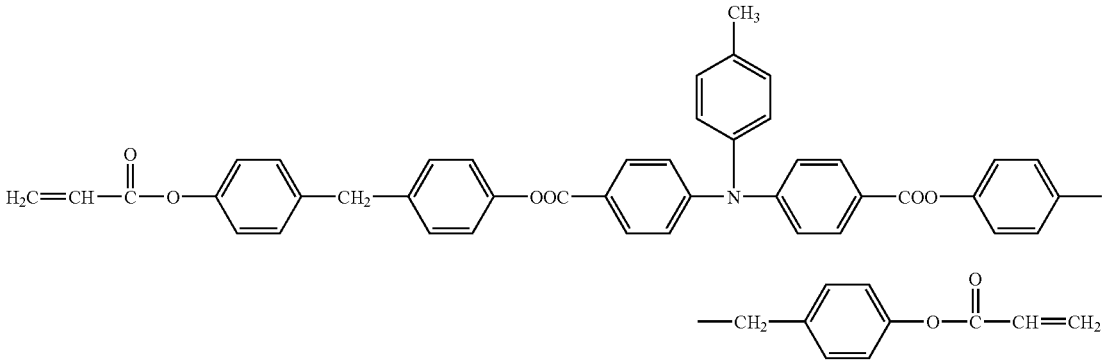 |
| 102 | 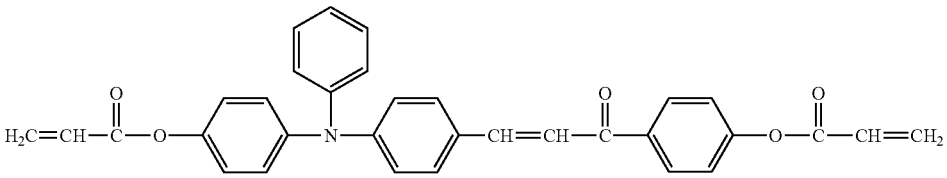 |
| 103 | 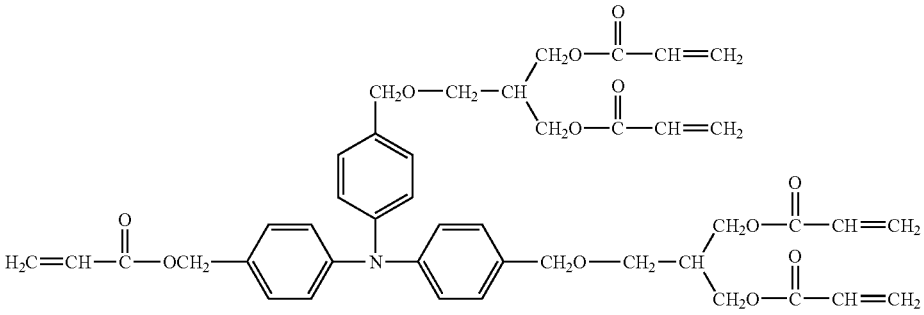 |
| 104 | 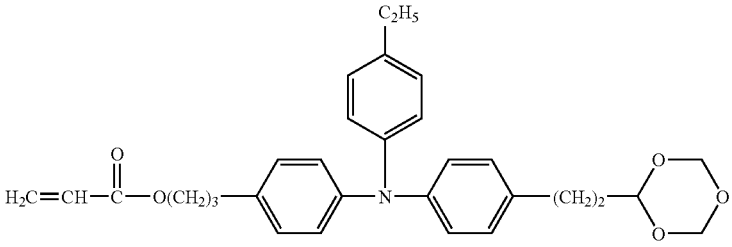 |
| 105 | 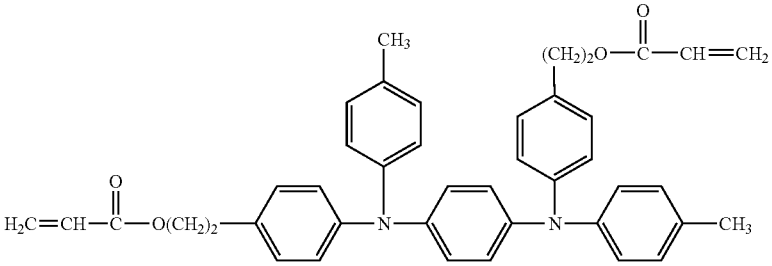 |

-continued
| No. | Exemplary compound |
|---|---|
| 106 | 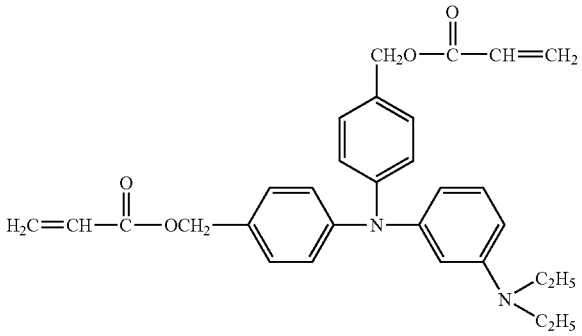 |
| 107 | 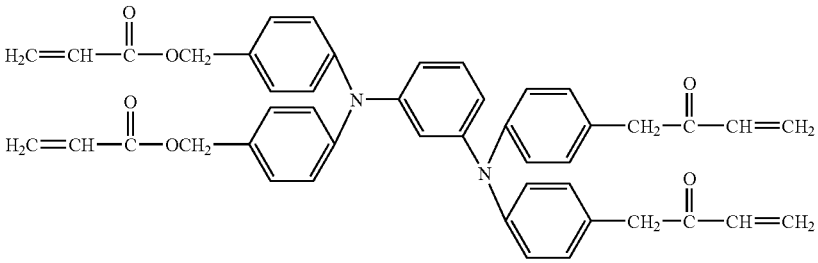 |
| 108 | 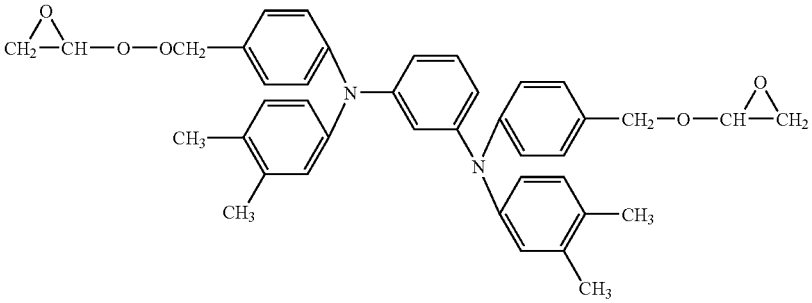 |
| 109 | 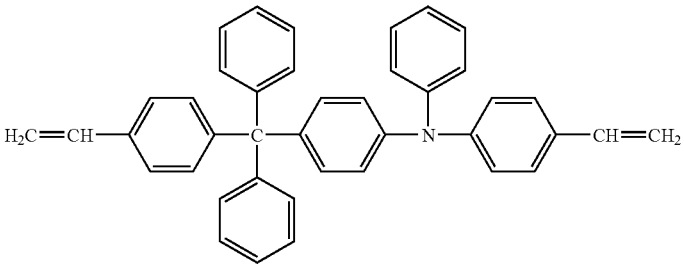 |
| 110 | 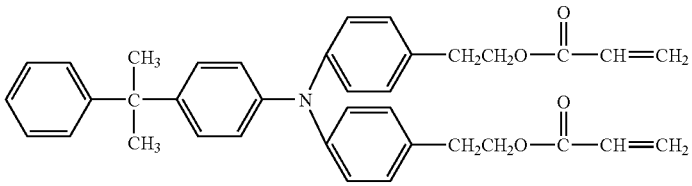 |

-continued
| No. | Exemplary compound |
|---|---|
| 111 | 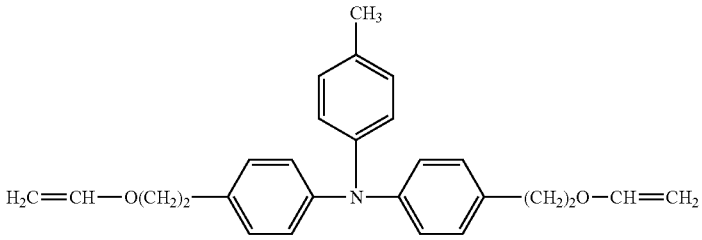 |
| 112 | 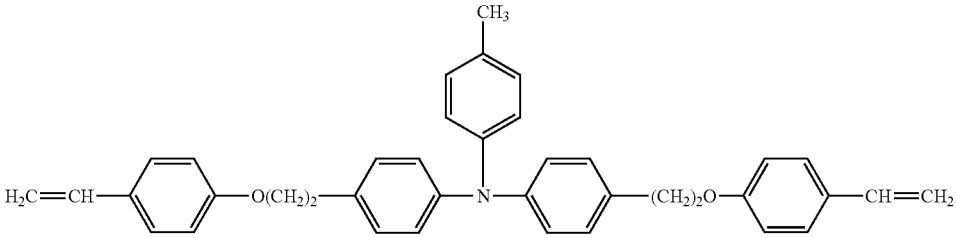 |
| 113 | 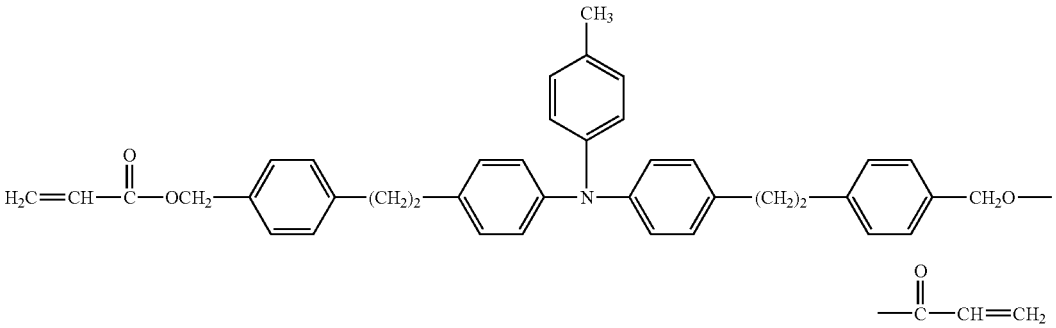 |
| 114 | 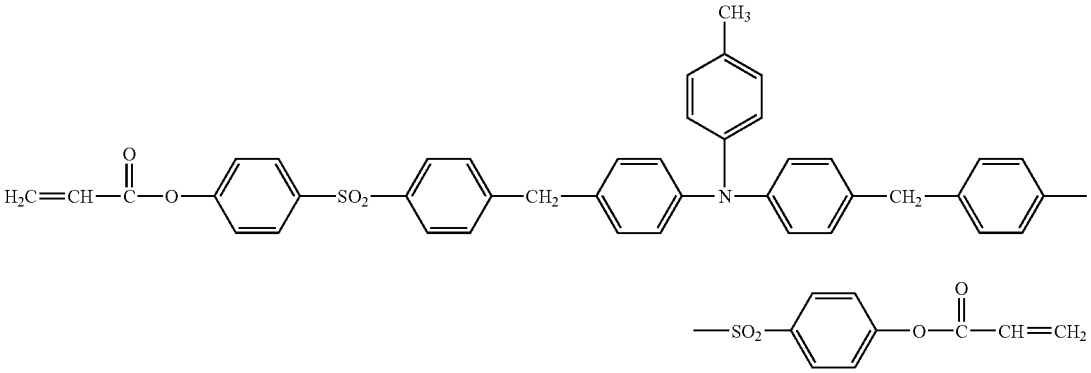 |
| 115 | 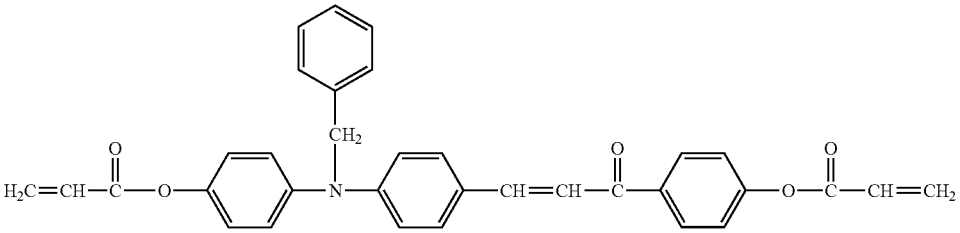 |

-continued

| No. | Exemplary compound |
|---|---|
| 116 | 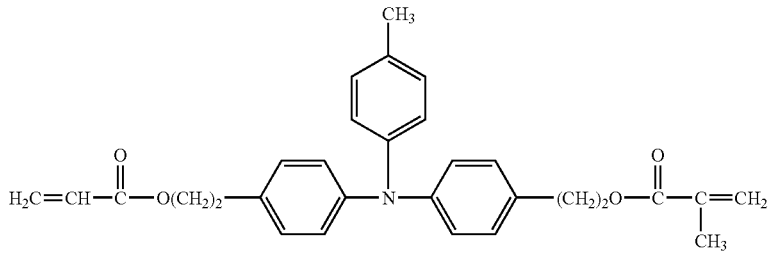 |
| 117 | 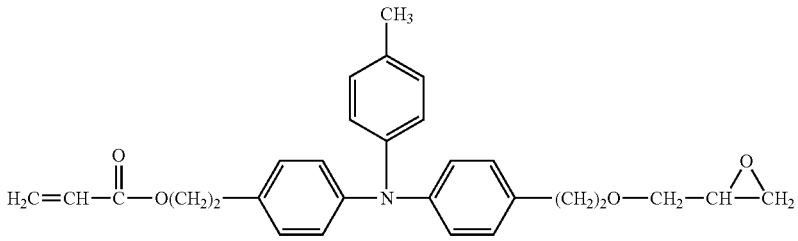 |
| 118 | 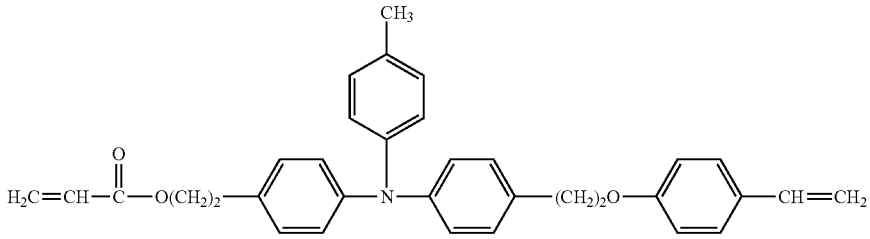 |
| 119 | 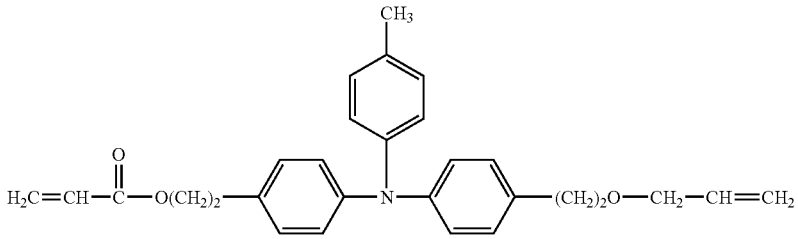 |

The electrophotographic photosensitive member of the present invention is described below in greater detail, inclusive of layers other than the surface layer.

As mentioned previously, the electrophotographic photosensitive member of the present invention is a cylindrical electrophotographic photosensitive member having a support (cylindrical support) and an organic photosensitive layer (hereinafter also simply "photosensitive layer") provided on the support (cylindrical support).

The photosensitive layer may be either a single-layer type photosensitive layer which contains a charge transporting material and a charge generating material in the same layer and a multi-layer type (function-separated type) photosensitive layer which is separated into a charge generation layer containing a charge generating material and a charge transport layer containing a charge transporting material. From the viewpoint of electrophotographic performance, the multi-layer type photosensitive layer is preferred. The multi-layer type photosensitive layer may also include a regular-layer type photosensitive layer in which the charge generation layer and the charge transport layer are superposed in this order from the support side and a reverse-layer type photosensitive layer in which the charge transport layer and the charge generation layer are superposed in this order from the support side. From the viewpoint of electrophotographic performance, the regular-layer type photosensitive layer is preferred. The charge generation layer may be constituted in a multiple layer, and the charge transport layer may also be constituted in a multiple layer.

Examples of the layer configuration of the electrophotographic photosensitive member of the present invention are shown in FIGS. 24A to 24I.

Figure 24A:
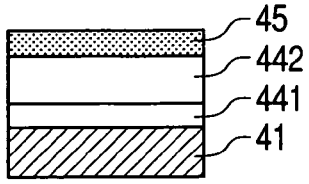
FIGS. 24A, 24B, 24C, 24D, 24E, 24F, 24G, 24H and 24I illustrate examples of the layer configuration of the electrophotographic photosensitive member of the present invention.

In the electrophotographic photosensitive member having layer configuration shown in FIG. 24A, a layer (charge generation layer) 441 containing a charge generating material and a layer (first charge transport layer) 442 containing a charge transporting material are provided in this order on a support 41, and further thereon a layer (second charge transport layer) 45 formed by polymerizing the hole transporting compound having a chain-polymerizing functional group is provided as the surface layer.

Figure 24B:
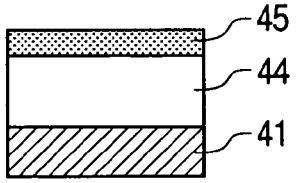

In the electrophotographic photosensitive member having layer configuration shown in FIG. 24B, a layer 44 containing a charge generating material and a charge transporting material is provided on a support 41, and further thereon a layer 45 formed by polymerizing the hole transporting compound having a chain-polymerizing functional group is provided as the surface layer.

Figure 24C:
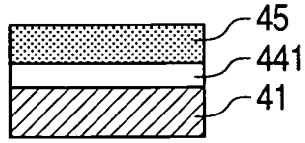

In the electrophotographic photosensitive member having layer configuration shown in FIG. 24C, a layer (charge generation layer) 441 containing a charge generating material is provided on a support 41, on which a layer 45 formed by polymerizing the hole transporting compound having a chain-polymerizing functional group is directly provided as the surface layer.

As shown in FIGS. 24D to 24I, an intermediate layer (also called "subbing layer")$_{43}$ having the function as a barrier and the function of adhesion or a conductive layer 42 intended for the prevention of interference fringes may also be provided between the support 41 and the layer (charge generation layer) 441 containing a charge generating material or the layer 44 containing a charge generating material and a charge transporting material.

Figure 24D:
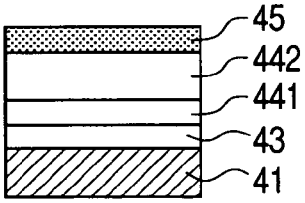
Figure 24E:
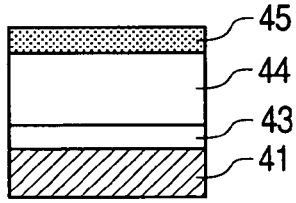
Figure 24F:
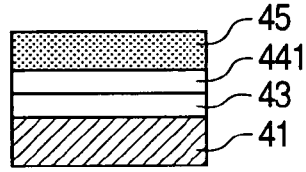
Figure 24G:
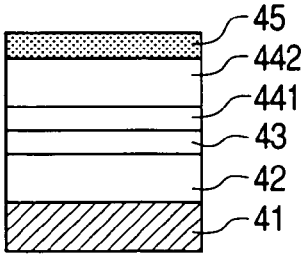
Figure 24H:
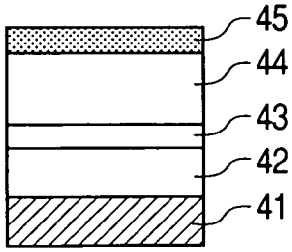
Figure 24I:
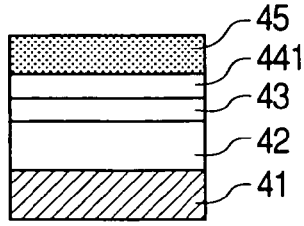

The electrophotographic photosensitive member of the present invention may have any layer configuration (e.g., the layer formed by polymerizing the hole transporting compound having a chain-polymerizing functional group need not be provided). Where the surface layer of the electrophotographic photosensitive member is the layer formed by polymerizing the hole transporting compound having a chain-polymerizing functional group, the layer configuration shown in FIGS. 24A, 24D or 24G is preferred among the layer configuration shown in FIGS. 24A to 24I.

As for the support, a material having conductivity will suffice for the support (conductive support). For example, supports made of the following are usable: a metal or an alloy such as iron, copper, gold, silver, aluminum, zinc, titanium, lead, nickel, tin, antimony, indium, chromium, aluminum alloy or stainless steel. It is possible to use also the above supports made of a metal or supports made of a plastic, and having layers formed by vacuum deposition of aluminum, aluminum alloy, indium oxide-tin oxide alloy or the like. It is possible to use still also supports comprising plastic or paper impregnated with conductive fine particles such as carbon black, tin oxide particles, titanium oxide particles or silver particles together with a suitable binder resin, and supports made of a plastic containing a conductive binder resin.

For the purpose of preventing interference fringes caused by scattering of laser light or the like, the surface of the support may be subjected to cutting, surface roughening or aluminum anodizing.

As mentioned previously, a conductive layer intended for the prevention of interference fringes caused by scattering of laser light or the like or for the covering of scratches of the support surface may be provided between the support and the photosensitive layer (charge generation layer or charge transport layer) and an intermediate layer described later.

The conductive layer may be formed using a conductive layer coating fluid prepared by dispersing and/or dissolving carbon black, a conductive pigment or a resistance control pigment in a binder resin. A compound capable of being cure-polymerized upon heating or irradiation with electron rays may be added to the conductive layer coating fluid. As to the conductive layer in which a conductive pigment or a resistance control pigment has been dispersed, its surface tends to be rough.

The conductive layer may preferably have a layer thickness of from 0.2 μm to 40 μm, more preferably from 1 μm to 35 μm, and still more preferably from 5 μm to 30 μm.

The binder resin used in the conductive layer may include, e.g., polymers or copolymers of vinyl compounds such as styrene, vinyl acetate, vinyl chloride, acrylate, methacrylate, vinylidene fluoride and trifluoroethylene, polyvinyl alcohol, polyvinyl acetal, polycarbonate, polyester, polysulfone, polyphenylene oxide, polyurethane, cellulose resins, phenol resins, melamine resins, silicon resins and epoxy resins.

The conductive pigment and the resistance control pigment may include, e.g., particles of metals (or alloys) such as aluminum, zinc, copper, chromium, nickel, silver and stainless steel, and plastic particles on the surface of which any of these metals have been vacuum-deposited. They may also be particles of metal oxides such as zinc oxide, titanium oxide, tin oxide, antimony oxide, indium oxide, bismuth oxide, indium oxide doped with tin, tin oxide doped with antimony or tantalum. Any of these may be used alone, or may be used in combination of two or more types. When used in combination of two or more types, they may simply be mixed, or may be made in the form of solid solution or fusion bonding.

As mentioned previously, an intermediate layer having a function as a barrier and a function of adhesion may also be provided between the support or the conductive layer and the photosensitive layer (the charge generation layer or the charge transport layer). The intermediate layer is formed for the purposes of, e.g., improving the adherence of the photosensitive layer, coating performance and the injection of electric charges from the support, and protecting the photosensitive layer from any electrical breakdown.

The intermediate layer may be formed using a material such as polyvinyl alcohol, poly-N-vinyl imidazole, polyethylene oxide, ethyl cellulose, an ethylene-acrylic acid copolymer, casein, polyamide, N-methoxymethylated nylon 6, copolymer nylons, glue and gelatin. The intermediate layer may be formed by coating an intermediate layer coating solution obtained by dissolving any of the above materials in a solvent, and drying the wet coating formed.

The intermediate layer may preferably be in a layer thickness of 0.05 μm to 1 μm, and further preferably from 0.1 μm to 2 μm.

The charge generating material used in the electrophotographic photosensitive member of the present invention may include, e.g., selenium-tellurium, pyrylium or thiapyrylium type dyes, phthalocyanine pigments having various central metals and various crystal types (such as α, β, γ, ϵ and X forms), anthanthrone pigments, dibenzpyrenequinone pigments, pyranthrone pigments, azo pigments such as monoazo, disazo and trisazo pigments, indigo pigments, quinacridone pigments, asymmetric quinocyanine pigments, quinocyanine pigments, and amorphous silicon. Any of these charge generating materials may be used alone, or may be used in combination of two or more.

The charge transporting material used in the electrophotographic photosensitive member of the present invention may include, besides the hole transporting compound having a chain-polymerizing functional group, e.g., pyrene compounds, N-alkylcarbazole compounds, hydrazone compounds, N,N-dialkylaniline compounds, diphenylamine compounds, triphenylamine compounds, triphenylmethane compounds, pyrazoline compounds, styryl compounds and stilbene compounds.

Where the photosensitive layer is functionally separated into a charge generation layer and a charge transport layer, the charge generation layer may be formed by applying a charge generation layer coating fluid prepared by dispersing the charge generating material together with a binder resin, which is used in a 0.3- to 4-fold quantity (weight ratio), and a solvent by means of a homogenizer, an ultrasonic dispersion machine, a ball mill, a vibration ball mill, a sand mill, an attritor or a roll mill, and drying the wet coating formed. The charge generation layer may also be a vacuum-deposited film of the charge generating material.

The binder resin used in the charge generation layer may include, e.g., polymers or copolymers of vinyl compounds such as styrene, vinyl acetate, vinyl chloride, acrylate, methacrylate, vinylidene fluoride and trifluoroethylene, polyvinyl alcohol, polyvinyl acetal, polycarbonate, polyester, polysulfone, polyphenylene oxide, polyurethane, cellulose resins, phenol resins, melamine resins, silicon resins and epoxy resins.

The charge generation layer may preferably be in a layer thickness of 5 μm or less, and further preferably from 0.1 μm to 2 μm.

Where the photosensitive layer is functionally separated into a charge generation layer and a charge transport layer, the charge transport layer, in particular, a charge transport layer which is not the surface layer of the electrophotographic photosensitive member, may be formed by applying a charge transport layer coating solution prepared by dissolving the charge transporting material and a binder resin in a solvent, and drying the wet coating formed. Also, of the above charge transporting materials, one having film forming properties in itself may be used singly without using any binder resin to form the charge transport layer.

Methods for forming the respective layers of the electrophotographic photosensitive member of the present invention may include dip coating, spray coating, curtain coating and spin coating. From the viewpoint of efficiency and productivity, dip coating and spray coating are preferred. Vacuum deposition, plasma or other film forming processes may also be selected.

Various additives may be added to the respective layers of the electrophotographic photosensitive member of the present invention. Such additives may include deterioration preventive agents such as antioxidants and ultraviolet absorbers, and lubricants such as fluorine-atom-containing resin particles.

Figure 18:
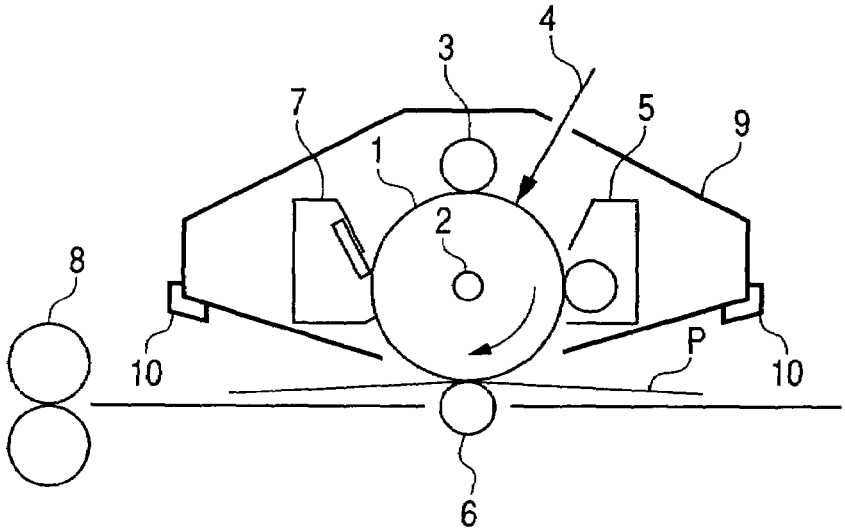
FIG. 18 illustrates an example of the schematic construction of an electrophotographic apparatus provided with a process cartridge having the electrophotographic photosensitive member of the present invention.

An example of the outline of the construction of an electrophotographic apparatus provided with a process cartridge having the electrophotographic photosensitive member of the present invention is shown in FIG. 18.

In FIG. 18, reference numeral 1 denotes a cylindrical electrophotographic photosensitive member, which is rotatively driven around an axis 2 in the direction of an arrow at a stated peripheral speed.

The surface of the electrophotographic photosensitive member 1 rotatively driven is uniformly electrostatically charged to a positive or negative, given potential through a charging means (primary charging means such as a charging roller) 3. The electrophotographic photosensitive member thus charged is then exposed to exposure light (imagewise exposure light) 4 emitted from an exposure means (not shown) for slit exposure, laser beam scanning exposure or the like. In this way, electrostatic latent images corresponding to the intended image are successively formed on the peripheral surface of the electrophotographic photosensitive member 1. In addition, the charging means 3 is not limited to a contact charging means making use of the charging roller as shown in FIG. 18, and may be a corona charging means making use of a corona charging assembly, or may be a charging means of any other system.

The electrostatic latent images thus formed on the peripheral surface of the electrophotographic photosensitive member 1 are developed with a toner contained in a developer a developing means 5 has, to form toner images. Then, the toner images thus formed and held on the peripheral surface of the electrophotographic photosensitive member 1 are successively transferred by applying a transfer bias from a transfer means (such as a transfer roller) 6, which are successively transferred on to a transfer material (such as paper) P fed from a transfer material feed means (not shown) to the part (contact zone) between the electrophotographic photosensitive member 1 and the transfer means 6 in such a manner as synchronized with the rotation of the electrophotographic photosensitive member 1.

The transfer material P to which the toner images have been transferred is separated from the peripheral surface of the electrophotographic photosensitive member 1 and is led to a fixing means 8, where the toner images are fixed, then is put out of the apparatus as an image-formed material (a print or a copy).

The peripheral surface of the electrophotographic photosensitive member 1 from which toner images have been transferred is brought to removal of the developer (toner) remaining after the transfer, through a cleaning means (such as a cleaning blade) 7. Thus, its surface is cleaned. It is further subjected to charge elimination by pre-exposure light (not shown) emitted from a pre-exposure means (not shown), and thereafter repeatedly used for the formation of images. In addition, where as shown in FIG. 18 the charging means 3 is the contact charging means making use of a charging roller or the like, the pre-exposure is not necessarily required.

The apparatus may be constituted of a combination of plural components integrally joined in a container as a process cartridge from among the constituents such as in the above electrophotographic photosensitive member 1, charging means 3, developing means 5, transfer means 6 and cleaning means 7 so that the process cartridge is set detachably mountable to the main body of an electrophotographic apparatus such as a copying machine or a laser beam printer. In the apparatus shown in FIG. 18, the electrophotographic photosensitive member 1 and the charging means 3, developing means 5 and cleaning means 7 are integrally supported to form a cartridge which is to be set up as a process cartridge 9 detachably mountable to the main body of the electrophotographic apparatus through a guide means 10 such as rails provided in the main body of the electrophotographic apparatus.

Where the cleaning means is a means for removing the transfer residual toner from the peripheral surface of the electrophotographic photosensitive member by means of the cleaning blade, from the viewpoint of cleaning performance, the contact pressure (linear pressure) of the cleaning blade against the peripheral surface of the electrophotographic photosensitive member may preferably be in the range of from 10 to 45 g/cm, and also the contact angle of the cleaning blade may preferably be in the range of from 20 to 30 degrees.

EXAMPLES

The present invention is described below in greater detail by giving specific working examples. In the following Examples, "part(s)" is meant to be "part(s) by weight".

Example 1-1

An aluminum cylinder of 30 mm in diameter and 357.5 mm in length was used as a support (cylindrical support).

Then, the support was dip-coated with a conductive layer coating fluid composed of 10 parts of $SnO_2$-coated barium sulfate (conductive particles), 2 parts of titanium oxide (a resistance controlling pigment), 6 parts of phenol resin (a binder resin), 0.001 part of silicone oil (a leveling agent), 3 parts of methanol and 12 parts of methoxypropanol, followed by curing (heat curing) at 140° C. for 30 minutes to form a conductive layer with a layer thickness of 18 μm.

Next, 3 parts of N-methoxymethylated nylon and 3 parts of copolymer nylon were dissolved in a mixed solvent of 65 parts of methanol and 30 parts of n-butanol to prepare an intermediate layer coating solution.

This intermediate layer coating solution was applied by dip-coating on the conductive layer, followed by drying at 100° C. for 10 minutes to form an intermediate layer with a layer thickness of 0.7 μm.

Next, 4 parts of hydroxygallium phthalocyanine having strong peaks at Bragg angles of 2θ±0.2° of 7.4° and 28.2° in CuKα characteristics X-ray diffraction, 2 parts of polyvinyl butyral resin (trade name: S-LEC BX-1, available from Sekisui Chemical Co., Ltd.) and 80 parts of cyclohexanone were subjected to dispersion for 4 hours by means of a sand mill making use of glass beads of 1 mm in diameter, and then 80 parts of ethyl acetate was added to prepare a charge generation layer coating fluid.

This charge generation layer coating fluid was applied by dip-coating on the intermediate layer, followed by drying at 100° C. for 10 minutes to form a charge generation layer with a layer thickness of 0.2 μm.

Next, 60 parts of a hole transporting compound having a structure represented by the following formula (11):

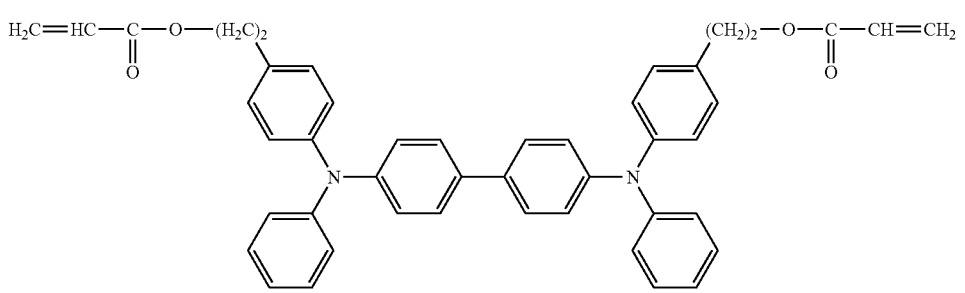

(11)

was dissolved in a mixed solvent of 65 parts of monochlorobenzene and 30 parts of dichloromethane to prepare a charge transport layer coating solution.

This charge transport layer coating solution was applied by dip-coating on the charge generation layer.

Next, in an atmosphere of nitrogen (oxygen concentration: 80 ppm), the charge transport layer coating solution applied (a wet coating) on the charge generation layer was irradiated with electron rays under conditions of an accelerating voltage of 150 kV and a dose of 5 Mrad ($5\times10^4$ Gy), and thereafter subjected to heat treatment for 3 minutes under conditions that the temperature of the irradiation object (electrophotographic photosensitive member) came to be 150° C. Further, this irradiation object was subjected to heat treatment (post-treatment) at 140° C. for 1 hour in the air. Thus, a charge transport layer with a layer thickness of 13 μm was formed.

Next, using an abrasive sheet AX-3000 (abrasive grains: alumina particles of 5 μm in average particle diameter; substrate: polyester film of 75 μm in thickness; count: 3000) available from Fuji Photo Film Co., Ltd., the peripheral surface of the abrading object (in this Example, such that the conductive layer, the intermediate layer, the charge generation layer and the charge transport layer were formed on the support) was subjected to abrading for 450 seconds, setting the feed speed of the abrasive sheet to be 150 mm/min., setting the number of revolutions of the abrading object to be 15 rpm, setting the pressure to press the abrasive sheet against the abrading object to be 7.5 $N/m^2$, setting the feed direction of the abrasive sheet and the rotational direction of the abrading object to be the same direction (hereinafter also called "with"; the opposite direction is also called "counter"), and using a back-up roller of 40 cm in outer diameter and 40 in Asker-C hardness. Thus, grooves were formed on the peripheral surface of the abrading object (in this Example, the surface of the charge transport layer) in its peripheral direction.

In this way, an electrophotographic photosensitive member was produced which had the cylindrical support and the organic photosensitive layer (charge generation layer and charge transport layer) provided on the cylindrical support, and on the peripheral surface of which the grooves were formed substantially in its peripheral direction (the direction of the grooves was approximately as shown in FIG. 5A).

The peripheral-surface shape of the electrophotographic photosensitive member thus produced was observed and measured to find that the groove density was 300, the groove width was 4.8 μm at the maximum, Rz was 0.51 μm and Rmax was 0.60 μm, and also that ΣWn was 510 μm, and the average angle of the groove was 0 degree with respect to the peripheral direction.

The electrophotographic photosensitive member thus produced was mounted to a copying machine GP40, manufactured by CANON INC., to make evaluation in an environment of 22° C./55% RH. In regard to potential characteristics of the electrophotographic photosensitive member, the developing unit was detached from the main body of the copying machine, and instead a potential measuring probe was set at the position of the developing unit to make measurement. In addition, in the measurement, the transfer unit was kept in non-contact with the electrophotographic photosensitive member, and no paper was fed (paper non-feed).

Initial-stage electrophotographic characteristics [dark-area potential Vd, optical-attenuation sensitivity (the amount of light necessary for effecting optical attenuation to −150 V, of dark-area potential set to be −650 V), and residual potential Vsl (the potential at the time the light was applied in an amount of light 3 times as much as the amount of light for the optical-attenuation sensitivity)] were measured, and thereafter a 100,000-sheet paper feed running (extensive operation) test was conducted to ascertain whether or not any defects came about in images reproduced. Also, the abrasion amount of the peripheral surface of the electrophotographic photosensitive member after the paper feed running test was measured as actual-use abrasion amount. In addition, the actual-use abrasion amount was calculated as the difference between the layer thickness of the surface layer at the initial stage (before the paper feed running test) and the layer thickness of the surface layer after the paper feed running test, using an eddy-current layer thickness meter manufactured by Karl Fischer GmbH. Also, the paper feed running test was conducted in an intermittent mode in which the machine was stopped once for each sheet of print. The photosensitive member and the cleaning blade ware observed in the following way.

Observation of deep scratches of peripheral surface of electrophotographic photosensitive member, after paper feed running test:

A: Neither deep scratch nor slight scratch is seen.

B: A few lines of slight scratches not appearing on images are seen.

C: A few lines of somewhat deep scratches not appearing on images are seen.

D: Deep scratches appearing on images are seen.

Observation of toner melt adhesion to peripheral surface of electrophotographic photosensitive member, after paper feed running test:

A: No melt adhesion is seen.

B: Melt adhesion not appearing on images is seen at a few spots.

C: Melt adhesion not appearing on images is seen at ten or more spots.

D: Melt adhesion appearing on images is seen.

Observation of toner migrating to air face (the back) of cleaning blade, after paper feed running test:

A: No toner migrating to the back is seen.

B: Toner migrating to the back is seen in small quantity in the direction of blade thrust.

C: Toner migrating to the back is seen in the whole direction of blade thrust.

D: Toner migrating to the back is seen in a large quantity.

The ten-point average surface roughness (Rz) and maximum surface roughness (Rmax) of the peripheral surface of the electrophotographic photosensitive member were also measured after the paper feed running test.

An electrophotographic photosensitive member for making evaluation on the deposition thickness of abrasion dust deposited on the air face of a blade made of polyurethane resin (i.e., an electrophotographic photosensitive member for measurement of deposition thickness) was also produced in the same manner as in the above, and the deposition thickness was measured.

An electrophotographic photosensitive member for making measurement of the universal hardness value (HU) and modulus of elastic deformation (We %) was still also produced in the same manner as in the above, and the universal hardness value (HU) and modulus of elastic deformation of the surface of the surface layer (in this Example, the charge transport layer) before and after the surface roughening step (abrading step) were measured.

The results of measurement and the results of evaluation are shown in Tables 1 to 3.

Example 1-2

An electrophotographic photosensitive member was produced in the same manner as in Example 1-1 except that, in Example 1-1, the dose 5 Mrad ($5\times10^4$ Gy) at which the charge transport layer coating solution applied (a wet coating) on the charge generation layer was irradiated with electron rays was changed to 1.5 Mrad ($1.5\times10^4$ Gy).

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

Compared with Example 1-1, the initial-stage electrophotographic characteristics were somewhat improved, but resulting in somewhat low running performance.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 1 to 3.

Example 1-3

The procedure in Example 1-1 was repeated to form the conductive layer, the intermediate layer and the charge generation layer on the support.

Next, 7 parts of a styryl compound having a structure represented by the following formula (12):

(12)

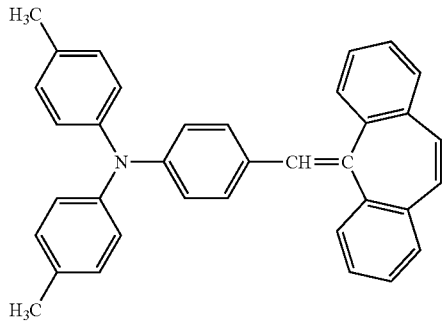

and 10 parts of a polycarbonate resin (trade name: IUPILON Z-800; available from Mitsubishi Engineering-Plastics Corporation) were dissolved in 80 parts of a mixed solvent of 105 parts of monochlorobenzene and 35 parts of dichloromethane to prepare a first charge transport layer coating solution.

This first charge transport layer coating solution was applied by dip-coating on the charge generation layer, followed by drying at 120° C. for 60 minutes to form a first charge transport layer with a layer thickness of 10 μm.

Next, 45 parts of a hole transporting compound having a structure represented by the following formula (13):

(13)

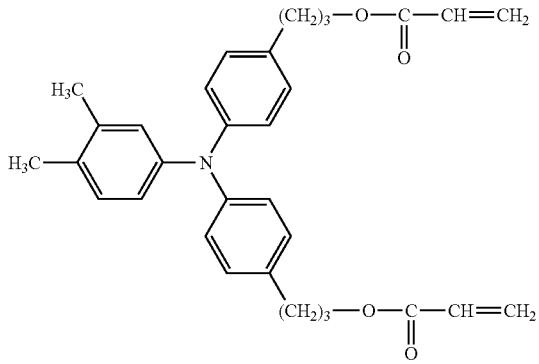

was dissolved in 55 parts of n-isopropanol to prepare a second charge transport layer coating solution.

This second charge transport layer coating solution was applied by dip-coating on the first charge transport layer.

Next, in an atmosphere of nitrogen (oxygen concentration: 80 ppm), the second charge transport layer coating solution applied on the first charge transport layer was irradiated with electron rays under conditions of an accelerating voltage of 150 kV and a dose of 1.5 Mrad ($1.5\times10^4$ Gy), and thereafter subjected to heat treatment for 3 minutes under conditions that the temperature of the irradiation object (electrophotographic photosensitive member) came to be 150° C. Further, this irradiation object was subjected to heat treatment (post-treatment) at 140° C. for 1 hour in the air. Thus, a second charge transport layer with a layer thickness of 5 μm was formed.

Next, using an abrasive sheet C-2000 (abrasive grains: Si—C particles of 9 μm in average particle diameter; substrate: polyester film of 75 μm in thickness) available from Fuji Photo Film Co., Ltd., the peripheral surface of the abrading object (in this Example, one in which the conductive layer, the intermediate layer, the charge generation layer, the first charge transport layer and the second charge transport layer were formed on the support) was subjected to abrading for 150 seconds, setting the feed speed of the abrasive sheet to 200 mm/min., setting the number of revolutions of the abrading object to be 25 rpm, setting the pressure to press the abrasive sheet against the abrading object to be 3 N/m$^2$, setting the feed direction of the abrasive sheet to "counter", and using a back-up roller of 40 cm in outer diameter and 40 in Asker-C hardness. Thus, grooves were formed on the peripheral surface of the abrading object in its peripheral direction.

In this way, an electrophotographic photosensitive member was produced which had the cylindrical support and the organic photosensitive layer provided on the cylindrical support, and on the peripheral surface of which the grooves were formed substantially in its peripheral direction (the direction of the grooves was approximately as shown in FIG. 5A).

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation (We %) was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 1 to 3.

Example 1-4

An electrophotographic photosensitive member was produced in the same manner as in Example 1-3 except that, in Example 1-3, the hole transporting compound having the structure represented by the above formula (13), used in the second charge transport layer coating solution, was changed to a hole transporting compound having a structure represented by the following formula (14).

(14)

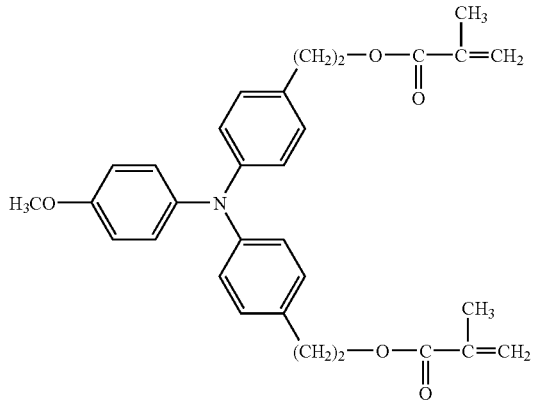

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 1 to 3.

Example 1-5

An electrophotographic photosensitive member was produced in the same manner as in Example 1-3 except that, in Example 1-3, the hole transporting compound having the structure represented by the above formula (13), used in the second charge transport layer coating solution, was changed for a hole transporting compound having a structure represented by the following formula (15):

(15)

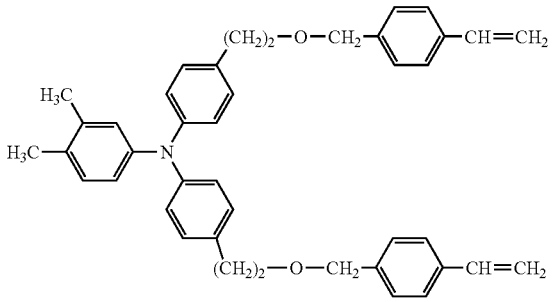

and that the n-propanol used in the second charge transport layer coating solution was changed to cyclohexane.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 1 to 3.

Example 1-6

An electrophotographic photosensitive member was produced in the same manner as in Example 1-3 except that, in Example 1-3, the hole transporting compound having the structure represented by the above formula (13), used in the second charge transport layer coating solution, was changed to a hole transporting compound having a structure represented by the following formula (16):

(16)

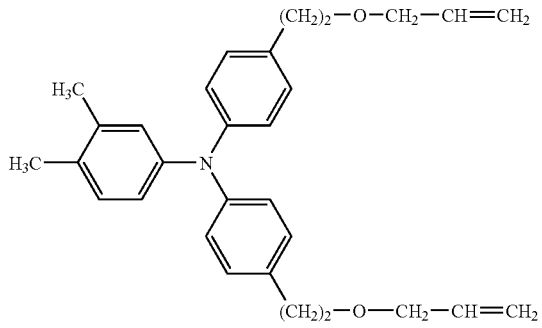

and that the n-propanol used in the second charge transport layer coating solution was changed to cyclohexane.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 1 to 3.

Example 1-7

The procedure in Example 1-3 was repeated to form the conductive layer, the intermediate layer and the charge generation layer on the support. Also, the same layer as the first charge transport layer in Example 1-3 was formed as a charge transport layer on the charge generation layer.

Next, 50 parts of fine antimony-doped tin oxide particles having been treated (amount of treatment: 7%) with 3,3,3-trifluoropropyltrimethoxysilane (trade name: LS1090; available from Shin-Etsu Chemical Co., Ltd.), 30 parts of an acrylic monomer having a structure represented by the following formula (17) and having no hole transporting ability:

(17)

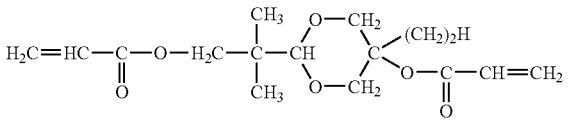

and 150 parts of ethanol were subjected to dispersion for 70 hours by means of a sand mill to prepare a protective layer coating fluid.

This protective layer coating fluid was applied by dip-coating on the charge transport layer.

Next, in an atmosphere of nitrogen (oxygen concentration: 80 ppm), the protective layer coating solution coated on the charge transport layer was irradiated with electron rays under conditions of an accelerating voltage of 150 kV and a dose of 1.5 Mrad ($1.5\times10^4$ Gy), and thereafter subjected to heat treatment for 3 minutes under conditions that the temperature of the irradiation object (electrophotographic photosensitive member) came to be 150° C. Further, this irradiation object was subjected to heat treatment (post-treatment) at 140° C. for 1 hour in the air. Thus, a protective layer with a layer thickness of 4 μm was formed.

Next, the procedure in Example 1-3 was repeated to subject the peripheral surface (in this Example, the surface of the protective layer) of the abrading object (in this Example, one in which the conductive layer, the intermediate layer, the charge generation layer, the charge transport layer and the protective layer were formed on the support) to abrading. Thus, grooves were formed on the peripheral surface of the abrading object in its peripheral direction.

In this way, an electrophotographic photosensitive member was produced which had the cylindrical support and the organic photosensitive layer provided on the cylindrical support, and on the peripheral surface of which the grooves were formed substantially in its peripheral direction.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the protective layer) were measured.

The results of measurement and results of evaluation in the foregoing are shown in Tables 1 to 3.

Example 1-8

An electrophotographic photosensitive member was produced in the same manner as in Example 1-3 except that, in Example 1-3, 5 parts of polytetrafluoroethylene particles were further added to the second charge transport layer coating solution.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 1 to 3.

Example 1-9

An electrophotographic photosensitive member was produced in the same manner as in Example 1-8 except that, in Example 1-8, the amount 5 parts in which the polytetrafluoroethylene particles was used was changed to 20 parts.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 1 to 3.

Example 1-10

An electrophotographic photosensitive member was produced in the same manner as in Example 1-8 except that, in Example 1-8, the amount of the polytetrafluoroethylene particles was changed from 5 parts to 30 parts.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 1 to 3.

Example 1-11

An electrophotographic photosensitive member was produced in the same manner as in Example 1-8 except that, in Example 1-8, the amount of the polytetrafluoroethylene particles was changed from 5 parts to 45 parts.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 1 to 3.

Example 1-12

An electrophotographic photosensitive member was produced in the same manner as in Example 1-3 except that, in Example 1-3, 5 parts of a polymerization initiator having a structure represented by the following formula (18):

(18)

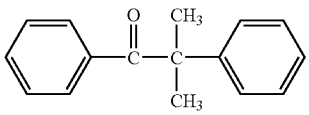

was further added to the second charge transport layer coating solution and that, in place of the irradiation with electron rays, the second charge transport layer coating solution applied on the first charge transport layer was irradiated with light of 500 mW/cm$^2$ in intensity for 60 seconds to effect curing (light curing).

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 1 to 3.

Example 1-13

An electrophotographic photosensitive member was produced in the same manner as in Example 1-3 except that, in Example 1-3, the hole transporting compound having the structure represented by the above formula (13), used in the second charge transport layer coating solution, was changed to a hole transporting hydroxymethyl-group-containing phenol compound having a structure represented by the following formula (19):

(19)

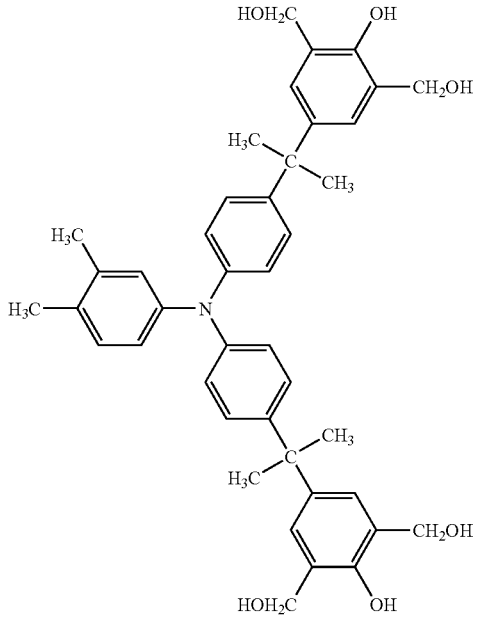

and that, in place of the irradiation with electron rays, the second charge transport layer coating solution coated on the first charge transport layer was heated at 145° C. for 1 hour to effect curing (heat curing).

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 1 to 3.

Example 1-14

The procedure in Example 1-3 was repeated to form the conductive layer, the intermediate layer, the charge generation layer and the first charge transport layer on the support.

Next, 10 parts of a hole transporting compound having a structure represented by the following formula (20):

(20)

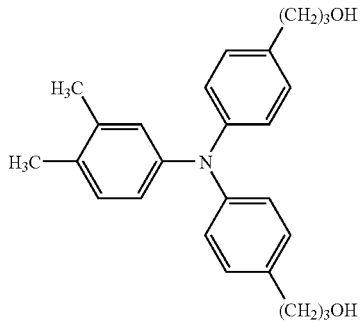

was added to 10 parts of 2-propanol, and also a heat-curable silicone resin (trade name: TOSGUARD 510, available from Toshiba Silicone Co., Ltd.) composed chiefly of a hydrolytic condensation product of a trialkoxysilane with a tetraalkoxysilane was so added that the non-volatile component of the binder resin was 13 parts. These were dissolved in 2-propanol to prepare a second charge transport layer coating solution (which was so prepared that the solid content of the whole coating solution was 30% by weight).

This second charge transport layer coating solution was applied by dip-coating on the first charge transport layer, followed by curing (heat curing) at 130° C. for 60 minutes. Thus, a second charge transport layer with a layer thickness of 5 μm was formed.

Next, the procedure in Example 1-3 was repeated to subject the peripheral surface (in this Example, the surface of the second charge transport layer) of the abrading object (in this Example, the one in which the conductive layer, the intermediate layer, the charge generation layer, the first charge transport layer and the second charge transport layer were formed on the support) to abrading. Thus, grooves were formed on the peripheral surface of the abrading object in its peripheral direction.

In this way, an electrophotographic photosensitive member was produced which had the cylindrical support and the organic photosensitive layer provided on the cylindrical support, and on the peripheral surface of which the grooves were formed substantially in its peripheral direction.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 1 to 3.

Example 1-15

The procedure in Example 1-1 was repeated to form the conductive layer, the intermediate layer and the charge generation layer on the support.

Next, 30 parts of the styryl compound having the structure represented by the above formula (12), 50 parts of a copolymer type polyarylate resin having a repeating structural unit represented by the following formula (21a) and a repeating structural unit represented by the following formula (21b) (copolymerization ratio (21a):(21b)=7:3; weight average molecular weight: 130,000; the phthalic acid skeletons of (21a) and (21b) are each tere:iso=1:1):

(21a)

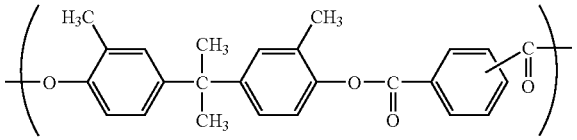

(21b)

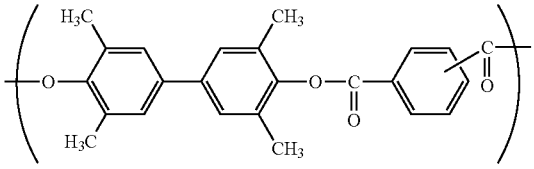

were dissolved in a mixed solvent of 350 parts of monochlorobenzene and 50 parts of dimethoxymethane to prepare a charge transport layer coating solution.

This charge transport layer coating solution was applied by dip-coating on the charge generation layer, followed by drying for 60 minutes in a hot-air dryer controlled to 120° C. Thus, a charge transport layer with a layer thickness of 25 μm was formed.

Next, the procedure in Example 1–3 was repeated to subject the peripheral surface (in this Example, the surface of the charge transport layer) of the abrading object (in this Example, the one in which the conductive layer, the intermediate layer, the charge generation layer, the charge transport layer and the charge transport layer were formed on the support) to abrading. Thus, grooves were formed on the peripheral surface of the abrading object in its peripheral direction.

In this way, an electrophotographic photosensitive member was produced which had the cylindrical support and the organic photosensitive layer provided on the cylindrical support, and on the peripheral surface of which the grooves were formed substantially in its peripheral direction.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 1 to 3.

Example 1-16

An electrophotographic photosensitive member was produced in the same manner as in Example 1-8 except that, in Example 1-8, the accelerating voltage of electron rays with which the second charge transport layer coating solution applied on the first charge transport layer was irradiated was changed from 150 kV to 80 kV, that the conditions "for 3 minutes under conditions that the temperature of the irradiation object came to be 150° C." under which the heat treatment was subsequently carried out after the irradiation with electron rays were changed to "for 90 seconds under conditions that the temperature of the irradiation object came to be 130° C." and that the oxygen concentration of the atmosphere of nitrogen was changed from 80 ppm to 10 ppm.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 1 to 3.

Example 1-17

An electrophotographic photosensitive member was produced in the same manner as in Example 1-8 except that, in Example 1-8, the conditions "for 3 minutes under conditions that the temperature of the irradiation object came to 150° C." under which the heat treatment was subsequently carried out after the irradiation with electron rays with which the second charge transport layer coating solution applied on the first charge transport layer was irradiated were changed to "for 3 minutes under conditions that the temperature of the irradiation object came to 140° C." and that the oxygen concentration of the atmosphere of nitrogen was changed from 80 ppm to 200 ppm.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 1 to 3.

Example 1-18

An electrophotographic photosensitive member was produced in the same manner as in Example 1-8 except that, in Example 1-8, the dose of electron rays with which the second charge transport layer coating solution applied on the first charge transport layer was irradiated with electron rays was changed from 1.5 Mrad ($1.5\times10^4$ Gy) to 0.5 Mrad ($5\times10^3$ Gy), that the conditions "for 3 minutes under conditions that the temperature of the irradiation object came to be 150° C." under which the heat treatment was subsequently carried out after the irradiation with electron rays were changed to "for 3 minutes under conditions that the temperature of the irradiation object came to be 140° C." and that the oxygen concentration of the atmosphere of nitrogen had was changed from 80 ppm to 150 ppm.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 1 to 3.

Example 1-19

The procedure in Example 1-3 was repeated to form the conductive layer, the intermediate layer, the charge generation layer and the first charge transport layer on the support.

Next, 50 parts of non-conductive fine tin oxide particles, 30 parts of the hole transporting compound having the structure represented by the above formula (13) and 150 parts of ethanol were subjected to dispersion for 70 hours by means of a sand mill to prepare a second charge transport layer coating fluid.

This second charge transport layer coating fluid was applied by dip-coating on the first charge transport layer.

Next, in an atmosphere of nitrogen (oxygen concentration: 80 ppm), the second charge transport layer coating solution coated (a wet coating) on the first charge transport layer was irradiated with electron rays under conditions of an accelerating voltage of 150 kV and a dose of 1.5 Mrad ($1.5\times10^4$ Gy), and thereafter subjected to heat treatment for 3 minutes under conditions that the temperature of the irradiation object (electrophotographic photosensitive member) came to be 150° C. Further, this irradiation object was subjected to heat treatment (post-treatment) at 140° C. for 1 hour in the air. Thus, a second charge transport layer with a layer thickness of 4 μm was formed.

Next, the procedure in Example 1-3 was repeated to subject the peripheral surface of the abrading object to abrading. Thus, grooves were formed on the peripheral surface of the abrading object in its peripheral direction.

In this way, an electrophotographic photosensitive member was produced which had the cylindrical support and the organic photosensitive layer provided on the cylindrical support, and on the peripheral surface of which the grooves were formed in plurality substantially in its peripheral direction.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 1 to 3.

Example 1-20

An electrophotographic photosensitive member was produced in the same manner as in Example 1-3 except that, in Example 1-3, the amount 45 parts in which the hole transporting compound having the structure represented by the above formula (13) was used in the second charge transport layer coating solution was changed to 30 parts, that 15 parts of an acrylic monomer having a structure represented by the following formula (22):

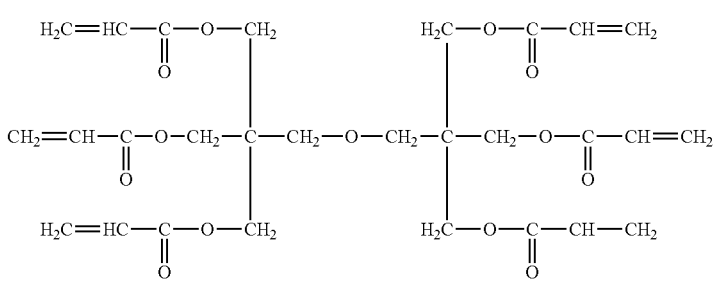

(22)

was added and that the pressure 3 $N/m^2$ at which the abrasive sheet was pressed against the abrading object in abrading the peripheral surface of the abrading object was changed to 5 $N/m^2$.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 1 to 3.

Example 1-21

An electrophotographic photosensitive member was produced in the same manner as in Example 1-2 except that, in Example 1-2, the time 450 seconds for which the peripheral surface of the abrading object was abraded was changed to 300 seconds.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 1 to 3.

Example 1-22

An electrophotographic photosensitive member was produced in the same manner as in Example 1-2 except that, in Example 1-2, the time 450 seconds for which the peripheral surface of the abrading object was abraded was changed to 120 seconds.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 1 to 3.

Example 1-23

An electrophotographic photosensitive member was produced in the same manner as in Example 1-2 except that, in Example 1-2, the time 450 seconds for which the peripheral surface of the abrading object was abraded was changed to 18 minutes.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 1 to 3.

Example 1-24

An electrophotographic photosensitive member was produced in the same manner as in Example 1-2 except that, in Example 1-2, the time 450 seconds for which the peripheral surface of the abrading object was sanded was changed to 20 minutes.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 1 to 3.

Example 1-25

An electrophotographic photosensitive member was produced in the same manner as in Example 1-2 except that, in Example 1-2, the pressure 7.5 $N/m^2$ at which the abrasive sheet was pressed against the abrading object in abrading the peripheral surface of the abrading object was changed to 6 $N/m^2$ and that the time 450 seconds for which the peripheral surface of the abrading object was abraded was changed to 100 seconds.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 1 to 3.

Example 1-26

An electrophotographic photosensitive member was produced in the same manner as in Example 1-2 except that, in Example 1-2, the pressure 7.5 $N/m^2$ at which the abrasive sheet was pressed against the abrading object in abrading the peripheral surface of the abrading object was changed to 8.5 $N/m^2$ and that the time 450 seconds for which the peripheral surface of the abrading object was abraded was changed to 60 seconds.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 1 to 3.

Example 1-27

An electrophotographic photosensitive member was produced in the same manner as in Example 1-9 except that, in Example 1-9, the back-up roller of 40 cm in outer diameter and 40 in Asker-C hardness which was used in abrading the peripheral surface of the abrading object was changed to a back-up roller of 40 cm in outer diameter and 30 in Asker-C hardness and that the pressure 3 $N/m^2$ at which the abrasive sheet was pressed against the abrading object was changed to 7 $N/m^2$.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 1 to 3.

Example 1-28

An electrophotographic photosensitive member was produced in the same manner as in Example 1-9 except that, in Example 1-9, the back-up roller of 40 cm in outer diameter and 40 in Asker-C hardness which was used in abrading the peripheral surface of the abrading object was changed to a back-up roller of 40 cm in outer diameter and 20 in Asker-C hardness and that the pressure 3 $N/m^2$ at which the abrasive sheet was pressed against the abrading object was changed to 11 $N/m^2$.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 1 to 3.

Example 1-29

An electrophotographic photosensitive member was produced in the same manner as in Example 1-2 except that, in Example 1-2, the back-up roller of 40 cm in outer diameter and 40 in Asker-C hardness which was used in abrading the peripheral surface of the abrading object was changed to a back-up roller of 80 mm in outer diameter and 45 in Shore-A hardness.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 1 to 3.

Example 1-30

An electrophotographic photosensitive member was produced in the same manner as in Example 1-29 except that, in Example 1-29, the back-up roller of 80 mm in outer diameter and 45 in Shore-A hardness which was used in abrading the peripheral surface of the abrading object was changed to a back-up roller of 80 mm in outer diameter and 25 in Shore-A hardness and that the pressure 7.5 $N/m^2$ at which the abrasive sheet was pressed against the abrading object was changed to 10 $N/m^2$.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 1 to 3.

Example 1-31

An electrophotographic photosensitive member was produced in the same manner as in Example 1-29 except that, in Example 1-29, the back-up roller of 80 mm in outer diameter and 45 in Shore-A hardness which was used in abrading the peripheral surface of the abrading object was changed to a back-up roller of 80 mm in outer diameter and 10 in Shore-A hardness and that the pressure 7.5 $N/m^2$ at which the abrasive sheet was pressed against the abrading object was changed to 13.2 $N/m^2$.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 1 to 3.

Example 1-32

An electrophotographic photosensitive member was produced in the same manner as in Example 1-29 except that, in Example 1-29, the back-up roller of 80 mm in outer diameter and 45 in Shore-A hardness which was used in abrading the peripheral surface of the abrading object was changed to a back-up roller of 80 mm in outer diameter and 65 in Shore-A hardness and that the pressure 7.5 $N/m^2$ at which the abrasive sheet was pressed against the abrading object was changed to 5.2 $N/m^2$.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 1 to 3.

TABLE 1

| Example: | Groove density | Groove width (max) (μm) | Rz (μm) | Rmax (μm) | Rmax − Rz (μm) | ΣWn | Groove average angle (E) |
|---|---|---|---|---|---|---|---|
| 1-1 | 300 | 4.8 | 0.51 | 0.60 | 0.09 | 510 | 0 |
| 1-2 | 330 | 5.8 | 0.55 | 0.66 | 0.11 | 600 | 0 |
| 1-3 | 420 | 10.4 | 0.62 | 0.83 | 0.21 | 480 | 0 |
| 1-4 | 440 | 10.8 | 0.62 | 0.83 | 0.21 | 520 | 0 |
| 1-5 | 500 | 12.1 | 0.71 | 0.95 | 0.24 | 640 | 0 |
| 1-6 | 560 | 13.2 | 0.75 | 0.98 | 0.23 | 730 | 0 |
| 1-7 | 620 | 16.8 | 0.88 | 1.01 | 0.13 | 780 | 0 |
| 1-8 | 350 | 9.5 | 0.60 | 0.69 | 0.09 | 600 | 0 |
| 1-9 | 500 | 11.2 | 0.69 | 0.81 | 0.12 | 630 | 0 |
| 1-10 | 680 | 13.7 | 0.77 | 0.95 | 0.18 | 700 | 0 |
| 1-11 | 750 | 15.3 | 0.86 | 1.00 | 0.14 | 780 | 0 |
| 1-12 | 440 | 11.5 | 0.68 | 0.92 | 0.24 | 490 | 0 |
| 1-13 | 300 | 6.1 | 0.52 | 0.61 | 0.09 | 520 | 0 |
| 1-14 | 320 | 6.3 | 0.63 | 0.72 | 0.09 | 590 | 0 |
| 1-15 | 700 | 18.5 | 1.30 | 1.50 | 0.20 | 800 | 0 |
| 1-16 | 330 | 9.5 | 0.50 | 0.58 | 0.08 | 650 | 0 |
| 1-17 | 500 | 11.2 | 0.80 | 0.92 | 0.12 | 680 | 0 |
| 1-18 | 820 | 15.8 | 1.10 | 1.25 | 0.15 | 700 | 0 |
| 1-19 | 750 | 21.2 | 0.93 | 1.21 | 0.27 | 750 | 0 |
| 1-20 | 450 | 12.5 | 0.55 | 0.58 | 0.03 | 550 | 0 |
| 1-21 | 180 | 4.5 | 0.42 | 0.53 | 0.11 | 420 | 0 |
| 1-22 | 80 | 3.3 | 0.35 | 0.41 | 0.06 | 200 | 0 |
| 1-23 | 800 | 15.0 | 0.82 | 1.05 | 0.23 | 700 | 0 |
| 1-24 | 950 | 18.5 | 0.89 | 1.17 | 0.28 | 780 | 0 |
| 1-25 | 50 | 3.1 | 0.30 | 0.38 | 0.08 | 120 | 0 |
| 1-26 | 20 | 25.3 | 0.68 | 0.90 | 0.22 | 340 | 0 |
| 1-27 | 500 | 11.2 | 0.69 | 0.81 | 0.12 | 600 | 0 |
| 1-28 | 520 | 13.5 | 0.69 | 0.86 | 0.17 | 630 | 0 |
| 1-29 | 600 | 9.1 | 0.79 | 0.92 | 0.13 | 650 | 0 |
| 1-30 | 650 | 12.3 | 0.82 | 1.00 | 0.18 | 700 | 0 |
| 1-31 | 600 | 9.1 | 0.75 | 1.01 | 0.26 | 640 | 0 |
| 1-32 | 600 | 9.1 | 0.88 | 1.15 | 0.27 | 680 | 0 |

TABLE 2

| | Abrasion dust quantity (deposition thickness) | Before formation of grooves | | After formation of grooves | |
|---|---|---|---|---|---|
| Example: | (μm) | We % | HU | We % | HU |
| 1-1 | 4.1 | 58 | 230 | 58 | 230 |
| 1-2 | 4.5 | 57 | 235 | 57 | 230 |
| 1-3 | 3.9 | 57 | 185 | 57 | 190 |
| 1-4 | 4.0 | 55 | 195 | 54 | 195 |
| 1-5 | 4.5 | 53 | 220 | 52 | 220 |
| 1-6 | 4.7 | 50 | 215 | 50 | 215 |
| 1-7 | 4.7 | 44 | 255 | 44 | 260 |
| 1-8 | 3.7 | 53 | 180 | 53 | 180 |
| 1-9 | 4.0 | 50 | 170 | 50 | 170 |
| 1-10 | 4.2 | 45 | 160 | 45 | 165 |
| 1-11 | 4.7 | 40 | 150 | 40 | 150 |
| 1-12 | 4.2 | 55 | 190 | 54 | 185 |
| 1-13 | 3.8 | 50 | 230 | 50 | 230 |
| 1-14 | 4.2 | 46 | 210 | 46 | 210 |
| 1-15 | 4.5 | 44 | 230 | 44 | 235 |
| 1-16 | 3.5 | 55 | 185 | 55 | 190 |
| 1-17 | 4.2 | 45 | 170 | 45 | 170 |
| 1-18 | 4.8 | 40 | 170 | 40 | 165 |
| 1-19 | 4.8 | 44 | 220 | 44 | 220 |
| 1-20 | 3.8 | 65 | 210 | 65 | 210 |
| 1-21 | 3.1 | 57 | 235 | 57 | 230 |
| 1-22 | 2.4 | 57 | 235 | 56 | 235 |
| 1-23 | 4.6 | 57 | 235 | 57 | 235 |
| 1-24 | 4.8 | 57 | 235 | 57 | 230 |
| 1-25 | 2.0 | 57 | 235 | 56 | 235 |
| 1-26 | 4.2 | 57 | 235 | 56 | 235 |
| 1-27 | 4.0 | 50 | 170 | 50 | 170 |
| 1-28 | 4.0 | 50 | 170 | 50 | 170 |
| 1-29 | 4.0 | 57 | 235 | 56 | 230 |
| 1-30 | 4.2 | 57 | 235 | 56 | 230 |
| 1-31 | 4.4 | 57 | 235 | 57 | 230 |
| 1-32 | 3.8 | 57 | 235 | 57 | 235 |

TABLE 3

(scr.: scratches)

| | Initial-stage electrophotographic characteristics | | | After 100,000-sheet running test | | | | |
|---|---|---|---|---|---|---|---|---|
| Example: | Dark = area potential Vd (−V) | Optical attenuation sensitivity (μJ/cm$^2$) | Residual potential Vsl (−V) | Image defects | Actual use abrasion amount (μm) | Deep scr. | Toner melt adhesion | Toner migrating to back |
| 1-1 | 650 | 0.36 | 50 | None. | 2.00 | B | B | A |
| 1-2 | 650 | 0.30 | 30 | None. | 2.25 | B | B | A |
| 1-3 | 650 | 0.40 | 50 | None. | 0.90 | A | A | A |

TABLE 3-continued (scr.: scratches)

| | Initial-stage electrophotographic characteristics | | | After 100,000-sheet running test | | | | |
|---|---|---|---|---|---|---|---|---|
| Example: | Dark = area potential Vd (−V) | Optical attenuation sensitivity (μJ/cm$^2$) | Residual potential Vsl (−V) | Image defects | Actual use abrasion amount (μm) | Deep scr. | Toner melt adhesion | Toner migrating to back |
| 1-4 | 650 | 0.45 | 80 | None. | 0.91 | A | A | A |
| 1-5 | 650 | 0.40 | 55 | None. | 1.02 | B | B | A |
| 1-6 | 650 | 0.40 | 55 | None. | 1.15 | B | B | A |
| 1-7 | 650 | 0.42 | 70 | None. | 2.20 | B | A | A |
| 1-8 | 650 | 0.39 | 55 | None. | 0.75 | A | A | A |
| 1-9 | 650 | 0.40 | 55 | None. | 0.69 | A | A | A |
| 1-10 | 650 | 0.39 | 65 | None. | 0.55 | B | B | A |
| 1-11 | 650 | 0.42 | 85 | None. | 0.44 | C | B | A |
| 1-12 | 650 | 0.45 | 85 | None. | 1.05 | A | A | A |
| 1-13 | 650 | 0.40 | 60 | None. | 1.10 | B | B | A |
| 1-14 | 650 | 0.42 | 45 | None. | 1.52 | B | A | A |
| 1-15 | 650 | 0.45 | 35 | None. | 10.00 | C | A | C |
| 1-16 | 650 | 0.38 | 30 | None. | 0.70 | A | A | A |
| 1-17 | 650 | 0.40 | 45 | None. | 0.80 | B | B | A |
| 1-18 | 650 | 0.36 | 25 | None. | 1.05 | C | B | B |
| 1-19 | 650 | 0.40 | 55 | None. | 1.15 | C | A | B |
| 1-20 | 650 | 0.45 | 75 | None. | 0.50 | A | A | A |
| 1-21 | 650 | 0.30 | 30 | None. | 2.25 | B | A | A |
| 1-22 | 650 | 0.30 | 30 | None. | 2.25 | B | A | A |
| 1-23 | 650 | 0308 | 30 | None. | 2.25 | B | B | A |
| 1-24 | 650 | 0.30 | 30 | None. | 2.25 | B | B | A |
| 1-25 | 650 | 0.30 | 30 | None. | 2.60 | B | A | C |
| 1-26 | 650 | 0.30 | 30 | None. | 2.12 | B | B | A |
| 1-27 | 650 | 0.40 | 55 | None. | 0.69 | A | A | A |
| 1-28 | 650 | 0.40 | 55 | None. | 0.69 | A | A | A |
| 1-29 | 650 | 0.30 | 30 | None. | 2.27 | B | B | A |
| 1-30 | 650 | 0.30 | 30 | None. | 2.27 | B | B | A |
| 1-31 | 650 | 0.30 | 30 | None. | 2.27 | B | B | A |
| 1-32 | 650 | 0.30 | 30 | None. | 2.27 | B | B | A |

Example 1-33

An electrophotographic photosensitive member was produced in the same manner as in Example 1-2 except that, in Example 1-2, the peripheral surface of the abrading object was abraded in the following way.

That is, using an abrasive sheet AX-1500 (abrasive grains: alumina particles of 12 μm in average particle diameter; substrate: polyester film of 75 μm in thickness; count: 1500) available from Fuji Photo Film Co., Ltd., the peripheral surface of the abrading object was subjected to abrading for 250 seconds, setting the feed speed of the abrasive sheet to be 250 mm/min., setting the number of revolutions of the abrading object to be 15 rpm, setting the pressure to press the abrasive sheet against the abrading object to be 4 N/m$^2$, setting the feed direction of the abrasive sheet and the rotational direction of the abrading object to be "with", and using a back-up roller of 40 cm in outer diameter and 40 in Asker-C hardness. Thus, grooves were formed on the peripheral surface of the abrading object in its peripheral direction.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 4 to 6.

Example 1-34

An electrophotographic photosensitive member was produced in the same manner as in Example 1-33 except that, in Example 1-33, in abrading the peripheral surface of the abrading object, the pressure 4 N/m$^2$ at which the abrasive sheet was pressed against the abrading object was changed to 3.5 N/m$^2$ and that the time 250 seconds for which the peripheral surface of the abrading object was abraded was changed to 400 seconds.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 4 to 6.

Example 1-35

An electrophotographic photosensitive member was produced in the same manner as in Example 1-2 except that, in Example 1-2, the peripheral surface of the abrading object was abraded in the following way.

That is, using an abrasive sheet AX-1000 (abrasive grains: alumina particles of 16 μm in average particle diameter; substrate: polyester film of 75 μm in thickness; count: 1000) available from Fuji Photo Film Co., Ltd., the peripheral surface of the abrading object was subjected to abrading for 400 seconds, setting the feed speed of the abrasive sheet to 250 mm/min., setting the number of revolutions of the abrading object to be 15 rpm, setting the pressure to press the abrasive sheet against the abrading object to be 3.5 $N/m^2$, setting the feed direction of the abrasive sheet and the rotational direction of the abrading object to be "with", and using a back-up roller of 40 cm in outer diameter and 40 in Asker-C hardness. Thus, grooves were formed on the peripheral surface of the abrading object in its peripheral direction.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 4 to 6.

Example 1-36

An electrophotographic photosensitive member was produced in the same manner as in Example 1-2 except that, in Example 1-2, the peripheral surface of the abrading object was abraded in the following way.

That is, using an abrasive sheet AX-5000 (abrasive grains: alumina particles of 2 μm in average particle diameter; substrate: polyester film of 75 μm in thickness; count: 5000) available from Fuji Photo Film Co., Ltd., the peripheral surface of the abrading object was subjected to abrading for 250 seconds, setting the feed speed of the abrasive sheet to be 250 mm/min., setting the number of revolutions of the abrading object to be 15 rpm, setting the pressure to press the abrasive sheet against the abrading object to be 2.5 $N/m^2$, setting the feed direction of the abrasive sheet and the rotational direction of the abrading object to be "with", and using a back-up roller of 40 cm in outer diameter and 40 in Asker-C hardness. Thus, grooves were formed on the peripheral surface of the abrading object in its peripheral direction.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 4 to 6.

Example 1-37

An electrophotographic photosensitive member was produced in the same manner as in Example 1-2 except that, in Example 1-2, the feed direction of the abrasive sheet and the rotational direction of the abrading object in abrading the peripheral surface of the abrading object were changed from "with" to "counter".

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 4 to 6.

Example 1-38

An electrophotographic photosensitive member was produced in the same manner as in Example 1-2 except that, in Example 1-2, the rotational direction of the abrading object in abrading the peripheral surface of the abrading object was reversed at intervals of 150 seconds.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 4 to 6.

Example 1-39

An electrophotographic photosensitive member was produced in the same manner as in Example 1-9 except that, in Example 1-9, in abrading the peripheral surface of the abrading object, the abrading object was moved as shown in FIG. 6 so that the average angle of the grooves formed on the peripheral surface of the abrading object came to be 5 degrees to the peripheral direction.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 4 to 6.

Example 1-40

An electrophotographic photosensitive member was produced in the same manner as in Example 1-39 except that, in Example 1-39, the level of movement of the electrophotographic photosensitive member was so changed that the average angle of the grooves formed on the peripheral surface of the abrading object came to be 52 degrees to the peripheral direction.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 4 to 6.

Example 1-41

An electrophotographic photosensitive member was produced in the same manner as in Example 1-9 except that, in Example 1-9, in abrading the peripheral surface of the abrading object, as shown in FIG. 8, the back-up roller was reciprocally moved at a stroke width of 8 mm so that the average angle of the grooves formed on the peripheral surface of the abrading object came to be ±35 degrees to the peripheral direction (grooves of ±35 degrees and grooves of −35 degrees cross).

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 4 to 6.

Example 1-42

An electrophotographic photosensitive member was produced in the same manner as in Example 1-41 except that, in Example 1-41, the reciprocal movement of the back-up roller was changed from "reciprocal movement at a stroke width of 8 mm" to "reciprocal movement at a stroke width of 4 mm" so that the average angle of the grooves formed on the peripheral surface of the abrading object thereby came to be ±15 degrees to the peripheral direction (grooves of +15 degrees and grooves of −15 degrees cross).

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 4 to 6.

Example 1-43

An electrophotographic photosensitive member was produced in the same manner as in Example 1-2 except that, in Example 1-2, in abrading the peripheral surface of the abrading object, the pressure to press the abrasive sheet against the abrading object was set to be 10.5 $N/m^2$ and that as shown in FIG. 11, a brush was brought into contact with the peripheral surface of the abrading object so as to remove the abrasion dust present on the peripheral surface of the abrading object. In addition, as for the brush, its mandrel diameter was 12 mm, the ear length was 5 mm, the material for ears (wool) was an acrylic resin, the resistivity was $10^3$ Ωcm, the thickness of each ear was 6 deniers (0.66 mg/m) and the number of ears was 150 $F/mm^2$, where the penetration level of the brush into the abrading object was set to be 1 mm and the brush was rotated at 60 rpm in the direction opposite to the rotational direction of the abrading object. The roller collecting the abrasion dust from the brush was 10 mm in outer diameter, the voltage applied to the roller was +100 V, and the roller was rotated at 60 rpm in the direction opposite to the rotational direction of the brush.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 4 to 6.

Example 1-44

An electrophotographic photosensitive member was produced in the same manner as in Example 1-43 except that, in Example 1-43, after the abrading of the peripheral surface of the abrading object was completed, the abrasive sheet was separated from the abrading object, and the abrading object and the brush were operated for 3 minutes as they were kept in contact with each other.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 4 to 6.

Example 1-45

An electrophotographic photosensitive member was produced in the same manner as in Example 1-44 except that, in Example 1-44, the brush was changed to a brush in which its mandrel diameter was 12 mm, the ear length was 5 mm, the material for ears (wool) was a polyamide resin, the resistivity was 10 Ωcm, the thickness of each ear was 6 deniers (0.66 mg/m) and the number of ears was 150 $F/mm^2$.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 4 to 6.

Example 1-46

An electrophotographic photosensitive member was produced in the same manner as in Example 1-44 except that, in Example 1-44, the brush was changed to a brush in which its mandrel diameter was 12 mm, the ear length was 5 mm, the material for ears (wool) was a polyethylene resin, the resistivity was $10^6$ Ωcm, the thickness of each ear was 6 deniers (0.66 mg/m) and the number of ears was 150 F/mm$^2$.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 4 to 6.

Example 1-47

An electrophotographic photosensitive member was produced in the same manner as in Example 1-44 except that, in Example 1-44, the brush was changed to a brush in which its mandrel diameter was 12 mm, the ear length was 5 mm, the material for ears (wool) was an aramid resin, the resistivity was $10^2$ Ωcm, the thickness of each ear was 6 deniers (0.66 mg/m) and the number of ears was 150 F/mm$^2$.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 4 to 6.

Example 1-48

An electrophotographic photosensitive member was produced in the same manner as in Example 1-43 except that, in Example 1-43, the brush was changed to a brush in which its mandrel diameter was 12 mm, the ear length was 5 mm, the material for ears (wool) was an acrylic resin, the resistivity was $10^3$ Ωcm, the thickness of each ear was 3 deniers (0.33 mg/m) and the number of ears was 310 F/mm$^2$.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 4 to 6.

Example 1-49

An electrophotographic photosensitive member was produced in the same manner as in Example 1-43 except that, in Example 1-43, the brush was changed for a brush in which its mandrel diameter was 12 mm, the ear length was 5 mm, the material for ears (wool) was an acrylic resin, the resistivity was $10^3$ Ωcm, the thickness of each ear was 10 deniers (1.11 mg/m) and the number of ears was 120 F/mm$^2$.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 4 to 6.

Example 1-50

An electrophotographic photosensitive member was produced in the same manner as in Example 1-43 except that, in Example 1-43, as shown in FIG. 10, a scraper was pressed against the brush so as to remove the abrasion dust of the brush. In addition, the scraper was one made of aluminum and having a thickness of 3 mm, where the penetration level of the scraper into the brush was set to be 1.5 mm, and the scraper was grounded.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 4 to 6.

Example 1-51

An electrophotographic photosensitive member was produced in the same manner as in Example 1-43 except that, in Example 1-43, a blade as shown in FIG. 12 was used in place of the brush. In addition, the blade was one made of a urethane resin and having a hardness of 80 degrees, and was set at a pressure of 3 g/mm.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 4 to 6.

Example 1-52

An electrophotographic photosensitive member was produced in the same manner as in Example 1-51 except that, in Example 1-51, after the abrading of the peripheral surface of the abrading object was completed, the abrasive sheet was separated from the abrading object, and the abrading object and the blade were operated for 5 minutes as they were kept in contact with each other.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 4 to 6.

Example 1-53

An electrophotographic photosensitive member was produced in the same manner as in Example 1-43 except that, in Example 1-43, a blade was additionally provided as in Example 1-51.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 4 to 6.

Example 1-54

An electrophotographic photosensitive member was produced in the same manner as in Example 1-53 except that, in Example 1-53, after the abrading of the peripheral surface of the abrading object was completed, the abrasive sheet was separated from the abrading object, and the abrading object and the blade were operated for 5 minutes as they were kept in contact with each other.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 4 to 6.

Example 1-55

An electrophotographic photosensitive member was produced in the same manner as in Example 1-54 except that, in Example 1-54, after the abrasive sheet was separated from the abrading object, and the abrading object and the blade were operated for 5 minutes as they were kept in contact with each other (i.e., after the first cleaning step), the second cleaning step was further carried out using such an assembly as shown in FIG. 13.

More specifically, using a scrubbing sheet (Mastertec), the scrubbing sheet feed speed was set to be 10 mm/min., the number of revolutions of the abrading object was set to be 60 rpm, the pressure of pressing the scrubbing sheet against the abrading object was set to be 15 $N/m^2$, and the rotational direction of the scrubbing sheet was set to be opposite to the rotational direction of the electrophotographic photosensitive member. Also, using a back-up roller of 40 in Asker-C hardness, the second cleaning step was carried out for 300 seconds.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 4 to 6.

Example 1-56

An electrophotographic photosensitive member was produced in the same manner as in Example 1-55 except that, in Example 1-55, the scrubbing sheet was impregnated with distilled water.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the charge transport layer) were measured.

The results of measurement and results of evaluation in the foregoing are shown in Tables 4 to 6.

Example 1-57

An electrophotographic photosensitive member was produced in the same manner as in Example 1-16 except that, in Example 1-16, the peripheral surface of the abrading object was abraded using a combination of the brush in Example 1-50 and the blade in Example 1-51 and that, after the abrading was completed, the abrasive sheet was separated from the abrading object, and the abrading object and the brush and blade were operated for 5 minutes as they were kept in contact with each other.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 4 to 6.

Example 1-58

An electrophotographic photosensitive member was produced in the same manner as in Example 1-57 except that, in Example 1-57, after the abrasive sheet was separated from the abrading object, and the abrading object and the blade were operated for 5 minutes as they were kept in contact with each other, the same second cleaning step as in Example 1-56 was carried out.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 4 to 6.

Example 1-59

An electrophotographic photosensitive member was produced in the same manner as in Example 1-9 except that, in Example 1-9, the peripheral surface of the abrading object was abraded using a combination of the magnetic brush shown in FIG. 14 and the blade in Example 1-51. In addition, the magnetic brush was a magnetic brush making use of metallic particles (ferrite particles; average particle diameter: 30 μm), and was grounded.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 4 to 6.

In addition, when the abrasion dust on the edge of the blade was examined, metallic particles were seen in the vicinity of the edge.

Example 1-60

An electrophotographic photosensitive member was produced in the same manner as in Example 1-59 except that, in Example 1-59, voltage of −500 V was added to the magnetic brush.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 4 to 6.

In addition, when the abrasion dust on the edge of the blade was examined, metallic particles were seen in the vicinity of the edge, while the number of the particles is smaller than that in Example 1-59.

Example 1-61

An electrophotographic photosensitive member was produced in the same manner as in Example 1-59 except that, in Example 1-59, a magnet was provided between the blade and the magnetic brush.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 4 to 6.

In addition, when the abrasion dust on the edge of the blade was examined, almost no metallic particles were seen in the vicinity of the edge.

Example 1-62

An electrophotographic photosensitive member was produced in the same manner as in Example 1-61 except that, in Example 1-61, in place of the magnet, a roller of 10 mm in diameter was provided at a position of 0.5 mm in distance from the electrophotographic photosensitive member, and voltage of −300 V was added to the roller.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 4 to 6.

In addition, when the abrasion dust on the edge of the blade was examined, metallic particles were little seen in the vicinity of the edge.

Example 1-63

An electrophotographic photosensitive member was produced in the same manner as in Example 1-61 except that, in Example 1-61, the same brush as that in Example 1-43 was provided between the magnet and the blade, and voltage of −100 V was applied to the brush.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 4 to 6.

In addition, when the abrasion dust on the edge of the blade was examined, almost no metallic particles were seen in the vicinity of the edge.

Example 1-64

An electrophotographic photosensitive member produced in the same manner as in Example 1-9 was immersed in ethanol for 20 minutes and simultaneously subjected to ultrasonic cleaning, and used in this EXAMPLE The groove density, groove width, Rz, Rmax, ΣWn and groove average angle of the peripheral surface of the electrophotographic photosensitive member produced were measured.

The electrophotographic photosensitive member produced was evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Example, the second charge transport layer) were measured.

The results of measurement and results of evaluation in the foregoing are shown in Tables 4 to 6.

TABLE 4

| Example: | Groove density | Groove width (max) (μm) | Rz (μm) | Rmax (μm) | Rmax − Rz (μm) | ΣWn | Groove average angle (E) |
|---|---|---|---|---|---|---|---|
| 1-33 | 500 | 25.0 | 0.85 | 1.02 | 0.17 | 650 | 0 |
| 1-34 | 850 | 30.0 | 0.95 | 1.14 | 0.19 | 770 | 0 |
| 1-35 | 300 | 40.0 | 1.22 | 1.32 | 0.10 | 710 | 0 |
| 1-36 | 800 | 1.0 | 0.30 | 0.56 | 0.26 | 420 | 0 |
| 1-37 | 250 | 5.3 | 0.44 | 0.50 | 0.06 | 470 | 0 |
| 1-38 | 390 | 6.1 | 0.58 | 0.70 | 0.12 | 520 | 0 |
| 1-39 | 500 | 11.2 | 0.69 | 0.81 | 0.12 | 600 | 5 |
| 1-40 | 350 | 14.2 | 0.60 | 0.72 | 0.12 | 510 | 52 |
| 1-41 | 650 | 13.5 | 0.65 | 0.75 | 0.10 | 730 | ±35 |
| 1-42 | 800 | 12.2 | 0.66 | 0.85 | 0.19 | 750 | ±15 |
| 1-43 | 550 | 8.5 | 0.61 | 0.78 | 0.17 | 670 | 0 |
| 1-44 | 550 | 8.5 | 0.61 | 0.78 | 0.17 | 670 | 0 |
| 1-45 | 550 | 8.5 | 0.61 | 0.78 | 0.17 | 670 | 0 |
| 1-46 | 550 | 8.5 | 0.61 | 0.78 | 0.17 | 670 | 0 |
| 1-47 | 550 | 8.5 | 0.61 | 0.78 | 0.17 | 670 | 0 |
| 1-48 | 550 | 8.5 | 0.61 | 0.78 | 0.17 | 670 | 0 |
| 1-49 | 550 | 8.5 | 0.61 | 0.78 | 0.17 | 670 | 0 |
| 1-50 | 550 | 8.5 | 0.61 | 0.78 | 0.17 | 670 | 0 |
| 1-51 | 420 | 10.4 | 0.62 | 0.83 | 0.21 | 650 | 0 |
| 1-52 | 420 | 10.4 | 0.62 | 0.83 | 0.21 | 650 | 0 |
| 1-53 | 420 | 10.4 | 0.62 | 0.83 | 0.21 | 650 | 0 |
| 1-54 | 420 | 10.4 | 0.62 | 0.83 | 0.21 | 650 | 0 |
| 1-55 | 420 | 10.4 | 0.62 | 0.83 | 0.21 | 630 | 0 |
| 1-56 | 420 | 10.4 | 0.62 | 0.83 | 0.21 | 620 | 0 |
| 1-57 | 330 | 9.5 | 0.50 | 0.58 | 0.08 | 650 | 0 |
| 1-58 | 330 | 9.5 | 0.50 | 0.58 | 0.08 | 650 | 0 |
| 1-59 | 500 | 11.2 | 0.69 | 0.81 | 0.12 | 640 | 0 |
| 1-60 | 500 | 11.2 | 0.69 | 0.81 | 0.12 | 640 | 0 |
| 1-61 | 500 | 11.2 | 0.69 | 0.81 | 0.12 | 640 | 0 |

TABLE 4-continued

| Example: | Groove density | Groove width (max) (μm) | Rz (μm) | Rmax (μm) | Rmax − Rz (μm) | ΣWn | Groove average angle (E) |
|---|---|---|---|---|---|---|---|
| 1-62 | 500 | 11.2 | 0.69 | 0.81 | 0.12 | 640 | 0 |
| 1-63 | 500 | 11.2 | 0.69 | 0.81 | 0.12 | 640 | 0 |
| 1-64 | 500 | 11.2 | 0.69 | 0.81 | 0.12 | 620 | 0 |

TABLE 5

| Example: | Abrasion dust quantity (deposition thickness) (μm) | Before formation of grooves We % | Before formation of grooves HU | After formation of grooves We % | After formation of grooves HU |
|---|---|---|---|---|---|
| 1-33 | 4.5 | 57 | 235 | 57 | 235 |
| 1-34 | 4.5 | 57 | 235 | 56 | 235 |
| 1-35 | 5.0 | 57 | 235 | 57 | 230 |
| 1-36 | 1.0 | 57 | 235 | 56 | 235 |
| 1-37 | 4.2 | 57 | 235 | 57 | 235 |
| 1-38 | 3.7 | 57 | 235 | 57 | 235 |
| 1-39 | 4.0 | 50 | 170 | 50 | 165 |
| 1-40 | 4.0 | 50 | 170 | 50 | 165 |
| 1-41 | 4.0 | 50 | 170 | 50 | 165 |
| 1-42 | 4.0 | 50 | 170 | 50 | 165 |
| 1-43 | 4.0 | 57 | 235 | 57 | 235 |

TABLE 5-continued

| Example: | Abrasion dust quantity (deposition thickness) (μm) | Before formation of grooves We % | Before formation of grooves HU | After formation of grooves We % | After formation of grooves HU |
|---|---|---|---|---|---|
| 1-44 | 3.0 | 57 | 235 | 57 | 235 |
| 1-45 | 3.2 | 57 | 235 | 56 | 235 |
| 1-46 | 3.6 | 57 | 235 | 57 | 235 |
| 1-47 | 2.8 | 57 | 235 | 57 | 235 |
| 1-48 | 4.3 | 57 | 235 | 56 | 235 |
| 1-49 | 4.5 | 57 | 235 | 57 | 235 |
| 1-50 | 4.0 | 57 | 235 | 57 | 230 |
| 1-51 | 3.2 | 57 | 235 | 57 | 235 |
| 1-52 | 2.2 | 57 | 235 | 57 | 235 |
| 1-53 | 1.8 | 57 | 235 | 56 | 235 |
| 1-54 | 1.3 | 57 | 235 | 57 | 235 |
| 1-55 | 0.5 | 57 | 235 | 57 | 235 |
| 1-56 | 0.2 | 57 | 235 | 57 | 230 |
| 1-57 | 1.5 | 55 | 185 | 55 | 185 |
| 1-58 | 0.1 | 55 | 185 | 55 | 190 |
| 1-59 | 4.0 | 50 | 170 | 50 | 170 |
| 1-60 | 4.0 | 50 | 170 | 50 | 170 |
| 1-61 | 4.0 | 50 | 170 | 50 | 170 |
| 1-62 | 4.0 | 50 | 170 | 50 | 170 |
| 1-63 | 4.0 | 50 | 170 | 50 | 175 |
| 1-64 | 2.1 | 50 | 170 | 50 | 170 |

TABLE 6

(scr.: scratches)

| Example: | Initial-stage electrophotographic characteristics: Dark = area potential Vd (−V) | Initial-stage electrophotographic characteristics: Optical attenuation sensitivity (μJ/cm$^2$) | Initial-stage electrophotographic characteristics: Residual potential Vsl (−V) | After 100,000-sheet running test: Image defects | After 100,000-sheet running test: Actual use abrasion amount (μm) | After 100,000-sheet running test: Deep scr. | After 100,000-sheet running test: Toner melt adhesion | After 100,000-sheet running test: Toner migrating to back |
|---|---|---|---|---|---|---|---|---|
| 1-33 | 650 | 0.30 | 30 | None. | 2.25 | B | B | A |
| 1-34 | 650 | 0.30 | 30 | None. | 2.25 | B | B | A |
| 1-35 | 650 | 0.30 | 30 | None. | 2.25 | B | B | B |
| 1-36 | 650 | 0.30 | 30 | None. | 2.25 | B | A | C |
| 1-37 | 650 | 0.30 | 30 | None. | 2.25 | B | B | B |
| 1-38 | 650 | 0.30 | 30 | None. | 2.25 | B | B | A |
| 1-39 | 650 | 0.40 | 55 | None. | 0.69 | A | A | A |
| 1-40 | 650 | 0.40 | 55 | None. | 0.69 | A | A | A |
| 1-41 | 650 | 0.40 | 55 | None. | 0.65 | A | A | A |
| 1-42 | 650 | 0.40 | 55 | None. | 0.65 | A | A | A |
| 1-43 | 650 | 0.30 | 30 | None. | 2.27 | B | B | A |
| 1-44 | 650 | 0.30 | 30 | None. | 2.27 | B | A | A |
| 1-45 | 650 | 0.30 | 30 | None. | 2.27 | B | A | A |
| 1-46 | 650 | 0.30 | 30 | None. | 2.27 | B | B | A |
| 1-47 | 650 | 0.30 | 30 | None. | 2.27 | B | A | A |
| 1-48 | 650 | 0.30 | 30 | None. | 2.27 | B | B | A |
| 1-49 | 650 | 0.30 | 30 | None. | 2.27 | B | B | A |
| 1-50 | 650 | 0.30 | 30 | None. | 2.27 | B | B | A |
| 1-51 | 650 | 0.30 | 30 | None. | 2.27 | B | A | A |
| 1-52 | 650 | 0.30 | 30 | None. | 2.27 | B | A | A |
| 1-53 | 650 | 0.30 | 30 | None. | 2.27 | B | A | A |

TABLE 6-continued

| | Initial-stage | | | (scr.: scratches) After 100,000-sheet running test | | | | |
|---|---|---|---|---|---|---|---|---|
| | electrophotographic characteristics | | | | Actual | | | |
| Example: | Dark = area potential Vd (−V) | Optical attenuation sensitivity (μJ/cm$^2$) | Residual potential Vsl (−V) | Image defects | use abrasion amount (μm) | Deep scr. | Toner melt adhesion | Toner migrating to back |
| 1-54 | 650 | 0.30 | 30 | None. | 2.27 | B | A | A |
| 1-55 | 650 | 0.30 | 30 | None. | 2.27 | B | A | A |
| 1-56 | 650 | 0.30 | 30 | None. | 0.70 | B | A | A |
| 1-57 | 650 | 0.38 | 30 | None. | 0.70 | A | A | A |
| 1-58 | 650 | 0.38 | 30 | None. | 0.69 | A | A | A |
| 1-59 | 650 | 0.40 | 55 | None. | 0.69 | A | A | A |
| 1-60 | 650 | 0.40 | 55 | None. | 0.69 | A | A | A |
| 1-61 | 650 | 0.40 | 55 | None. | 0.69 | A | A | A |
| 1-62 | 650 | 0.40 | 55 | None. | 0.69 | A | A | A |
| 1-63 | 650 | 0.40 | 55 | None. | 0.69 | A | A | A |
| 1-64 | 650 | 0.40 | 55 | None. | 0.69 | A | A | A |

Comparative Example 1-1

In Example 1-1, an electrophotographic photosensitive member was produced without subjecting the peripheral surface of the abrading object to the abrading, and used in this Comparative Example.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation of the surface layer (in this Comparative Example, the charge transport layer) were measured.

The results of measurement and results of evaluation in the foregoing are shown in Tables 7 to 9.

In addition, as a result of the paper feed running test conducted, abnormal sounds were heard after about 5,000th sheet running. The cleaning blade turned in printing on 6,000th sheet.

Comparative Example 1-2

An electrophotographic photosensitive member was produced in the same manner as in Example 1-1 except that, in Example 1-1, the time 450 seconds for which the peripheral surface of the abrading object was abraded was changed to 50 seconds.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Comparative Example, the charge transport layer) were measured.

The results of measurement and results of evaluation in the foregoing are shown in Tables 7 to 9.

In addition, as a result of the paper feed running test conducted, line images were seen on halftone images after about 15,000th sheet running. The process cartridge (drum cartridge) was taken out to observe the cleaning blade, where the blade was seen to be chipped off at its edge.

Comparative Example 1-3

An electrophotographic photosensitive member was produced in the same manner as in Example 1-1 except that, in Example 1-1, the time 450 seconds for which the peripheral surface of the abrading object was abraded was changed to 30 minutes.

The groove density, groove width, Rz, Rmax, ΣWn and groove average angle of the peripheral surface of the electrophotographic photosensitive member produced were measured.

The electrophotographic photosensitive member produced was evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Comparative Example, the charge transport layer) were measured.

The results of measurement and results of evaluation in the foregoing are shown in Tables 7 to 9.

In addition, as a result of the paper feed running test conducted, the image density at areas where the value of Rmax−Rz was more than 0.3 was seen to be reduced.

Comparative Example 1-4

An electrophotographic photosensitive member was produced in the same manner as in Example 1-24 except that, in Example 1-24, the time 20 minutes for which the peripheral surface of the abrading object was abraded was changed to 30 minutes.

The groove density, groove width, Rz, Rmax, ΣWn and groove average angle of the peripheral surface of the electrophotographic photosensitive member produced were measured.

The electrophotographic photosensitive member produced was also evaluated in the same manner as in Example 1-1.

An electrophotographic photosensitive member for making measurement of deposition thickness was also produced in the same manner as in the above, and the deposition thickness of abrasion dust deposited on the air face of the blade made of polyurethane resin was measured.

An electrophotographic photosensitive member for making measurement of the universal hardness value (HU) and modulus of elastic deformation was still also produced in the same manner as in the above, and the universal hardness value (HU) and modulus of elastic deformation before and after the grooves were formed on the surface of the surface layer (in this Comparative Example, the charge transport layer) were measured.

The results of measurement and results of evaluation in the foregoing are shown in Tables 7 to 9.

In addition, as a result of the paper feed running test conducted, in the last half of the running test, line-shaped toner leakage was seen and image defects also occurred.

TABLE 7

| Comparative Example: | Groove density | Groove width (max) (μm) | Rz (μm) | Rmax (μm) | Rmax − Rz (μm) | ΣWn | Groove average angle (E) |
|---|---|---|---|---|---|---|---|
| 1-1 | — | — | 0.04 | 0.11 | 0.07 | — | — |
| 1-2 | 12 | 3.0 | 0.25 | 0.30 | 0.05 | 20 | 0 |
| 1-3 | 1,100 | 12.7 | 0.82 | 1.25 | 0.43 | 870 | 0 |
| 1-4 | 1,200 | 21.0 | 0.92 | 1.22 | 0.30 | 950 | 0 |

TABLE 8

| Comparative | Abrasion dust quantity (deposition thickness) | Before formation of grooves | | After formation of grooves | |
|---|---|---|---|---|---|
| Example: | (μm) | We % | HU | We % | HU |
| 1-1 | 0.0 | 58 | 230 | — | — |
| 1-2 | 0.4 | 58 | 230 | 58 | 230 |

TABLE 8-continued

| Comparative | Abrasion dust quantity (deposition thickness) | Before formation of grooves | | After formation of grooves | |
|---|---|---|---|---|---|
| Example: | (μm) | We % | HU | We % | HU |
| 1-3 | 6.0 | 58 | 230 | 58 | 230 |
| 1-4 | 5.0 | 57 | 235 | 56 | 235 |

TABLE 9

| | Initial-stage electrophotographic characteristics | | |
|---|---|---|---|
| Comparative Example: | Dark-area potential Vd (−V) | Optical attenuation sensitivity (μJ/cm$^2$) | Residual potential Vsl (−V) |
| 1-1 | 650 | 0.36 | 50 |
| 1-2 | 650 | 0.36 | 50 |
| 1-3 | 650 | 0.36 | 50 |
| 1-4 | 650 | 0.30 | 30 |

Examples 2-1 to 2-16 &

Comparative Examples 2-1 to 2-3

In Examples 2-1 to 2-16 and Comparative Examples 2-1 to 2-3, electrophotographic photosensitive members produced in the same manner as in Examples shown respectively in Table 10 were evaluated in the following way concerning image deletion and cleaning blade scraping in a high-temperature and high-humidity environment (32.5° C./85% RH).

More specifically, the copying machine used in Example 1-1 was placed in the environment of 32.5° C./85% RH, and a 10,000-sheet paper feed running test was conducted, and thereafter this copying machine was left standing for 3 days as it was. On the next day, images were reproduced to make evaluation on image deletion. Evaluation was also made on cleaning blade scraping caused by elevated torque between the peripheral surface of the electrophotographic photosensitive member and the cleaning blade during the paper feed running test. The results of evaluation are shown in Table 10.

TABLE 10

| | Electro-photographic Photosensitive member | image deletion | Cleaning blade scraping |
|---|---|---|---|
| Example: | | | |
| 2-1 | Ex. 1-1 | None. | None. |
| 2-2 | Ex. 1-3 | None. | None. |
| 2-3 | Ex. 1-7 | Image deletion occur over the whole areas. | None. |
| 2-4 | Ex. 1-8 | None. | None. |
| 2-5 | Ex. 1-9 | None. | None. |
| 2-6 | Ex. 1-10 | None. | None. |
| 2-7 | Ex. 1-11 | Density decrease due to image deletion in part. | None. |

TABLE 10-continued

| | Electro-photographic Photosensitive member | image deletion | Cleaning blade scraping |
|---|---|---|---|
| 2-8 | Ex. 1-16 | None. | None. |
| 2-9 | Ex. 1-21 | None. | None. |
| 2-10 | Ex. 1-22 | None. | Slightly occur after 9,000-sheet running. |
| 2-11 | Ex. 1-25 | None. | Slightly occur after 5,000-sheet running. |
| 2-12 | Ex. 1-27 | None. | None. |
| 2-13 | Ex. 1-35 | None. | None. |
| 2-14 | Ex. 1-56 | None. | None. |
| 2-15 | Ex. 1-57 | None. | None. |
| 2-16 | Ex. 1-58 | None. | None. |
| Comparative Example: | | | |
| 2-1 | Cp. 1-2 | None. | Occur after 1,000-sheet running. |
| 2-2 | Cp. 1-3 | Image deletion occur over the whole areas. | None. |
| 2-3 | Cp. 1-4 | Image deletion occur over the whole areas. | None. |

Ex.: Example,
Cp.: Comparative Example

The electrophotographic photosensitive members having the value of ΣWn of from 200 to 800 showed good evaluation results in respect of the image deletion and cleaning blade scraping. Those of less than 200 showed good evaluation results concerning the image deletion, but tended to cause the cleaning blade scraping because the contact area between the peripheral surface of the electrophotographic photosensitive member and the cleaning blade was so large as to tend to cause elevated torque between the two. Those of more than 800 showed good evaluation results concerning the cleaning blade scraping, but tended to cause the image deletion because the contact area between the peripheral surface of the electrophotographic photosensitive member and the cleaning blade was too small to achieve a sufficient effect of rubbing friction.

Examples 3-1 to 3-5 &

Comparative Examples 3-1, 3-2

In Examples 3-1 to 3-5 and Comparative Examples 3-1 and 3-2, electrophotographic photosensitive members produced in the same manner as in Examples shown respectively in Table 11 were evaluated in the following way concerning cleaning performance for toner in a low-temperature and low-humidity environment (22.5° C./5% RH).

More specifically, the copying machine used in Example 1-1 was placed in the environment of 22.5° C./85% RH, and a 10,000-sheet paper feed running test was conducted. Thereafter, images formed were evaluated, and also evaluation was made on toner migrating to the back in the same manner as in Example 1. The results of evaluation are shown in Table 11.

TABLE 11

| Example: | Electrophotographic photosensitive member | Image evaluation | Toner migrating to back |
|---|---|---|---|
| 3-1 | Ex. 1-1 | Good without faulty cleaning. | A |
| 3-2 | Ex. 1-9 | Good without faulty cleaning. | A |
| 3-3 | Ex. 1-16 | Good without faulty cleaning. | A |
| 3-4 | Ex. 1-18 | Good without faulty cleaning. | B |
| 3-5 | Ex. 1-35 | Good without faulty cleaning. | B |
| 3-1 | Cp. 1-4 | Faulty-cleaning images occur from the beginning. | — |
| 3-2 | Cp. 1-3 | Faulty-cleaning images occur from the beginning. | — |

Ex.: Example,
Cp.: Comparative Example

In cases where the Rz was 1.3 or less, no faulty cleaning appeared on images reproduced. However, in the observation of the cleaning blade, the toner tended to leak through the blade to migrate to its back, with an increase in the Rz. Also, as to electrophotographic photosensitive members of more than 1,000 in groove density, line-shaped faulty-cleaning images appeared from the initial stage of the running.

Examples 4-1 to 4-4

In Examples 4-1 to 4-4, electrophotographic photosensitive members produced in the same manner as in Examples shown respectively in Table 12 (except that the aluminum cylinder was changed to an aluminum cylinder of 370 mm in length and 84 mm in outer diameter) were each mounted to a modified machine of a copying machine iRC6800, manufactured by CANON INC., (which was so modified that a negative-charging organic electrophotographic photosensitive member was mountable). A 100,000-sheet feed running test was conducted in an A4 full-color 5-sheet intermittent mode, in an environment of 22.5° C./55% RH to examine whether image defects occurred. Also, the actual-use abrasion amount of each electrophotographic photosensitive member was measured and the electrophotographic photosensitive member and cleaning blade were observed, in the same manner as in Example 1-1. The results of evaluation are shown in Table 12.

TABLE 12

| Example: | Electrophotographic photosensitive member | Image defects | Actual use abrasion amount (μm) | Deep scratches | Toner melt adhesion | Toner migrating to back |
|---|---|---|---|---|---|---|
| 4-1 | Ex. 1-1 | None. | 1.0 | B | B | B |
| 4-2 | Ex. 1-3 | None. | 0.2 | A | A | A |

TABLE 12-continued

| Example: | Electrophotographic photosensitive member | Image defects | Actual use abrasion amount (μm) | Deep scratches | Toner melt adhesion | Toner migrating to back |
|---|---|---|---|---|---|---|
| 4-3 | Ex. 1-9 | None. | 0.2 | A | A | A |
| 4-4 | Ex. 1-11 | None. | 0.2 | C | C | B |

Ex.: Example

This application claims priority from Japanese Patent Application No. 2004-092099 filed Mar. 26, 2004, Japanese Patent Application No. 2004-131660 filed Apr. 27, 2004, and Japanese Patent Application No. 2004-308309 filed Oct. 22, 2004 which are hereby incorporated by reference herein.

The invention claimed is:

1. A cylindrical electrophotographic photosensitive member which comprises a cylindrical support and an organic photosensitive layer having a cured surface layer provided on the cylindrical support, wherein;

a plurality of grooves each having width in the range of from 0.5 μm to 40 μm are formed on the peripheral surface of said electrophotographic photosensitive member substantially in the peripheral direction of the peripheral surface;

the number of the grooves is from 20 lines to 1,000 lines per 1,000 μm in width in the generatrix direction of the peripheral surface; the peripheral surface of said electrophotographic photosensitive member has a modulus of elastic deformation of from 45% to 65%; and the peripheral surface of said electrophotographic photosensitive member has a universal hardness value HU of from 150 $N/mm^2$ to 210 $N/mm^2$.

2. The electrophotographic photosensitive member according to claim 1, which satisfies the following relation (a):

$$200 \leqq \sum_{n=1}^{i} Wn \leqq 800 \quad \text{(a)}$$

wherein the number of grooves is i-lines per 1,000 μm in width ($20 \leqq i \leqq 1{,}000$) of the generatrix direction of said peripheral surface, and widths of the i-lines of grooves are represented by $W_1$ to $W_i$.

3. The electrophotographic photosensitive member according to claim 1 or 2, wherein the peripheral surface of said electrophotographic photosensitive member has a ten-point average surface roughness Rz of from 0.3 μm to 1.3 μm, and has a difference between the ten-point average surface roughness Rz and a maximum surface roughness Rmax of the peripheral surface, Rmax−Rz, of 0.3 μm or less.

4. The electrophotographic photosensitive member according to claim 1 or claim 2, wherein said grooves cross one another.

5. The electrophotographic photosensitive member according to claim 1 wherein the modulus of elastic deformation of the peripheral surface of said electrophotographic photosensitive member is from 50% to 65%.

6. A process cartridge which comprises the electrophotographic photosensitive member according to claim 1 or claim 2, and at least one means selected from the group consisting of a charging means, a developing means, a transfer means and a cleaning means, which are integrally supported; the process cartridge being detachably mountable to a main body of an electrophotographic apparatus.

7. An electrophotographic apparatus which comprises the electrophotographic photosensitive member according to claim 1 or claim 2, a charging means, an exposure means, a developing means and a transfer means.

8. The electrophotographic apparatus according to claim 7, which further comprises a cleaning means.

* * * * *

UNITED STATES PATENT AND TRADEMARK OFFICE

CERTIFICATE OF CORRECTION

PATENT NO. : 7,186,489 B2
APPLICATION NO. : 11/225061
DATED : March 6, 2007
INVENTOR(S) : Hiroki Uematsu et al.

It is certified that error appears in the above-identified patent and that said Letters Patent is hereby corrected as shown below:

COLUMN 1

Line 7, "ELECTROPHOTOGRAPHIC APPARATUS" should read
--ELECTROPHOTOGRAPHIC APPARATUS ¶
This application is a continuation of International Application No. PCT/JP2005/006427, filed March 25, 2005, which claims the benefit of Japanese Patent Application No. 2004-092099 filed March 26, 2004, Japanese Patent Application No. 2004-131660 filed April 27, 2004 and Japanese Patent Application No. 2004-308309 filed October 22, 2004.--.

COLUMN 5

Line 47, "is "1")," should read --is "i"),--.

COLUMN 17

Line 60, "object 11 4." should read --object 104.--.

COLUMN 23

Formula, " 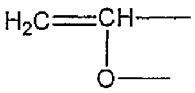 " should read -- 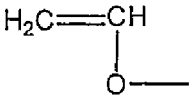 --.

COLUMN 24

Line 43, "$R^{11}$ to $R^{14}$" should read --$R^{11}$ to $R^{14}$--.

COLUMN 72

Line 42, "1 μmm" should read --7 μm,--.

COLUMN 90

Line 60, "($5\times10^3$ Gy)," should read --($5\times10^3$ Gy),--.

COLUMN 91

Line 58, "($1.5\times10^4$ Gy)," should read --($1.5\times10^4$ Gy),--.

UNITED STATES PATENT AND TRADEMARK OFFICE

CERTIFICATE OF CORRECTION

PATENT NO. : 7,186,489 B2
APPLICATION NO. : 11/225061
DATED : March 6, 2007
INVENTOR(S) : Hiroki Uematsu et al.

It is certified that error appears in the above-identified patent and that said Letters Patent is hereby corrected as shown below:

COLUMN 91-92

Formula 22, "

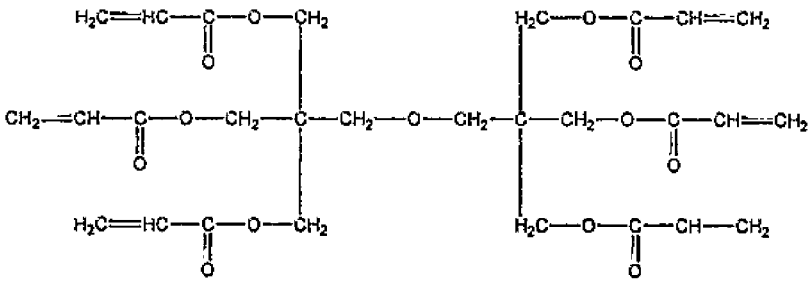

"

should read

--

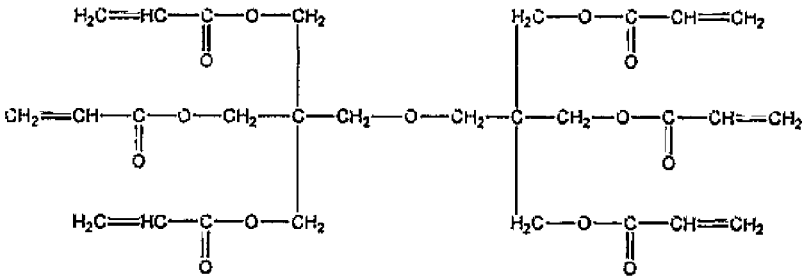

--.

COLUMN 109

Line 27, "1-1" should read --1-1.--.

COLUMN 118

Line 14, "EXAMPLE" should read --EXAMPLE.--.

UNITED STATES PATENT AND TRADEMARK OFFICE

CERTIFICATE OF CORRECTION

PATENT NO. : 7,186,489 B2
APPLICATION NO. : 11/225061
DATED : March 6, 2007
INVENTOR(S) : Hiroki Uematsu et al.

It is certified that error appears in the above-identified patent and that said Letters Patent is hereby corrected as shown below:

COLUMN 126

Line 40, "Table 12" should read --Table 11--; and
Line 52, "measured" should read --measured,--.

Signed and Sealed this

Eighteenth Day of December, 2007

JON W. DUDAS
*Director of the United States Patent and Trademark Office*